US006391533B1

(12) United States Patent
Mikoshiba et al.

(10) Patent No.: US 6,391,533 B1
(45) Date of Patent: May 21, 2002

(54) SILVER HALIDE COLOR PHOTOSENSITIVE MATERIAL AND COLOR IMAGE FORMING METHOD USING THE SAME

(75) Inventors: Hisashi Mikoshiba; Yoshio Shimura; Naoto Matsuda, all of Minami-Ashigara (JP)

(73) Assignee: Fuji Photo Film Co., Ltd., Ashigara (JP)

( * ) Notice: Subject to any disclaimer, the term of this patent is extended or adjusted under 35 U.S.C. 154(b) by 0 days.

(21) Appl. No.: 09/897,043

(22) Filed: Jul. 3, 2001

Related U.S. Application Data

(63) Continuation-in-part of application No. 09/324,122, filed on Jun. 2, 1999, which is a continuation-in-part of application No. 09/172,030, filed on Oct. 14, 1998, now Pat. No. 6,159,671.

(51) Int. Cl.[7] ..... G03C 1/08; G03C 7/26; G03C 7/32

(52) U.S. Cl. ..... 430/558; 430/386; 430/379

(58) Field of Search ..... 430/543, 558, 430/386, 379

(56) References Cited

U.S. PATENT DOCUMENTS

| | | | |
|---|---|---|---|
| 4,835,094 | A | 5/1989 | Wolff et al. |
| 4,960,685 | A | 10/1990 | Bowne |
| 4,994,351 | A | 2/1991 | Haga et al. |
| 5,272,049 | A | 12/1993 | Sakanoue et al. |
| 5,340,706 | A | 8/1994 | Naruse et al. |
| 5,368,998 | A | 11/1994 | Ishidai et al. |
| 5,384,236 | A | 1/1995 | Matsuoka et al. |
| 5,605,788 | A | 2/1997 | Kawagishi et al. |
| 5,667,952 | A | 9/1997 | Tang et al. |
| 5,688,964 | A | 11/1997 | Romanet et al. |
| 5,698,386 | A | 12/1997 | Tang et al. |
| 5,756,274 | A | 5/1998 | Matsuda et al. |
| 5,858,635 | A | 1/1999 | Nakamine et al. |
| 5,972,574 | A | 1/1999 | Fischer et al. |
| 5,972,587 | A | 10/1999 | Romanet et al. |
| 6,074,810 | A | 6/2000 | Kawagishi et al. |
| 6,159,671 | A | 12/2000 | Matsuda et al. |

FOREIGN PATENT DOCUMENTS

| | | | |
|---|---|---|---|
| JP | 4163548 | A | 6/1992 |
| JP | 4-289852 | * | 10/1992 |
| JP | 10186603 | | 7/1998 |
| JP | 11119393 | | 4/1999 |

* cited by examiner

*Primary Examiner*—Geraldine Letscher

(74) *Attorney, Agent, or Firm*—Birch, Stewart, Kolasch & Birch, LLP

(57) ABSTRACT

A silver halide color photosensitive material comprising each at least one blue-, green-, and red-sensitive emulsion layer on a support. The material contains a magenta coupler of formula (MC-1):

(MC-1)

wherein $R_1$ represents a t-alkyl group, s, m, and n represent 0 or 1, $R_2$ to $R_7$ represent H, halogen atom, alkyl, or aryl group, L represents $—NR_8SO_2—$, $—SO_2NR_8—$, $—SO_2NR_8CO—$, $—NR_8COO—$, $—NR_8CONR_9—$, or —COO—, $R_8$ and $R_9$ represent H, alkyl, or aryl group, J represents —CO—, —COO—, —O—, —S—, $—CONR_{10}—$, $—NR_{10}CO—$, $—NR_{10}COO—$, $—NR_{10}NR_{11}—$, $—SO_2—$, $—SO_2NR_{10}—$, or $—CONR_{10}SO_2—$, $R_{10}$ and $R_{11}$ represent H, alkyl, or aryl group, B represents an alkyl group of $C_{1-70}$ or an aryl group of $C_{6-70}$, p represents an integer from 1 to 5, G represents halogen atom, alkyl, aryl, or alkoxy group, and q represents an integer from 0 to 4, provided that is excluded from the magenta coupler.

8 Claims, 5 Drawing Sheets

SILVER HALIDE COLOR PHOTOSENSITIVE MATERIAL AND COLOR IMAGE FORMING METHOD USING THE SAME

CROSS-REFERENCE TO RELATED APPLICATIONS

This is a Continuation-in-Part application of U.S. patent application Ser. No. 09/324,122, filed Jun. 2, 1999, which is a Continuation-in-Part application of U.S. patent application No. 09/172,030, filed Oct. 14, 1998, now U.S. Pat. No. 6,159,671, the entire contents of which are incorporated herein by reference.

BACKGROUND OF THE INVENTION

The present invention relates to a novel color coupler compound, a silver halide color photosensitive material using the same and an image forming method using the same and, more particularly, to a silver halide color reversal photosensitive material and an image forming method using the same.

Recently, silver halide color sensitive materials are strongly required to have good color reproduction in addition to high sensitivity, high sharpness, and high graininess.

In the field of silver halide color photosensitive materials, a 1-phenyl-5-pyrazolone coupler has been extensively used as a magenta coupler. However, compounds having little secondary absorption and good hue and preferable as image forming dyes have been searched for, and a pyrazolotriazole magenta coupler is also beginning to be used widely.

A pyrazolotriazole magenta coupler is an attractive compound having good hue. However, a 4-equivalent coupler in which a position where the coupler couples to an oxidized form of an aromatic primary amine developing agent is a hydrogen atom, undesirably causes yellow coloring with time after development.

Compared to this 4-equivalent coupler, a 2-equivalent coupler in which the coupling position is substituted by a split-off group (e.g., a halogen atom) instead of a hydrogen atom does not easily cause yellow coloring.

A color reversal photosensitive material is subjected to first development, reversal processing, and color development in this order. Since a 2-equivalent coupler has a high degree of color generation per mol of silver, this coupler has an essential problem that the coupler lowers the sensitivity compared to a 4-equivalent coupler. Accordingly, when a pyrazolotriazole magenta coupler is to be used in a color reversal photosensitive material, a 4-equivalent coupler is desirable from the viewpoint of sensitivity. The use of a 4-equivalent pyrazolotriazole magenta coupler in a color reversal photosensitive material is disclosed in, e.g., Jpn. Pat. Appln. KOKAI Publication No. (hereinafter referred to as JP-A-)5-100382 (U.S. Pat. No. (US) 5,272,049) and JP-A-63-153548 (U.S. Pat. No. 4,994,351). However, the above mentioned problem of yellow coloring occurring with time after processing remains unsolved.

Of such 4-equivalent pyrazolotriazole couplers, compounds belonging to the category of a 1H-pyrazolo-[5,1-c]-1,2,4-triazole type coupler are already disclosed in, e.g., JP-A-5-100382 (U.S. Pat. No. 5,272,049), JP-A-63-153548 (U.S. Pat. No. 4,994,351), JP-A-6-208209, JP-A-6-214360 (U.S. 5,368,998), and JP-A-7-261348. However, when the present inventors applied these know compounds to color reversal photosensitive materials, the photographic properties largely varied when the replenishment rate of a color developer was lowered. Additionally, unpreferable sensitivity reduction occurred when the sensitive materials were stored.

BRIEF SUMMARY OF THE INVENTION

It is an object of the present invention to provide a silver halide color photosensitive material which has good color reproduction and high image fastness and produces little stain.

It is another object of the present invention to provide a silver halide color photosensitive material which has improved in the storage stability and the resistance to composition variations in developers.

It is still another object of the present invention to provide a color reversal photosensitive material which has good color reproduction and high fastness and has improved in the storage stability and the resistance to composition variations in developers.

It is still another object of the present invention to provide a method for forming a color image which is good in color reproduction, image fastness, storage stability, and resistance to composition variations in developers and improved in stain formation.

It is still another object of the present invention to provide a color coupler that can be used in such photographic materials as those mentioned above.

The present inventors have extensively studied a structure which does not easily cause yellow coloring among other 4-equivalent pyrazolotriazole couplers, and found that some of the 1H-pyrazolo-[5,1-c]-1,2,4-triazole type couplers described above do not relatively easily cause yellow coloring, thereby completing the present invention.

That is, the objects of the present invention are achieved by the following photosensitive material.

(1) A silver halide color photosensitive material comprising at least one blue-sensitive emulsion layer, at least one green-sensitive emulsion layer, and at least one red-sensitive emulsion layer on a support, wherein the material contains a magenta coupler represented by formula (MC-1) below:

(MC-1)

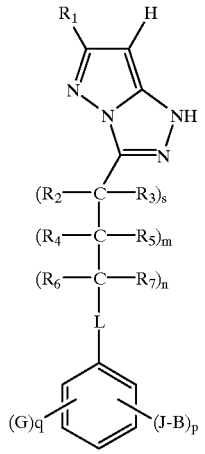

wherein $R_1$ represents a tertiary alkyl group; each of s, m, and n independently represents 0 or 1; each of $R_2$, $R_3$, $R_4$, $R_5$, $R_6$, and $R_7$ independently represents a hydrogen atom, halogen atom, alkyl group, or aryl group; L represents a divalent group selected from the group consisting of $—NR_8SO_2—$, $—SO_2NR_8—$, $—SO_2NR_8CO—$, $—NR_8COO—$, $—NR_8CONR_9—$, and —COO—, wherein the right side of each formula bonds to the phenyl group in formula (MC-1); each of $R_8$ and $R_9$ independently represents a hydrogen atom, alkyl group, or aryl group; J represents a divalent group selected from the group consisting of —CO—, —COO—, —O—, —S—, —$CONR_{10}$—, —$NR_{10}CO$—, —$NR_{10}COO$—, —$NR_{10}NR_{11}$—, —$SO_2$—, —$SO_2NR_{10}$—, and —$CONR_{10}SO_2$—, wherein the left side of each formula bonds to the phenyl group in formula (MC-1); each of $R_{10}$ and $R_{11}$ independently represents a hydrogen atom, alkyl group, or aryl group; B represents an alkyl group having the total number of carbon atoms of 1 to 70 or an aryl group having the total number of carbon atoms of 6 to 70; p represents an integer from 1 to 5, a plurality of —J—B's being able to be the same or different when p is 2 or more; G represents a group selected from the group consisting of an alkyl group, aryl group, halogen atom, and alkoxy group; and q represents an integer from 0 to 4, a plurality of G's being able to be the same or different when q is 2 or more, provided that the following magenta coupler is excluded:

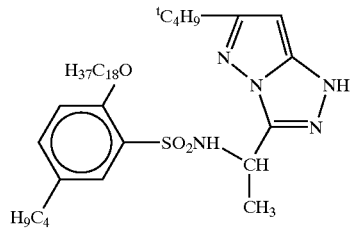

(2) A silver halide color photosensitive material comprising at least one blue-sensitive emulsion layer, at least one green-sensitive emulsion layer, and at least one red-sensitive emulsion layer on a support, wherein the material contains a magenta coupler represented by formula (MC-2) below:

(MC-2)

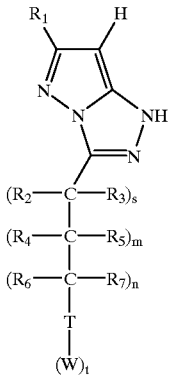

wherein $R_1$, s, m, n, $R_2$, $R_3$, $R_4$, $R_5$, $R_6$, $R_7$, and $R_8$ each represent the same meanings as defined in formula (MC-1) of (1) mentioned above; T represents a divalent group selected from the group consisting of —$SO_2$—, —O—, and —$NR_8CO$—, wherein the right side of each formula bonds to W, or a phenyl group, wherein t=1 when T is the divalent group selected from —$SO_2$—, —O—, and —$NR_8CO$—, t=0 when T is a nonsubstituted phenyl group; t is an integer from 1 to 5 when T is a substituted phenyl group; W represents a group containing a 1- to 70-carbon alkyl group and containing, at the same time, a group selected from the group consisting of —$CR_{12}HOH$, —$SO_2NH_2$, —$SO_2NHCOR_{13}$, and —$CONH_2$, or a group containing a 6- to 70-carbon aryl group and containing, at the same time, a group selected form the group consisting of —$CR_{12}HOH$, —$SO_2NH_2$, —$SO_2NHCOR_{13}$, and —$CONH_2$, a plurality of W's being able to be the same or different when t is 2 or more; and each of $R_{12}$ and $R_{13}$ represents an alkyl group or aryl group.

(3) A method for forming a color image on a silver halide color photosensitive material comprising a step of performing black-and-white development followed by a step of reversal processing for the material and a step of performing color development for the reversal processed material by using a color developer having a pH of 11.5 or more, wherein the material subjected to the black-and-white development is the material described in item (1) or (2) above, and a replenishment amount of the color developer is less than 1.6 liters per $m^2$ of the material.

(4) A compound represented by formula (MC-4) below:

(MC-4)

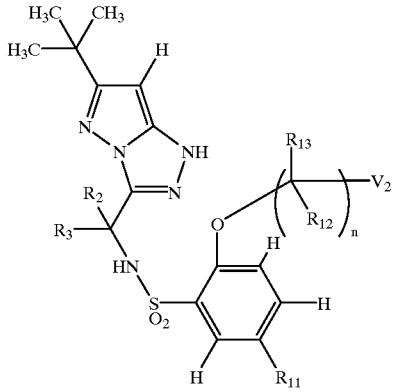

wherein each of $R_2$ and $R_3$ independently represent a hydrogen atom or 1- to 3-carbon unsubstituted alkyl group; $R_{11}$ represents a hydrogen atom, 1- to 8-carbon unsubstituted alkyl group, or 5- to 10-carbon cycloalkyl group; each of $R_{12}$ and $R_{13}$ independently represents a hydrogen atom or 1- to 20-carbon alkyl group; n represents a natural number from 1 to 3; and $V_2$ represents a group selected from the following groups:

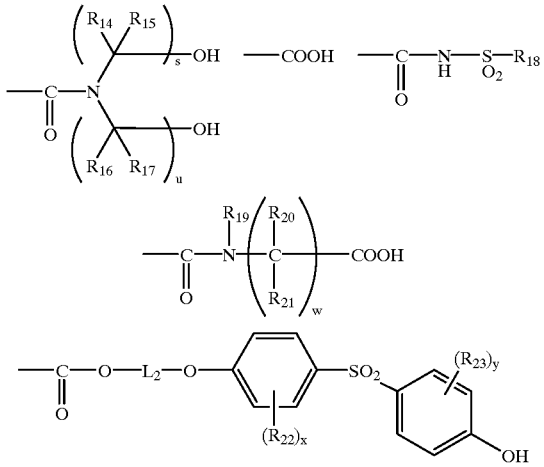

wherein each of $R_{14}$, $R_{15}$, $R_{16}$ and $R_{17}$ independently represents a hydrogen atom or 1- to 3-carbon unsubstituted alkyl group; each of s and u independently represents 2 or 3; $R_{18}$ represents a 1- to 8-carbon unsubstituted alkyl group or 6- to 20-carbon aryl group; w represents 1 or 2; $R_{19}$ represents a hydrogen atom or 1- to 20-carbon unsubstituted alkyl group; each of $R_{20}$ and $R_{21}$ independently represents a hydrogen atom or 1- to 3-carbon unsubstituted alkyl group;

each of $R_{22}$ and $R_{23}$ independently represents a chlorine atom or bromine atom; each of x and y independently represents an integer from 0 to 2; and $L_2$ represents a 2- to 10-carbon alkylene group.

Figure 1:
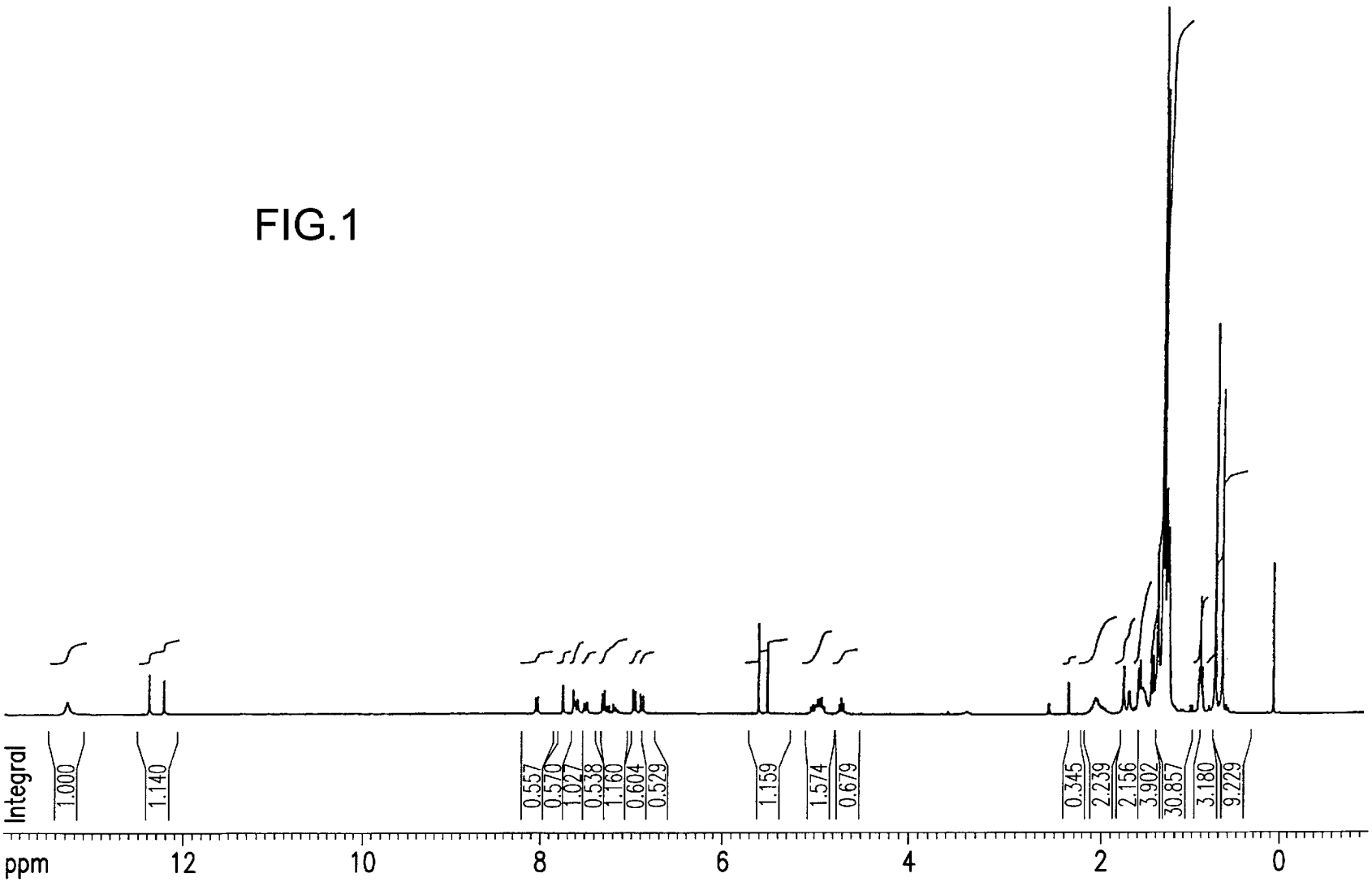
FIG. 1 is $^1$H NMR (300 MHz, DMSO-$d_6$, ppm) spectrum of the exemplified compound M-75.

All the spectra of FIGS. 1 to 5 were measured by using ARX-300 (300 MHz) manufactured by Japan Bruker.

DETAILED DESCRIPTION OF THE INVENTION

The present invention will be described in detail below.

Formula (MC-1) will be described below.

In formula (MC-1), $R_1$ represents a tertiary alkyl group. The tertiary alkyl group represented by $R_1$ is preferably a 4- to 20-carbon substituted or nonsubstituted tertiary alkyl group. Examples of a substituent for substituting this tertiary alkyl group are an aryl group, heterocyclic group, acyl group, acyloxy group, acylamino group, alkoxy group, aryloxy group, heterocyclic oxy group, alkoxycarbonyl group, aryloxycarbonyl group, heterocyclic oxy carbonyl group, alkylcarbamoyl group, arylcarbamoyl group, alkylsulfonyl group, arylsulfonyl group, alkylsulfamoyl group, arylsulfamoyl group, alkylsulfonylamino group, alkylamino group, anilino group, amino group, alkylsulfinyl group, arylsulfinyl group, alkylthio group, arylthio group, mercapto group, hydroxy group, cyano group, nitro group, hydroxylamino group, nitro group, carbonyl group, sulfo group, and halogen atom. Practical examples of $R_1$ are formulas (A-1) to (A-10) below, but the present invention is not limited to these examples.

(A-1)

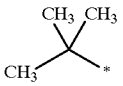

(A-2)

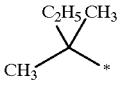

(A-3)

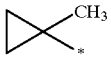

(A-4)

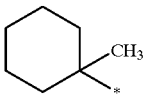

(A-5)

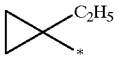

-continued (A-6)

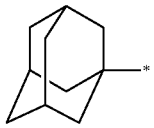

(A-7)

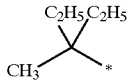

(A-8)

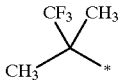

(A-9)

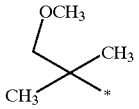

(A-10)

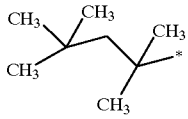

In formulas (A-1) to (A-10), * represents a position where the group bonds to a pyrazolotriazole ring. $R_1$ is preferably tertiary alkyl containing no hetero atom and preferably has 4 to 10 carbon atoms. Herein, a hetero atom means an atom other than a carbon atom and a hydrogen atom.

$R_2$, $R_3$, $R_4$, $R_5$, $R_6$, and $R_7$ will be described below.

Each of $R_2$, $R_3$, $R_4$, $R_5$, $R_6$, and $R_7$ independently represents a hydrogen atom, halogen atom, alkyl group, or aryl group, and these groups can have a substituent. Examples of this substituent are the substituents substitutable to $R_1$ mentioned above. Also, any two of $R_2$, $R_3$, $R_4$, $R_5$, $R_6$, and $R_7$ can combine to form a ring structure together with C—C or C—C—C. Examples are a hydrogen atom, halogen atom (fluorine, chlorine, bromine, and iodine), alkyl group (substituted or nonsubstituted, 1- to 10-carbon, straight-chain or branched alkyl group and cycloalkyl group, e.g., methyl, ethyl, isopropyl, t-butyl, t-octyl, trifluoromethyl, cyclohexyl, 2-methoxymethyl, n-octyl, and benzyl), and aryl group (a substituted or nonsubstituted 6- to 20-carbon aryl group, e.g., phenyl, 4-chlorophenyl, 4-methoxyphenyl, 4-hydroxyphenyl, and naphthyl).

Each of $R_2$, $R_3$, $R_4$, $R_5$, $R_6$, and $R_7$ is preferably a hydrogen atom, alkyl group, or aryl group. More preferably, at least one of $R_2$ and $R_3$ is an alkyl group or aryl group, and each of $R_4$, $R_5$, $R_6$, and $R_7$ is a hydrogen atom, alkyl group, or aryl group. Most preferably, at least one of $R_2$ and $R_3$ is a group selected from a methyl group, ethyl group, and isopropyl group, and each of $R_4$, $R_5$, $R_6$, and $R_7$ is a hydrogen atom, alkyl group, or aryl group.

Each of s, m, and n independently represents 0 or 1. Preferably, each of s and m is 1 and n is 0, or s is 1 and each of m and n is 0.

L represents a divalent group selected from —$NR_8SO_2$—, —$SO_2NR_8$—, —$SO_2NR_8CO$—, —$NR_8COO$—, —$NR_8CONR_9$—, and —COO—, wherein the right side of each formula bonds to the phenyl group in formula (MC-1). Each of $R_8$ and $R_9$ represents a hydrogen atom, alkyl group, or aryl group. L is preferably —$NR_8SO_2$—, —$SO_2NR_8$—, or —$SO_2$NRSCO— wherein $R_8$ is more preferably a hydrogen atom.

J represents a divalent group selected from —CO—, —COO—, —O—, —S—, —$CONR_{10}$—, —$NR_{10}CO$—, —$NR_{10}COO$—, —$NR_{10}NR_{11}$—, —$SO_2$—, —$SO_2NR_{10}$—, and —$CONR_{10}SO_2$—, wherein the left side of each formula bonds to the phenyl group in formula (MC-1). Each of $R_{10}$ and $R_{11}$represents a hydrogen atom, alkyl group, or aryl group.

J is preferably —COO—, —O—, —$CONR_{10}$—, —$NR_{10}CO$—, —$NR_{10}COO$—, —$NR_{10}NR_{11}$—, —$SO_2NR_{10}$—, or —$CONR_{10}SO_2$— wherein one of $R_{10}$ and $R_{11}$ is preferably a hydrogen atom. J is more preferably —$SO_2NR_2$— or —$CONR_{10}SO_2$—.

B represents a substituted or nonsubstituted alkyl group or aryl group having a total number of carbon atoms of 6 to 70. B is most preferably a group known as a ballast group in the field of photographic organic compounds. Examples are n-hexyl, 2-ethyl-hexyl, n-octyl, n-decyl, n-dodecyl, n-pentadecyl, n-octadecyl, 2,4-di-t-amylphenyl, and 2,4-di-t-amylphenyloxypropyl. The total number of carbon atoms is preferably 6 to 50, more preferably 6 to 30, particularly preferably 10 to 25, and most preferably 15 to 25. In this specification, if, for example, an alkyl group is a substituted alkyl group, "the total number of carbon atoms" is the number of carbon atoms of the whole substituted alkyl group including the number of carbon atoms of the substituent. The same rule applies correspondingly to an aryl group and other groups. On the other hand, "n-carbon" or "carbon atom" without "total"is the number of carbon atoms of a group assuming the group is unsubstituted. For example, a n-carbon alkyl group means the number, i.e., n, of the carbon atom(s) does not include the carbon atom(s) of a substituent (s) that attach to the alkyl group, when the alkyl group is a substituted alkyl group. The same rule applies correspondingly to an aryl group and other groups.

p represents a natural number from 1 to 5. When p is 2 or more, a plurality of —J—B's can be the same or different. p is preferably 1 or 2, and most preferably 1.

G represents a substituent substitutable to the phenyl group. Examples of this substituent are substituents when T is a phenyl group in formula (MC-2) to be described later.

G is preferably a substituent selected from an alkyl group, halogen atom, and alkoxy group.

q represents an integer from 0 to 4.

G is preferably a tertiary alkyl (e.g., t-butyl, t-octyl, t-amyl, or any of those enumerated above as examples of $R_1$). Most preferably, G is tertiary alkyl, and q is 1.

In the present invention, the magenta coupler:

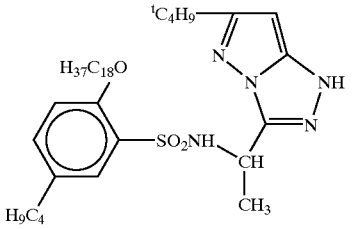

is excluded from the scope of formula (MC-1).

The compound represented by formula (MC-1) is preferably a compound in which $R_1$ is a tertiary alkyl group not containing any elements except for hydrogen atoms and carbon atoms, s is 1, m is 1 or 0, n is 0, each of $R_2$, $R_3$, $R_4$, $R_5$, $R_6$, and $R_7$ is a hydrogen atom, halogen atom, alkyl group, or aryl group, at least one of $R_2$ and $R_3$ is an alkyl group containing 4 or less carbon atoms, at least one of $R_4$ and $R_5$ is a hydrogen atom when m is 1, L is a group selected from —$NHSO_2$—, —$SO_2NH$—, and —$SO_2NHCO$—, J is a group selected from —O—, —COO—, —CONH—, —NHCO—, —NHCONH—, —$SO_2NH$—, and —$CONHSO_2$—, B is a group having a total number of carbon atoms of 6 to 30, p is 1 or 2, G is a tertiary alkyl group, and q is 1.

Additionally, the portion represented by —J—B is preferably substituted by a group selected from —$CR_{12}OH$—, —$SO_2NH_2$, —$SO_2NHCOR_{13}$, and —$CONH_2$ as characteristic groups of formula (MC-2) described below. The portion represented by —J—B is also preferably substituted by —COOH group. In these formulas, each of $R_{12}$ and $R_{13}$ represents a substituted or nonsubstituted alkyl group or substituted or nonsubstituted aryl group.

When L is —$NR_8SO_2$— and J is —O—, B is preferably a substituted alkyl group or an aryl group having a total number of carbon atoms of 6 to 70.

Formula (MC-2) will be described below.

$R_1$, $R_2$, $R_3$, $R_4$, $R_5$, $R_6$, and $R_7$ have the same meanings as defined in formula (MC-1) and are preferably those mentioned preferable for formula (MC-1). In formula (MC-2), it is preferable that s and m be 1 and n be 0, all of s, m, and n be 1, or all of s, m, and n be 0.

T represents a divalent group selected from —$SO_2$—, —O—, and —$NR_8CO$—, wherein the right side of each formula bonds to W, substituted phenyl group, or nonsubstituted phenyl group, i.e., t=0. T is preferably —$SO_2$—, —NHCO—, or a phenyl group.

When at least one of s, m, and n is 1, T is preferably —$SO_2$—, —O—, or —NHCO—. When all of s, m, and n are 0, T is preferably a phenyl group.

W represents a group containing a 6- to 70-carbon substituted or nonsubstituted alkyl group or aryl group and containing a group selected from the group consisting of —$CR_{12}HOH$, —$SO_2NH_2$, —$SO_2NHCOR_{13}$, and —$CONH_2$ at the same time, wherein each of $R_{12}$ and $R_{13}$ represents a substituted or nonsubstituted alkyl group or substituted or nonsubstituted aryl group. W is preferably a group containing a 6- to 30-carbon alkyl group or aryl group.

t represents 1 when T is a divalent group selected from —$SO_2$—, —O—, and $NR_8CO$—, and represents a natural number from 1 to 5 when T is a phenyl group. When T is a phenyl group, t is preferably 1 or 2.

When T is a phenyl group, the substitution position of W can be any of the 2-, 3-, and 4-positions of the phenyl group. When t is 2, however, the substitution position is preferably the 3- or 5-position.

When t is 2 or more, a plurality of W's can be the same or different.

When T is a phenyl group, this phenyl group can have a substituent except for groups represented by W. Examples of this substituent are a halogen atom, alkyl group, aryl group, heterocyclic group, cyano group, hydroxyl group, nitro group, carboxyl group, amino group, alkoxy group, aryloxy group, acylamino group, alkylamino group, anilino group, ureido group, sulfamoylamino group, alkylthio group, arylthio group, alkoxycarbonylamino group, sulfonamide group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imide group, heterocyclic thio group, sulfinyl group, phosphonyl group, aryloxycarbonyl group, acyl group, and azolyl group.

More specifically, examples of the substituent are a halogen atom (e.g., a chlorine atom and bromine atom), alkyl group (e.g., a 1- to 32-carbon straight-chain or branchedchain alkyl group, aralkyl group, alkenyl group, alkinyl group, cycloalkyl group, and cycloalkenyl group, more specifically, methyl, ethyl, propyl, isopropyl, t-butyl, tridecyl, 2-methanesulfonylethyl, 3-(3-pentadecylphenoxy) propyl, 3-{4-{2-[4-(4-hydroxyphenylsulfonyl)phenoxy] dodecaneami do}phenyl}propyl, 2-ethoxytridecyl, trifluoromethyl, cyclopentyl, and 3-(2,4-di-t-amylphenoxy) propyl), aryl group (e.g., phenyl, 4-t-butylphenyl, 2,4-di-t-amylphenyl, and 4-tetradecaneamidophenyl), heterocyclic group (e.g., 2-furyl, 2-thienyl, 2- pyrimidinyl, and 2-benzothioazolyl), cyano group, hydroxyl group, nitro group, carboxyl group, amino group, alkoxy group (e.g., methoxy, ethoxy, 2-methoxyethoxy, 2-dodecylethoxy, and 2-methanesulfonylethoxy), aryloxy group (e.g., phenoxy, 2-methylphenoxy, 4-t-butylphenoxy, 3-nitrophenoxy, 3-t-butyloxycarbamoylphenoxy, and 3-methoxycarbamoylphenoxy), acylamino group (e.g., acetamide, benzamide, tetradecaneamide, 2-(2,4-di-t-amylphenoxy)butaneamide, 4-(3-t-butyl-4-hydroxyphenoxy)butaneamide, 2-{4-(4-hydroxyphenylsulfonyl)phenoxy}decaneamide), alkylamino group (e.g., methylamino, butylamino, dodecylamino, diethylamino, and methylbutylamino), anilino group (e.g., phenylamino, 2-chloroanilino, 2-chloro-5-tetradecaneaminoanilino, 2-chloro-5-dodecyloxycarbonylanilino, N-acetylanilino, and 2-chloro-5-{α-(3-t-butyl-4-hydroxyphenoxy) dodecaneamido}anilino), ureido group (e.g., phenylureido, methylureido, and N,N-dibutylureido), sulfamoylamino group (e.g., N,N-dipropylsulfamoylamino and N-methyl-N-decylsulfamoylamino), alkylthio group (e.g., methylthio, octylthio, tetradecylthio, 2-phenoxyethylthio, 3-phenoxypropylthio, and 3-(4-t-butylphenoxy)propylthio), arylthio group (e.g., phenylthio, 2-butoxy-5-t-octylphenylthio, 3-pentadecylphenylthio, 2-carboxyphenylthio, and 4-tetradecaneamidophenylthio), alkoxycarbonylamino group (e.g., methoxycarbonylamino and tetradecyloxycarbonylamino), sulfonamide group (e.g., e.g., methanesulfonamide, hexadecanesulfonamide, benzenesulfonamide, p-toluenesulfonamide, octadecanesulfonamide, 2-methyloxy-5-t-butylbenzenesulfonamide), carbamoyl group (e.g., N-ethylcarbamoyl, N,N-dibutylcarbamoyl, N-(2-dodecyloxyethyl)carbamoyl, N-methyl-N-dodecylcarbamoyl, and N-(3-(2,4-di-t-amylphenoxy) propyl)carbamoyl), sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), sulfonyl group (e.g., methanesulfonyl, octanesulfonyl, benzenesulfonyl, and toluenesulfonyl), alkoxycarbonyl group (e.g., methoxycarbonyl, butyloxycarbonyl, dodecyloxycarbonyl, and octadecyloxycarbonyl), heterocyclic oxy group (e.g., 1-phenyltetrazole-5-oxy and 2-tetrahydropyranyloxy), azo group (e.g., phenylazo, 4-methoxphenylazo, 4-pyvaloylaminophenylazo, and 2-hydroxy-4-propanoylphenylazo), acyloxy group (e.g., acetoxy), carbamoyloxy group (e.g., N-methylcarbamoyloxy and N-phenylcarbamoyloxy), silyloxy group (e.g., trimethylsilyloxy and dibutylmethylsilyloxy), aryloxycarbonylamino group (e.g., phenoxycarbonylamino), imide group (e.g., N-succinimide, N-phthalimide, and 3-octadecenylsuccinimide), heterocyclic thio group (e.g., 2-benzothioazolylthio, 2,4-di-phenoxy-1,3,5-trizole-6-thio, and 2-pyridylthio), sulfinyl group (e.g., dodecanesulfinyl, 3-pentadecylphenylsulfinyl, and 3-phenoxypropylsulfinyl), phosphonyl group (e.g., phenoxyphosphonyl, octyloxysulfonyl, and phenylphosphonyl), aryloxycarbonyl group (e.g., phenoxycarbonyl), acyl group (e.g., acetyl, 3-phenylpropanoyl, benzoyl, and 4-dodecyloxybenzoyl), and azolyl group (e.g., imidazolyl, pyrazolyl, 3-chloropyrazole-1-yl, and triazole).

The compound represented by formula (MC-2) is preferably a compound in which $R_1$ is a tertiary alkyl group, preferably a tertiary alkyl group having 4 to 10 carbon atoms, not containing any elements except for hydrogen atoms and carbon atoms, each of s, m, and n is 1, T is a group selected from —$SO_2$—and —NHCO—, at least one of $R_2$ and $R_3$ is an alkyl group having 4 or less carbon atoms, all of $R_4$, $R_5$, $R_6$, and $R_7$ are hydrogen atoms, and W is a group containing a group selected from —$CHR_{12}OH$, —$SO_2NH_2$, and —$SO_2NHCOR_{13}$ and containing a 6- to 30-carbon alkyl group or aryl group, at the same time.

In another preferable compound, $R_1$ is a tertiary alkyl group not containing any elements except for hydrogen atoms and carbon atoms, all of s, m, and n are 0, T is a phenyl group, and W is a group containing a group selected from —$CHR_{12}OH$, —$SO_2NH_2$, and —$SO_2NHCOR_{13}$ and containing a 6- to 30-carbon alkyl group or aryl group at the same time. In this preferable compound, W is preferably a substituted alkyl group or substituted aryl group, to which a group selected from —$CHR_{12}OH$, —$SO_2NH_2$, and —$SO_2NHCOR_{13}$ is substituted, or a substituted alkyl group or substituted aryl group whose substituent is further substituted by a group selected from —$CHR_{12}OH$, —$SO_2NH_2$, and —$SO_2NHCOR_{13}$.

Of the compounds represented by formulas (MC-1) and (MC-2), a compound represented by formula (MC-1) is more preferable.

The magenta coupler of the invention is preferably represented by formula (MC-3) below:

(MC-3)

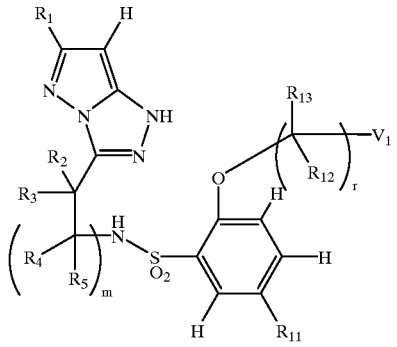

wherein $R_1$ represents a 4- to 8-carbon unsubstituted tertiary alkyl group; each of $R_2$, $R_3$, $R_4$, and $R_5$ independently represents a hydrogen atom or 1- to 4-carbon unsubstituted alkyl group, provided that at least one of $R_2$ and $R_3$ is not a hydrogen atom; m represents 0 or 1; $R_{11}$ represents a 4- to 8-carbon tertiary alkyl group or 5- to 10-carbon cycloalkyl group; each of $R_{12}$ and $R_{13}$ independently represents a hydrogen atom or 1- to 20-carbon alkyl group; r represents a natural number from 1 to 3; and $V_1$ represents a carboxyl group, 1- to 20-carbon substituted or unsubstituted carbamoly group, 2- to 20-carbon substituted or unsubstituted sulfonylaminocarbonyl group, or 1- to 20-carbon substituted or unsubstituted alkoxycarbonyl group, provided that when $V_1$ represents a carbamoyl group or alkoxycarbonyl group, each of the carbamoly group and alkoxycarbonyl group preferably has a carboxyl group or a hydroxypheny group as its substituent.

Among the compounds represented by formula (MC-3), compounds represented by formula (MC-4) below is more preferable:

(MC-4)

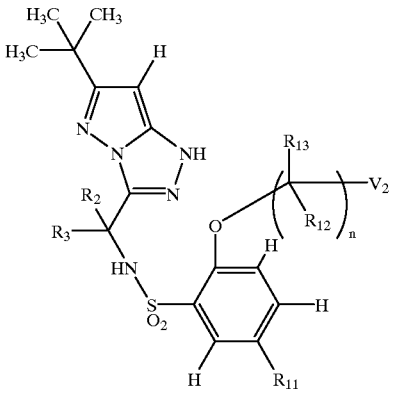

wherein each of $R_2$ and $R_3$ independently represent a hydrogen atom or 1- to 3-carbon unsubstituted alkyl group; $R_{11}$ represents a hydrogen atom, 1- to 8-carbon unsubstituted alkyl group, or 5- to 10-carbon cycloalkyl group; each of $R_{12}$ and $R_{13}$ independently represents a hydrogen atom or 1- to 20-carbon alkyl group; n represents a natural number from 1 to 3; and $V_2$ represents a group selected from the following 10 groups:

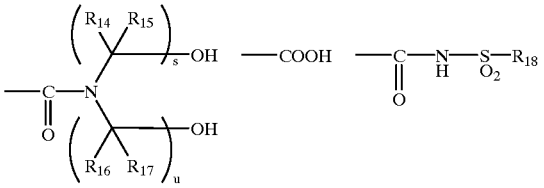

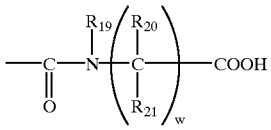

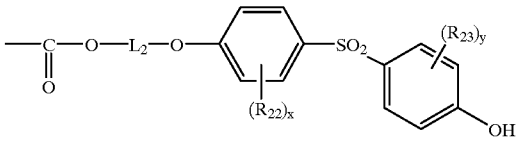

wherein each of $R_{14}$, $R_{15}$, $R_{16}$ and $R_{17}$ independently represents a hydrogen atom or 1- to 3-carbon unsubstituted alkyl group; each of s and u independently represents 2 or 3; $R_{18}$ represents a 1- to 8-carbon unsubstituted alkyl group or 6- to 20-carbon aryl group; w represents 1 or 2; $R_{19}$ represents a hydrogen atom or 1- to 20-carbon unsubstituted alkyl group; each of $R_{20}$ and $R_{21}$ independently represents a hydrogen atom or 1- to 3-carbon unsubstituted alkyl group; each of $R_{22}$ and $R_{23}$ independently represents a chlorine atom or bromine atom; each of x and y independently represents an integer from 0 to 2; and $L_2$ represents a 2—to 10-carbon alkylene group.

Among the compounds represented by formula (MC-4), $R_2$ is preferably methyl, ethyl, n-propyl or iso-propyl; $R_3$ is preferably a hydrogen atom, methyl or ethyl; $R_{11}$ is preferably a hydrogen atom or a 1—to 8-carbon unsubstituted alkyl group; $R_{12}$ is preferably a hydrogen atom; and $R_{13}$ is preferably a hydrogen atom or a 1—to 16-carbon unsubstituted alkyl group; and $V_2$ is preferably represented by the following group:

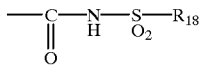

wherein $R_{18}$ represents a 1- to 8-carbon unsubstituted alkyl group or 6- to 20-carbon aryl group.

Practical compound examples of the present invention are presented below. However, the present invention is not limited to these examples.

M-1

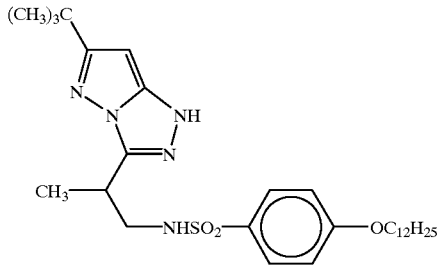

M-2

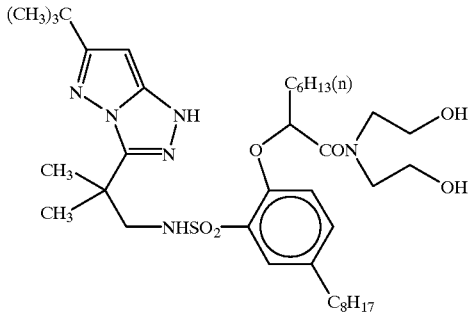

M-3

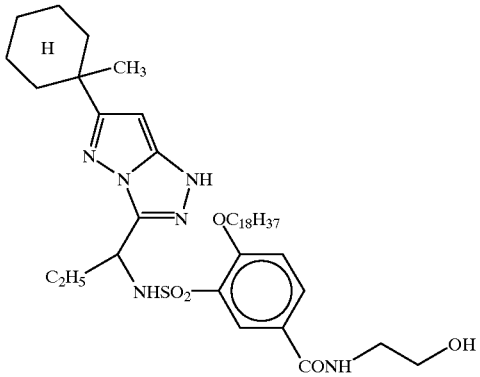

-continued
M-4
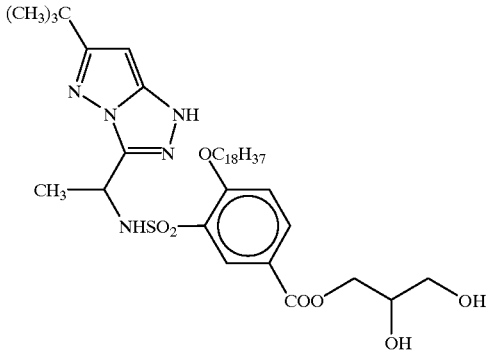
M-5
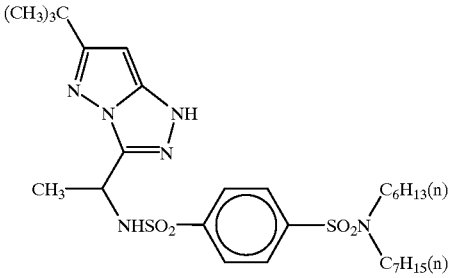
M-6
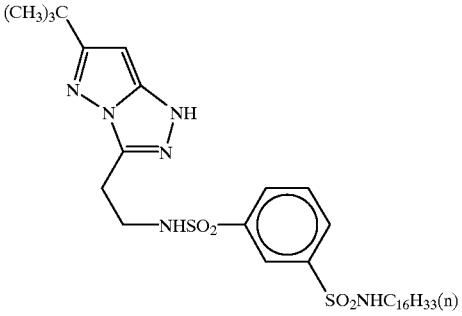
M-7
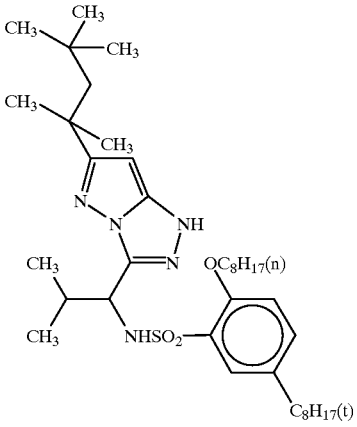
In this specification, (t)$C_8H_{17}$ is
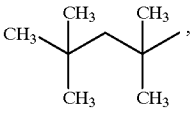
unless otherwise indicated.
M-8
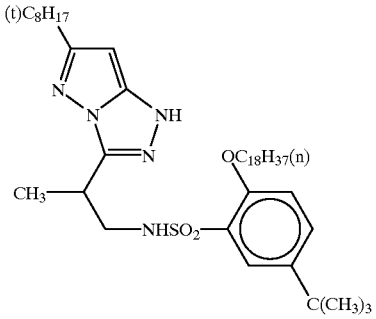
M-9
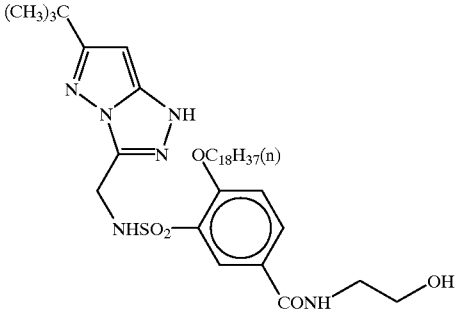
M-10
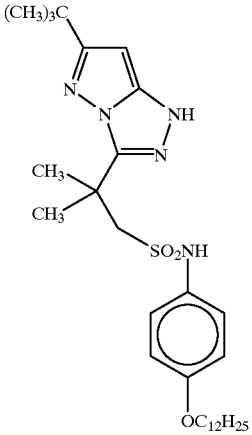
M-11
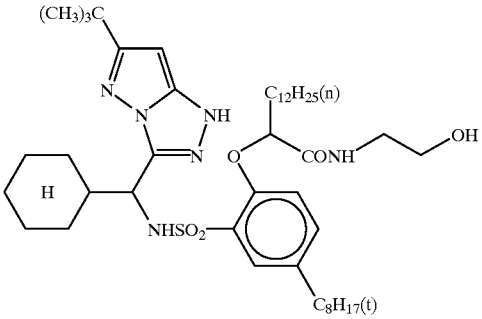

-continued
M-12
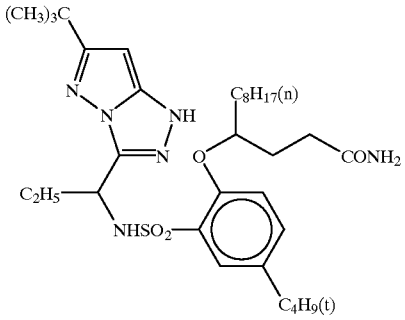
M-13
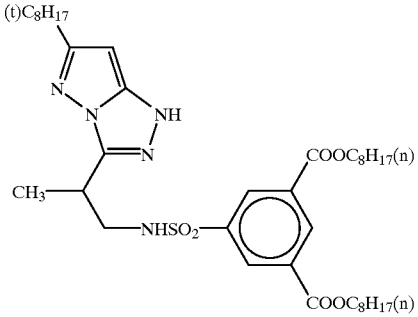
M-14
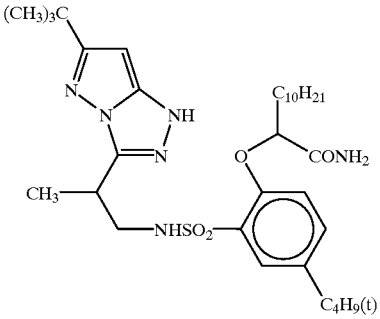
M-15
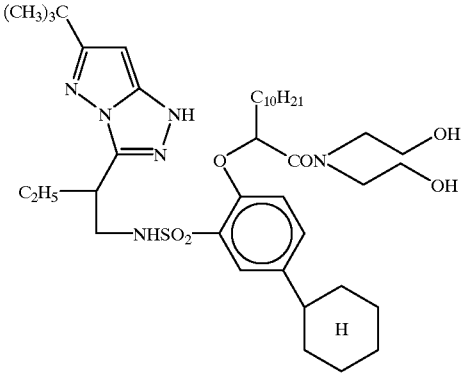
-continued
M-16
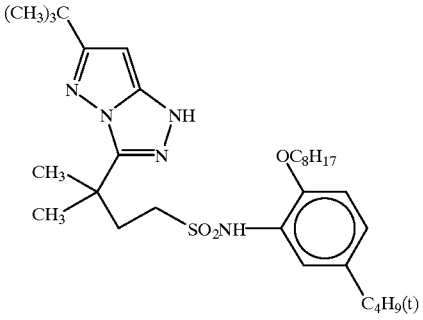
M-17
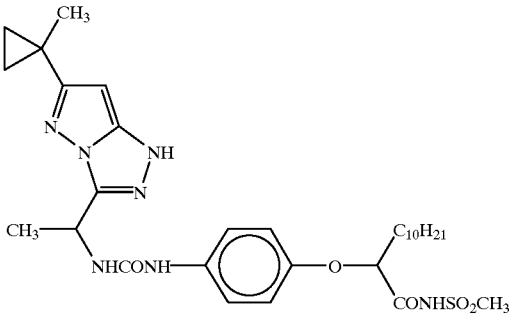
M-18
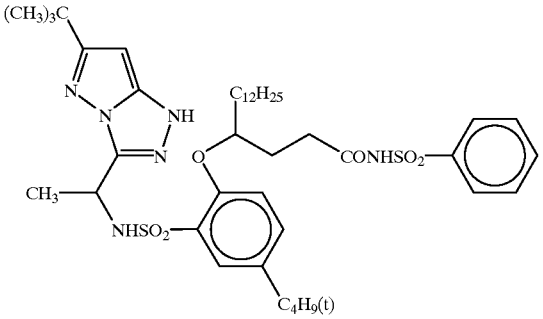
M-19
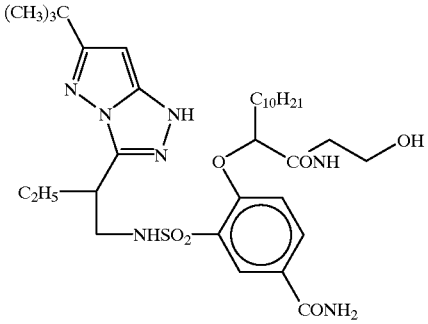

-continued
M-20
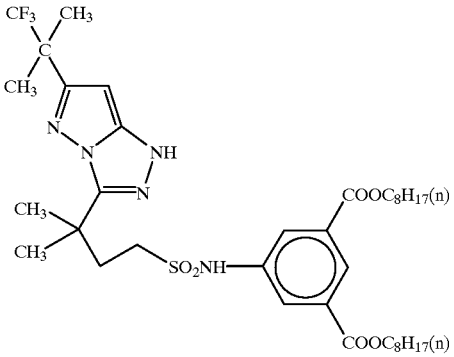
M-21
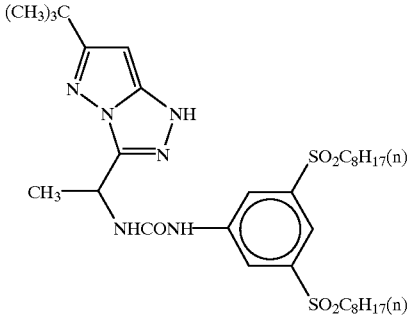
M-22
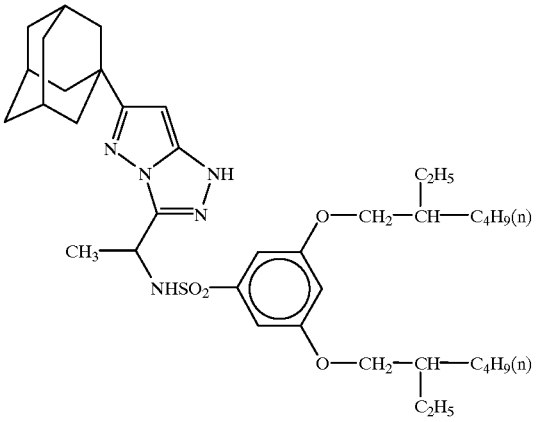
M-23
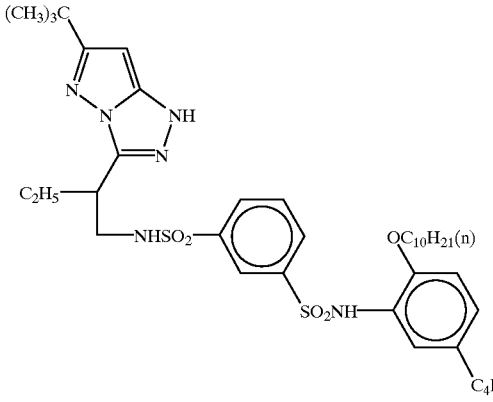
-continued
M-24
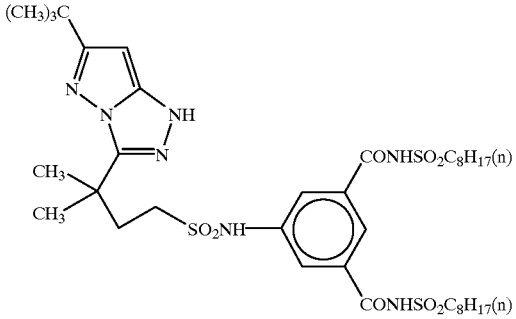
M-25
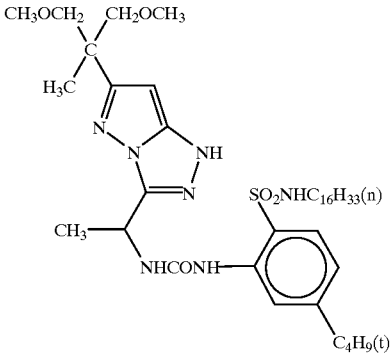
M-26
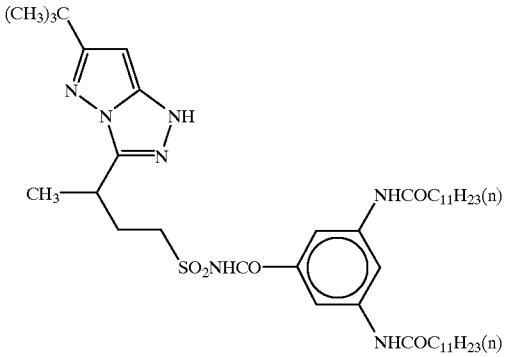
M-27
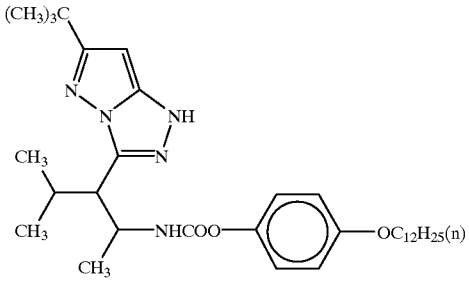

-continued
M-28
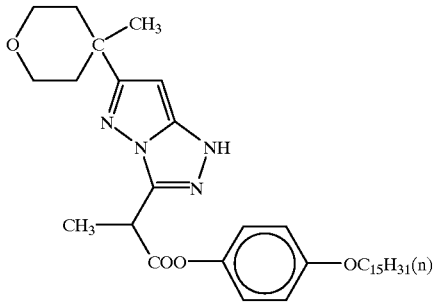
M-29
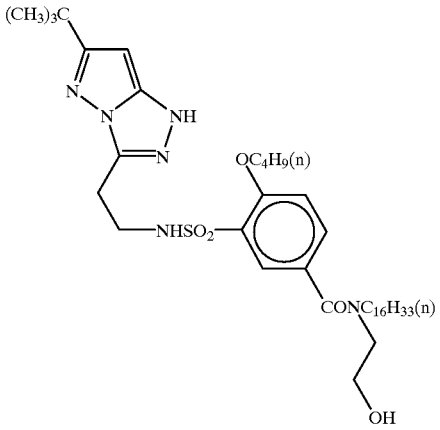
M-30
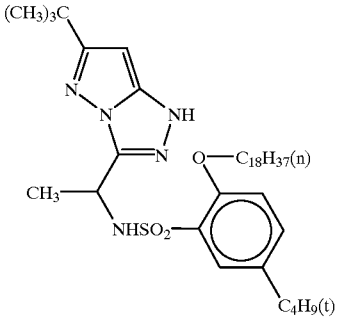
M-31
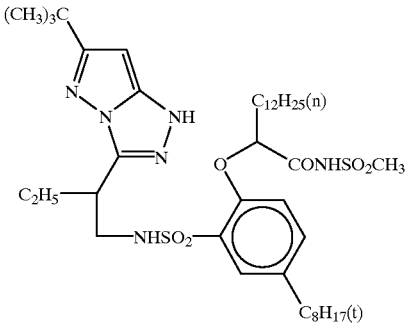
-continued
M-32
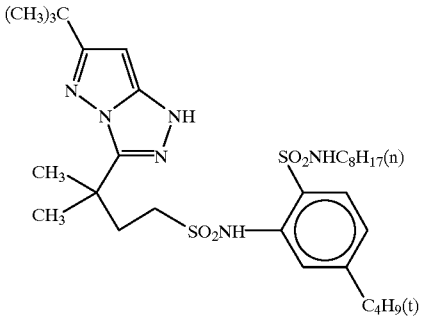
M-33
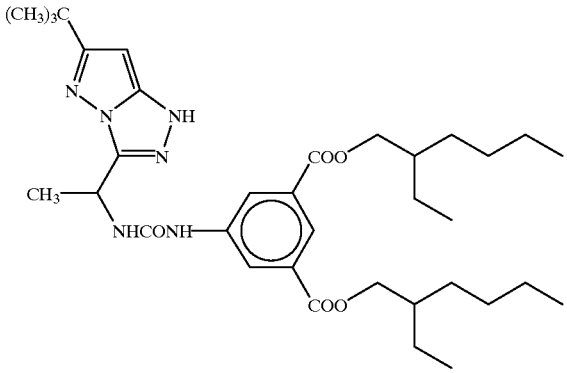
M-34
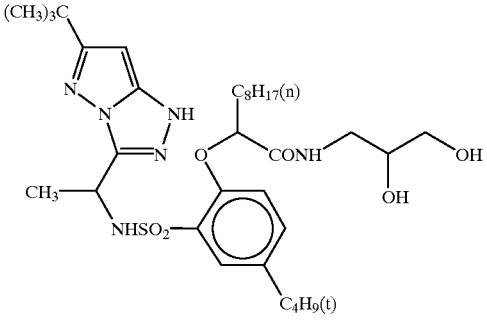
M-35
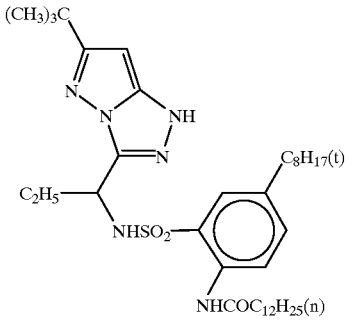

-continued
M-36
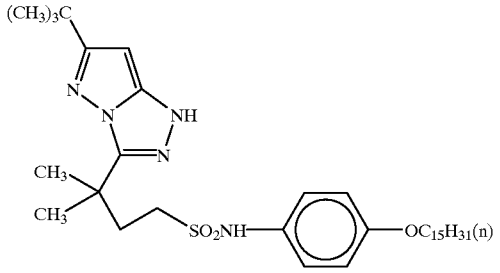
M-37
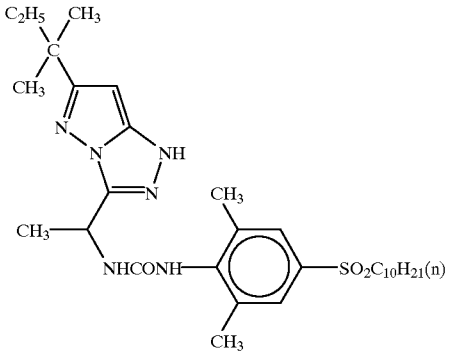
M-38
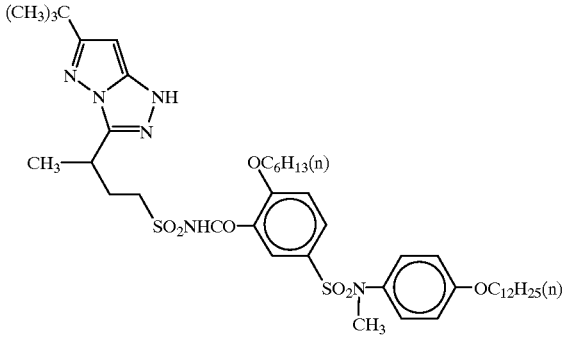
M-39
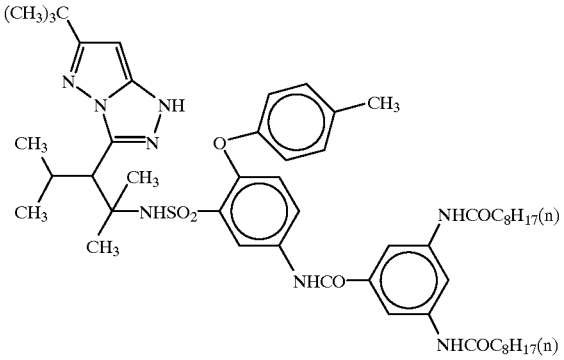
-continued
M-40
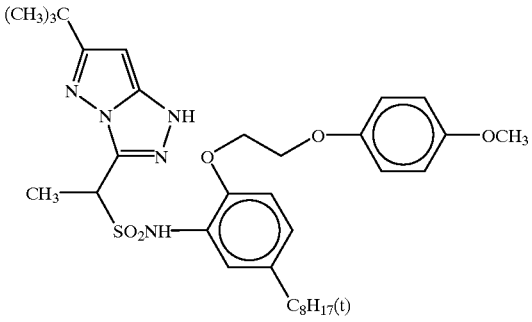
M-41
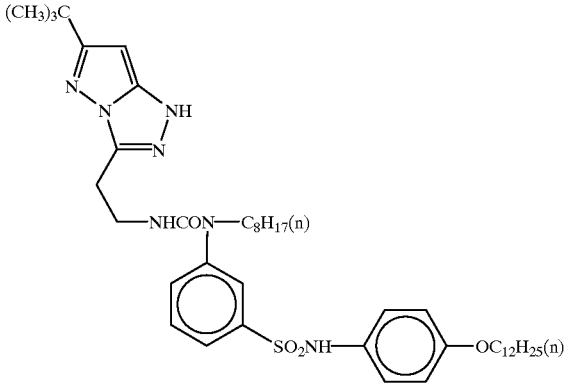
M-42
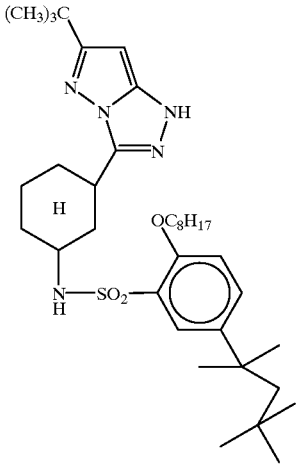
M-43
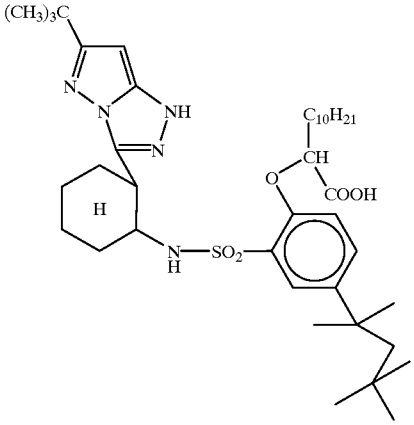

M-44
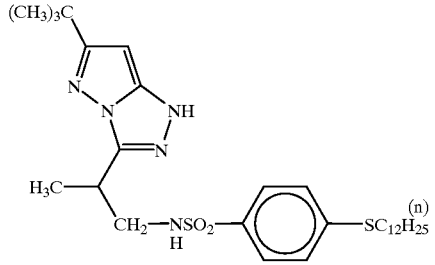
M-45
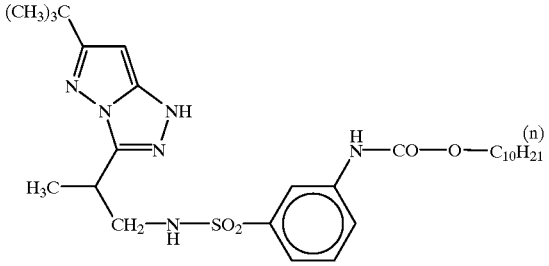
M-46
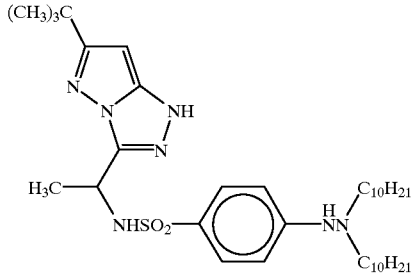
M-47
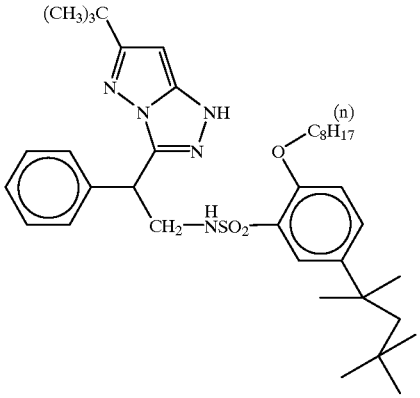
M-48
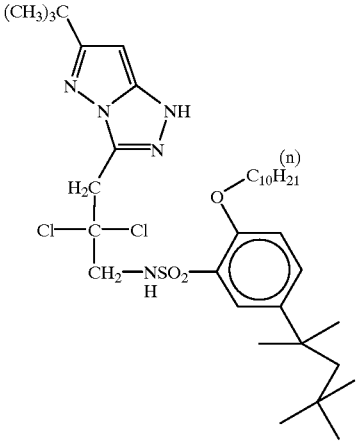
Practical compound examples of formula (MC-2) are presented below. However, the present invention is not limited to these examples.
M-49
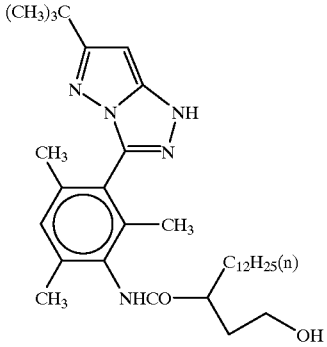
M-50
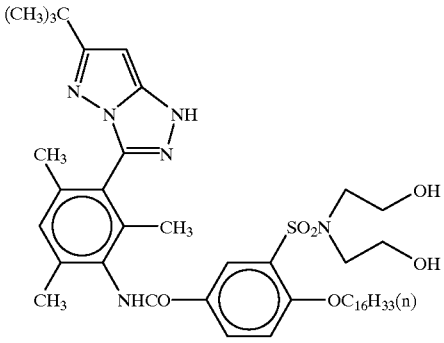

-continued
M-51
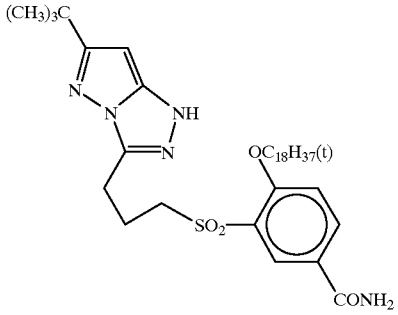
M-52
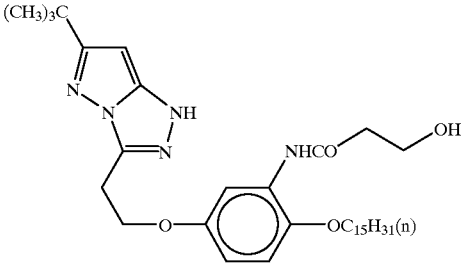
M-53
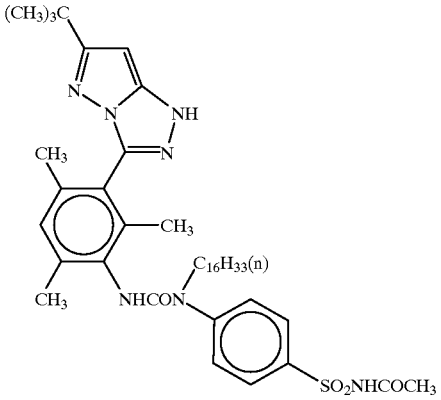
M-54
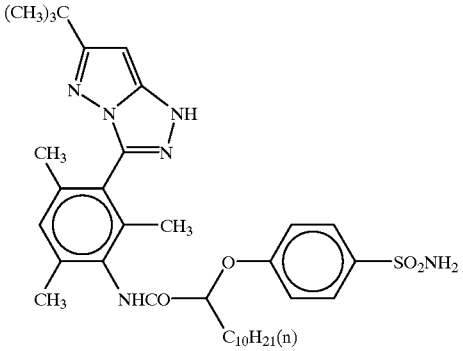
-continued
M-55
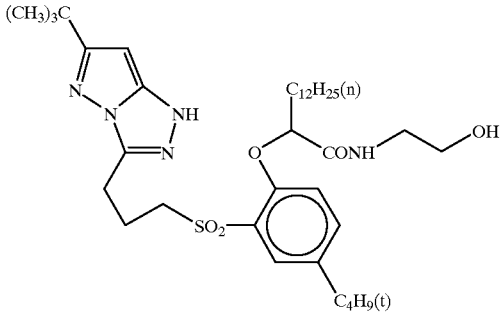
M-56
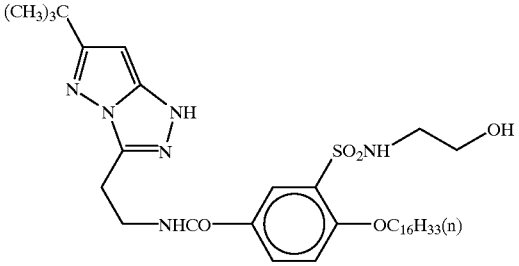
M-57
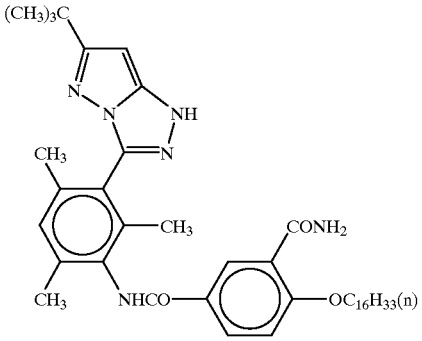
M-58
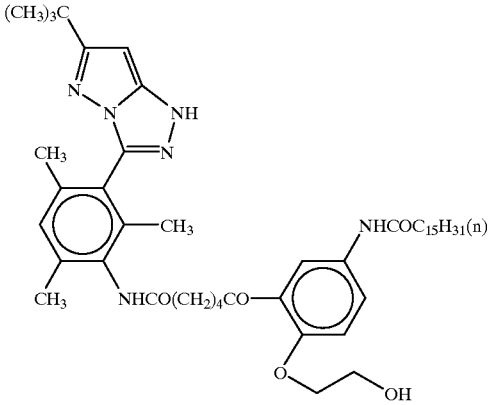

-continued
M-59
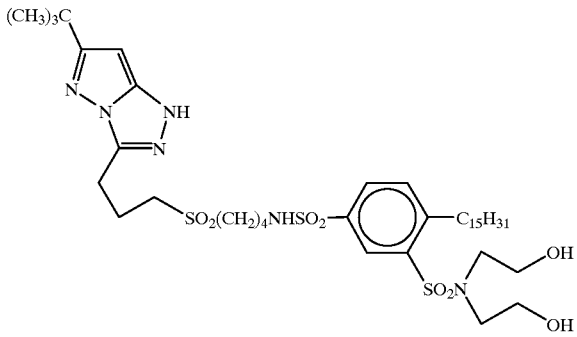
M-60
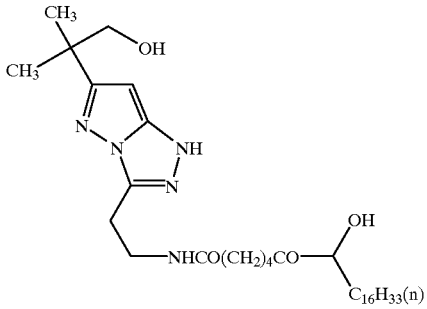
M-61
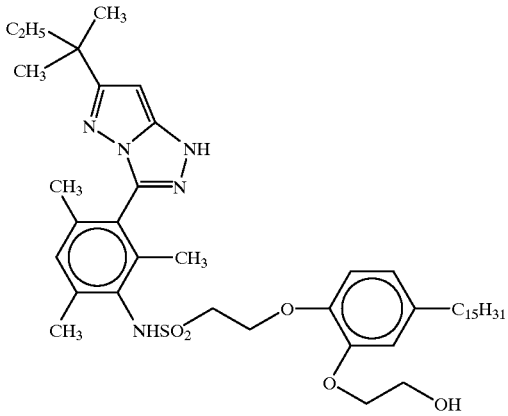
M-62
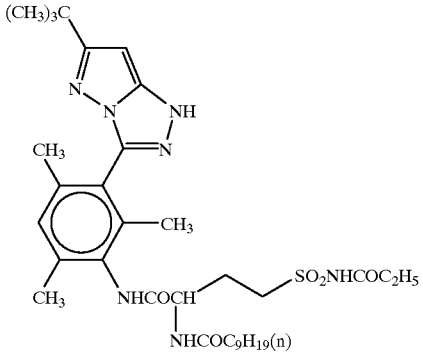
-continued
M-63
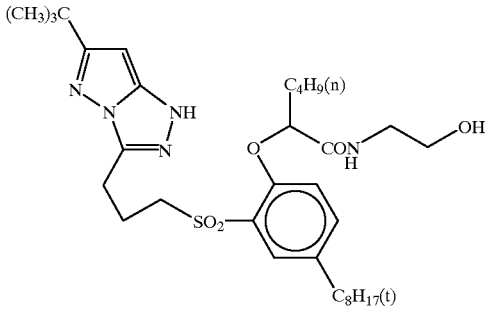
M-64
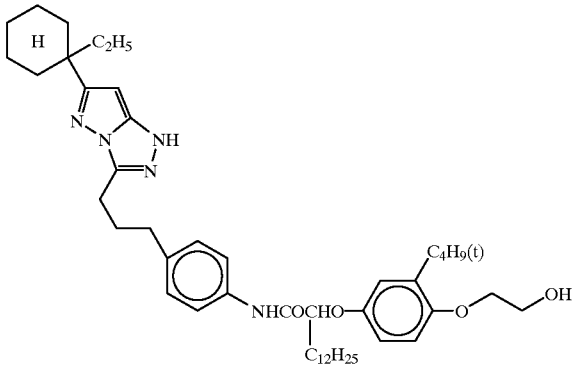
M-65
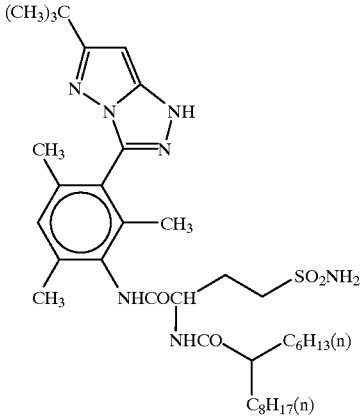
M-66
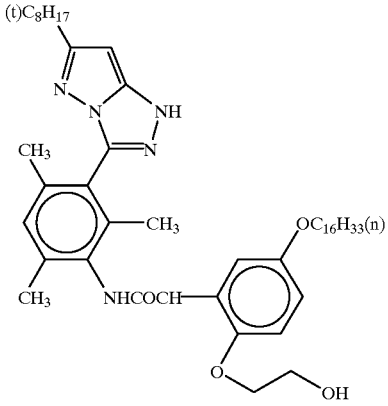

-continued
M-67
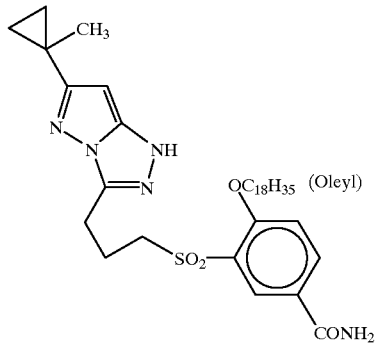
M-68
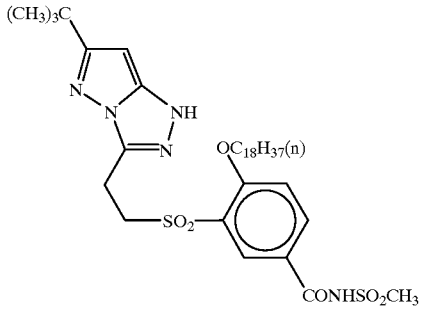
M-69
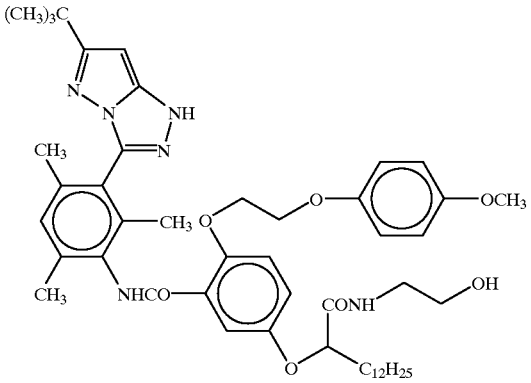
-continued
M-70
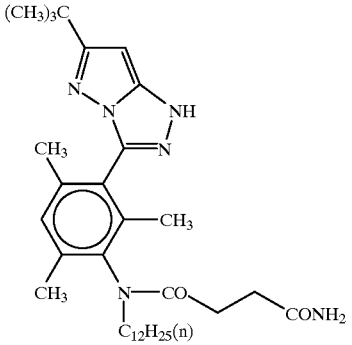
M-71
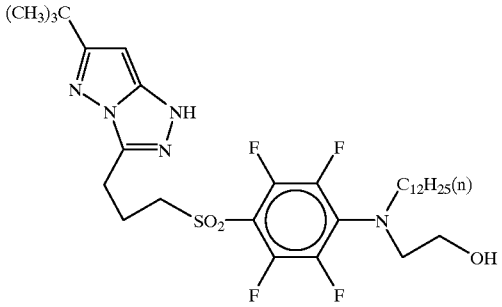
M-72
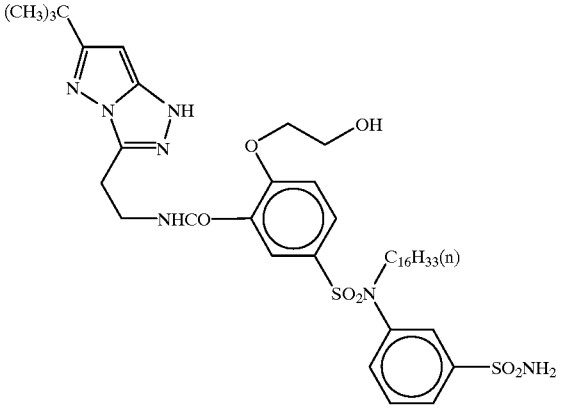
The following compounds are within the scope of formula (M-4). *: Rb is a normal alkyl group unless otherwise indicated.

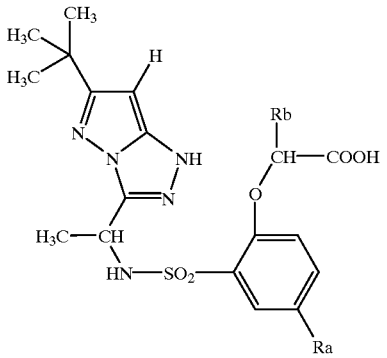
| Compound No. | Ra | Rb* |
|---|---|---|
| M-73 | 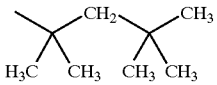 | $—C_6H_{13}$ |
| M-74 | 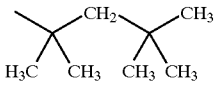 | $—C_8H_{17}$ |
| M-75 | 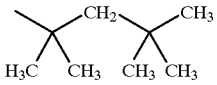 | $—C_{10}H_{21}$ |
| M-76 | 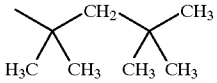 | $—C_{12}H_{25}$ |
| M-77 | 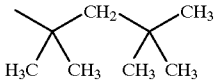 | $—C_{14}H_{29}$ |
| M-78 | 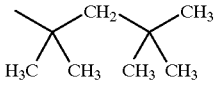 | $—C_{16}H_{31}$ |
| M-79 | 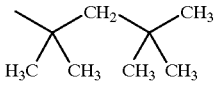 | $—C_{18}H_{37}$ |
| M-80 | 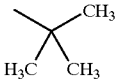 | $—C_6H_{13}$ |
| M-81 | 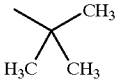 | $—C_8H_{17}$ |
| M-82 | 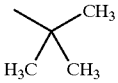 | $—C_{10}H_{21}$ |
| M-83 | 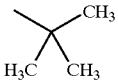 | $—C_{12}H_{25}$ |

-continued
| | | |
|---|---|---|
| M-84 | 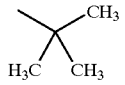 | $—C_{14}H_{29}$ |
| M-85 | 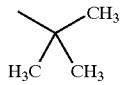 | $—C_{16}H_{31}$ |
| M-86 | 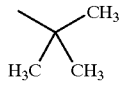 | $—C_{18}H_{37}$ |
| M-87 | 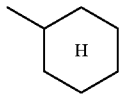 | $—C_{14}H_{29}$ |
| M-88 | 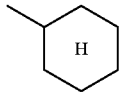 | $—C_{16}H_{31}$ |
| M-89 | 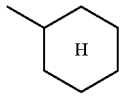 | $—C_{18}H_{37}$ |
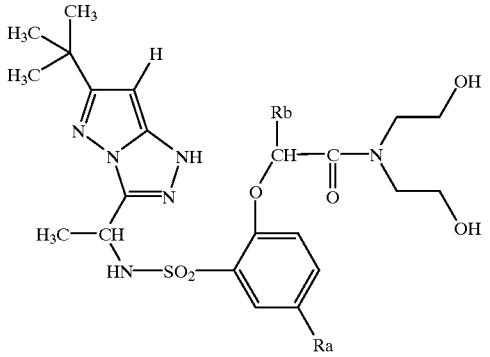
| Compound No. | Ra | Rb |
|---|---|---|
| M-90 | 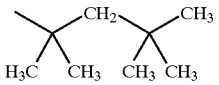 | $—C_6H_{13}$ |
| M-91 | 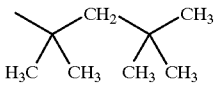 | $—C_8H_{17}$ |
| M-92 | 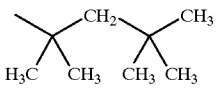 | $—C_{10}H_{21}$ |
| M-93 | 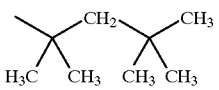 | $—C_{12}H_{25}$ |

-continued
| | | |
|---|---|---|
| M-94 | 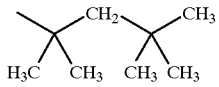 | $—C_{14}H_{29}$ |
| M-95 | 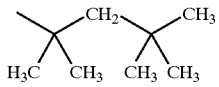 | $—C_{16}H_{31}$ |
| M-96 | 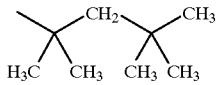 | $—C_{18}H_{37}$ |
| M-97 | 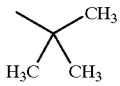 | $—C_6H_{13}$ |
| M-98 | 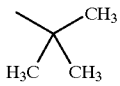 | $—C_8H_{17}$ |
| M-99 | 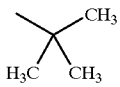 | $—C_{10}H_{21}$ |
| M-100 | 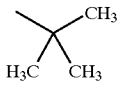 | $—C_{12}H_{25}$ |
| M-101 | 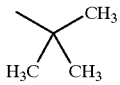 | $—C_{14}H_{29}$ |
| M-102 | 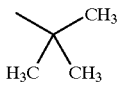 | $—C_{16}H_{31}$ |
| M-103 | 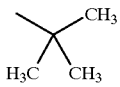 | $—C_{18}H_{37}$ |
| M-104 | 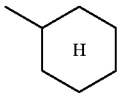 | $—C_8H_{17}$ |
| M-105 | 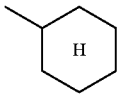 | $—C_{10}H_{21}$ |
| M-106 | 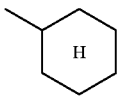 | $—C_{12}H_{25}$ |

-continued
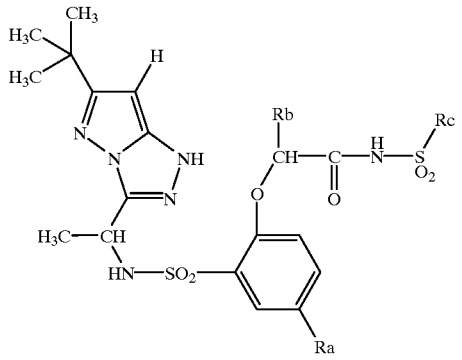
| Compound No. | Ra | Rb | Rc |
|---|---|---|---|
| M-107 | 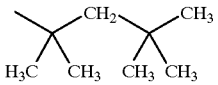 | $—C_6H_{13}$ | $—CH_3$ |
| M-108 | 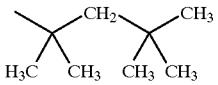 | $—C_8H_{17}$ | $—CH_3$ |
| M-109 | 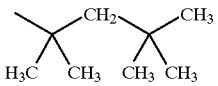 | $—C_{10}H_{21}$ | $—CH_3$ |
| M-110 | 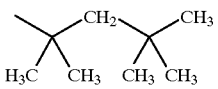 | $—C_{12}H_{25}$ | $—CH_3$ |
| M-111 | 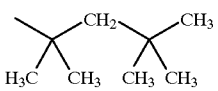 | $—C_{14}H_{29}$ | $—CH_3$ |
| M-112 | 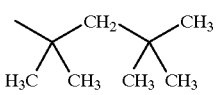 | $—C_{16}H_{31}$ | $—CH_3$ |
| M-113 | 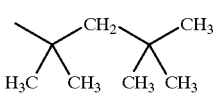 | $—C_{18}H_{37}$ | $—CH_3$ |
| M-114 | 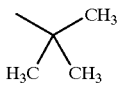 | $—C_6H_{13}$ | $—CH_3$ |
| M-115 | 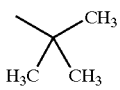 | $—C_8H_{17}$ | $—CH_3$ |
| M-116 | 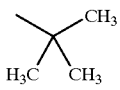 | $—C_{10}H_{21}$ | $—CH_3$ |
| M-117 | 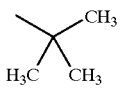 | $—C_{12}H_{25}$ | $—CH_3$ |

-continued
| | | | |
|---|---|---|---|
| M-118 | 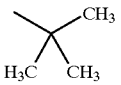 | $—C_{14}H_{29}$ | $—CH_3$ |
| M-119 | 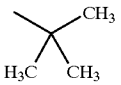 | $—C_{16}H_{31}$ | $—CH_3$ |
| M-120 | 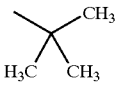 | $—C_{18}H_{37}$ | $—CH_3$ |
| M-121 | 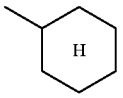 | $—C_8H_{17}$ | $—CH_3$ |
| M-122 | 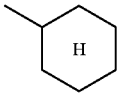 | $—C_{10}H_{21}$ | $—CH_3$ |
| M-123 | 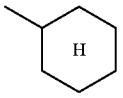 | $—C_{12}H_{25}$ | $—CH_3$ |
| M-124 | 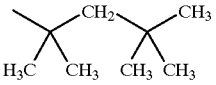 | $—C_8H_{17}$ | 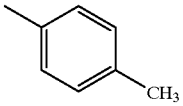 |
| M-125 | 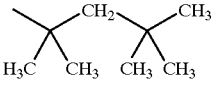 | $—C_{10}H_{21}$ | 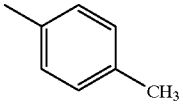 |
| M-126 | 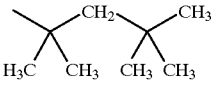 | $—C_{12}H_{25}$ | 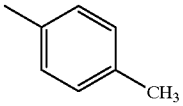 |
| M-127 | 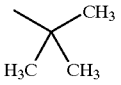 | $—C_8H_{17}$ | 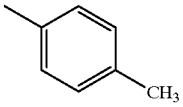 |
| M-128 | 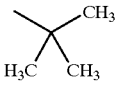 | $—C_{10}H_{21}$ | 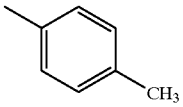 |
| M-129 | 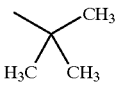 | $—C_{12}H_{25}$ | 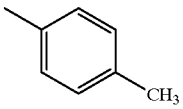 |
| M-130 | 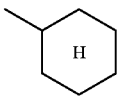 | $—C_8H_{17}$ | 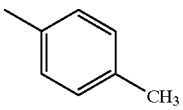 |

-continued
| | | | |
|---|---|---|---|
| M-131 | 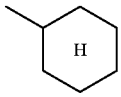 | $—C_{10}H_{21}$ | 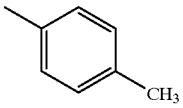 |
| M-132 | 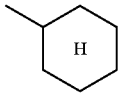 | $—C_{12}H_{25}$ | 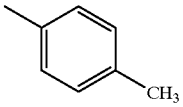 |
| M-133 | 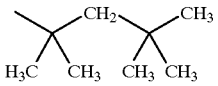 | $—C_{10}H_{21}$ | 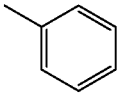 |
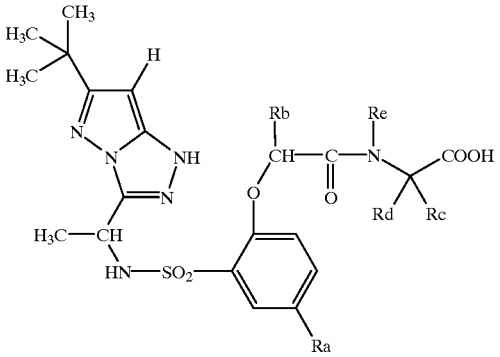
| Compound No. | Ra | Rb | Rc | Rd | Re |
|---|---|---|---|---|---|
| M-134 | 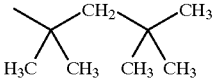 | $—C_8H_{17}$ | —H | —H | —H |
| M-135 | 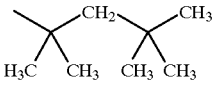 | $—C_{10}H_{21}$ | $—CH_3$ | —H | $—CH_3$ |
| M-136 | 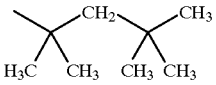 | $—C_{12}H_{25}$ | $—CH_3$ | —H | —H |
| M-137 | 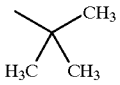 | $—C_8H_{17}$ | $—CH_3$ | $—CH_3$ | $—C_{10}H_{21}$ |
| M-138 | 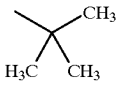 | $—C_{10}H_{21}$ | $—CH_3$ | $—CH_3$ | $—C_{10}H_{21}$ |

-continued
| | | | | | | |
|---|---|---|---|---|---|---|
| M-139 | 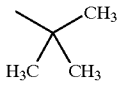 | $—C_{12}H_{25}$ | $—CH_3$ | $—CH_3$ | —H | |
| M-140 | 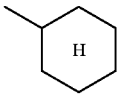 | $—C_8H_{17}$ | 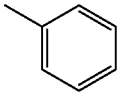 | $—CH_3$ | —H | |
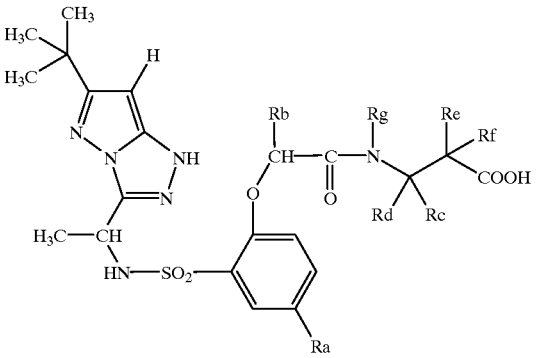
| Compound No. | Ra | Rb | Rc | Rd | Re | Rf | Rg |
|---|---|---|---|---|---|---|---|
| M-141 | 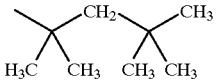 | $—C_8H_{17}$ | —H | —H | —H | —H | —H |
| M-142 | 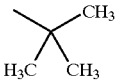 | $—C_8H_{17}$ | —H | —H | —H | —H | 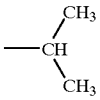 |
| M-143 | 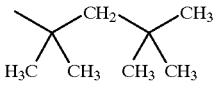 | $—C_{10}H_{21}$ | —H | —H | —H | —H | $—CH_3$ |
| M-144 | 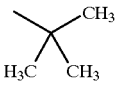 | $—C_{10}H_{21}$ | —H | —H | —H | —H | —H |
| M-145 | 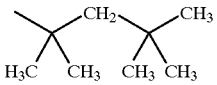 | $—C_{10}H_{21}$ | $—CH_3$ | —H | —H | —H | —H |
| M-146 | 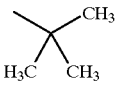 | $—C_8H_{17}$ | $—CH_3$ | $—CH_3$ | —H | —H | —H |

-continued
| | | | | | | | |
|---|---|---|---|---|---|---|---|
| M-147 | 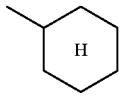 | $—C_{10}H_{21}$ | $—CH_3$ | $—CH_3$ | —H | —H | $—C_{10}H_{21}$ |
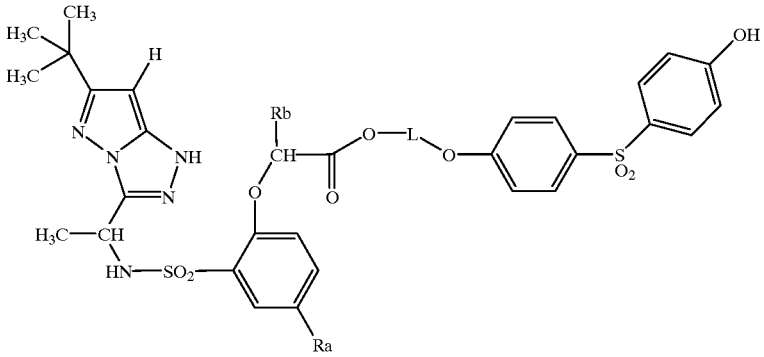
| Compound No. | Ra | Rb | L |
|---|---|---|---|
| M-148 | 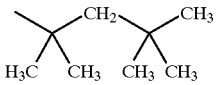 | $—C_6H_{13}$ | 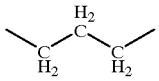 |
| M-149 | 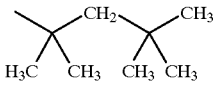 | $—C_8H_{17}$ | 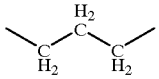 |
| M-150 | 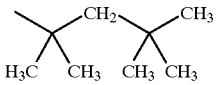 | $—C_{10}H_{21}$ | 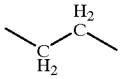 |
| M-151 | 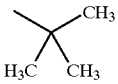 | $—C_{12}H_{25}$ | 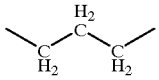 |
| M-152 | 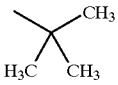 | $—C_{14}H_{29}$ | 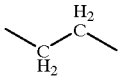 |
| M-153 | 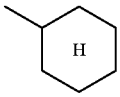 | $—C_{16}H_{31}$ | 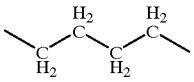 |
| M-154 | 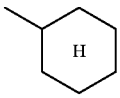 | $—C_{18}H_{37}$ | 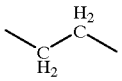 |

The following compounds are within the scope of formula (M-3).
M-155
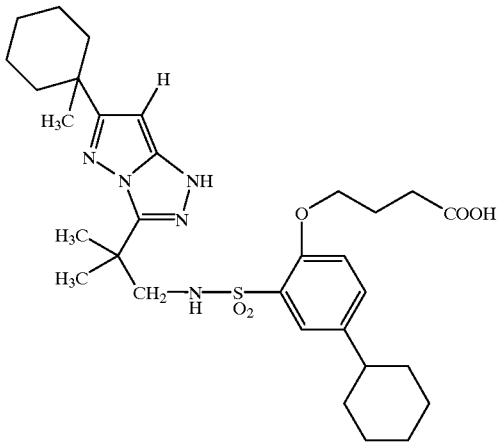
M-156
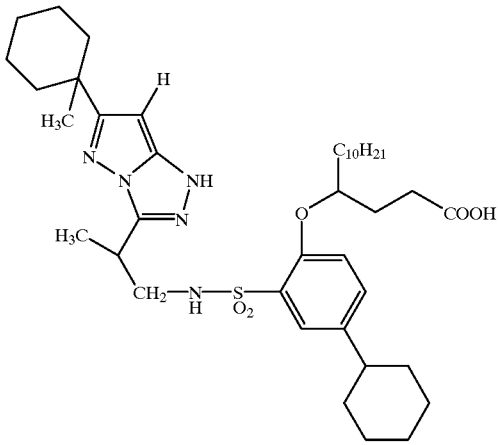
M-157
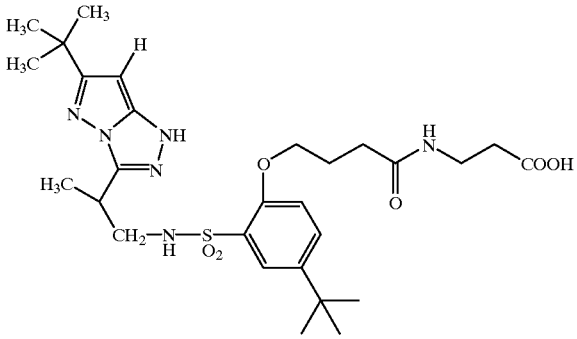
-continued
M-158
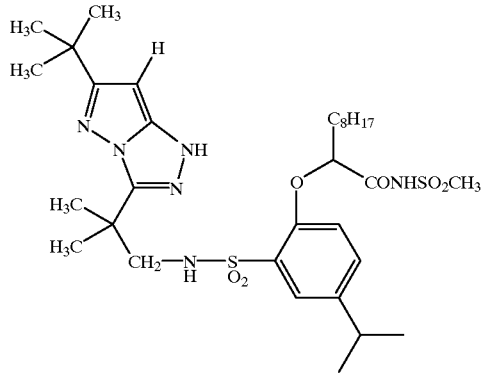
M-159
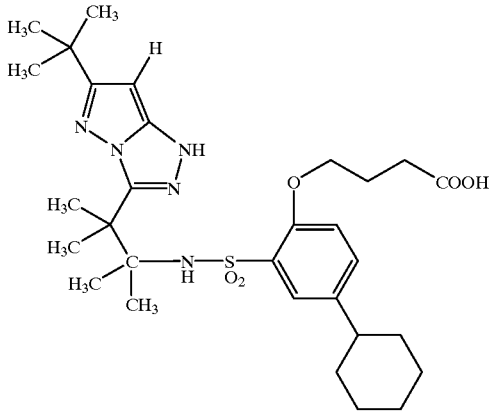
M-160
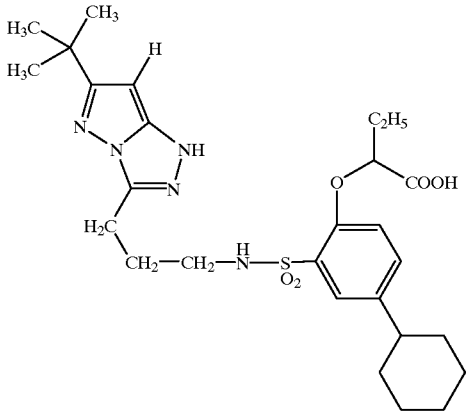
M-161
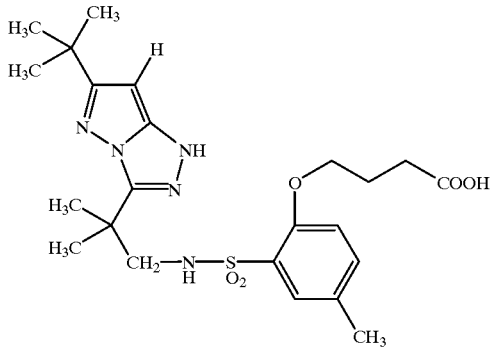

-continued

M-162

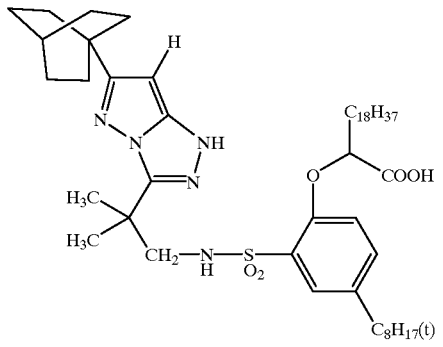

M-163

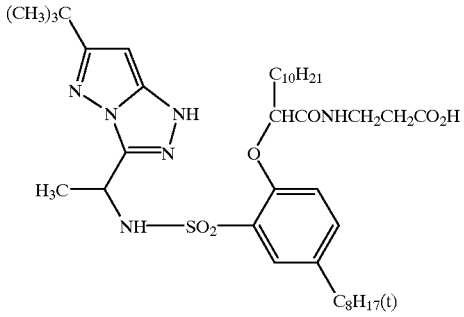

M-164

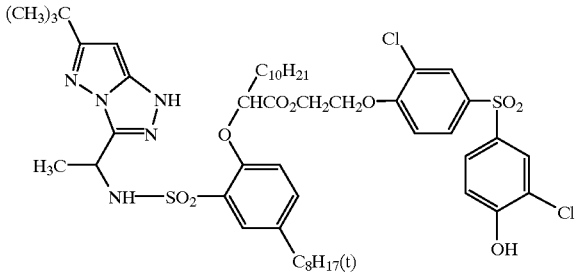

The coupler represented by formula (MC-1) or formula (MC-2) of the present invention can be synthesized by know methods. Examples are described in U.S. Pat. Nos. 4,540,654, 4,705,863, and 5,451,501, JP-A-61-65245, JP-A-62-209457, JP-A-62-249155, JP-A-63-41851, Jpn. Pat. Appln. KOKOKU Publication No. (hereinafter referred to as JP-B-7-122744, JP-B-5-105682, JP-B-7-13309, JP-B-7-82252, U.S. Pat. Nos. 3,725,067 and 4,777,121, JP-A-2-201442, JP-A-2-101077, JP-A-3-125143, and JP-A-4-242249, the disclosures of which are herein incorporated by reference.

Synthesis examples of the compounds of the invention are set forth below.

1. Synthesis of Intermediate B (Steps 1 and 2)

i) Step 1: Synthesis of Intermediate A

Into a 500 mL-three neck flask, provided with a thermometer, a stirrer and a cooler, 148.lg (1 mol) of phthalic anhydride, 93.5 g (1.05 mol) of α-alanine, and 200 mL of acetic acid were added and stirred at an internal temperature of 120° C. for 5 hr. The reaction solution was cooled to 80° C. and the reaction solution was pored drop-wise into 500 mL of iced water for 5 min. After the addition, the reaction solution was stirred for 30 min at a room temperature, and the precipitated crystal was suction-filtrated. The crystal was washed with 100 mL of water, dried, thereby to obtain 204 g (yield=93%) of Intermediate A of white crystal.

ii) Step 2: Synthesis of Intermediate B

Into a 500 mL-three neck flask, provided with a thermometer, a stirrer and a cooler, 109.6 g (0.5 mol) of Intermediate A, 150 mL of toluene, and 0.1 g of N,N-dimethylformamide were added and stirred at an external temperature of 90 to 100° C. Then, 101.3 g (0.75 mol) of thionyl chloride was added drop-wise for 30 min. After the addition, the reaction solution was further stirred with heating for additional 30 min, toluene and excess thionyl chloride were removed under a reduced pressure, thereby to obtain 116 g of Intermediate B of oil (m.p. 68–70° C., yield=97.6%).

2. Synthesis of Intermediate D (Steps 3 and 4)

i) Step 3: Synthesis of Intermediate C

Into a 1 L-three neck flask, provided with a thermometer, a stirrer and a cooler, 103.2 g (0.5 mol) of p-octylphenol, 153.7 g (0.5 mol) of ethyl 2-bromododecanoate, 103.6 g (0.75 mol) of potassium carbonate, and 400 mL of N,N-dimethylformamide were added and stirred at an internal temperature of 120° C. for 5 hr. The reaction solution was cooled to 40° C., suction-filtered, and the reaction vessel and the crystals were washed by pouring 600 mL of ethyl acetate. The filtrate was extracted with 500 mL of water twice (250 mL×2), separated the phases and the organic phase was dried over magnesium sulfate anhydride. The extracted solution was filtered and then concentrated under a reduced pressure to remove the solvent, thereby to obtain 216 g (yield was qualitative) of Intermediate C of oil.

ii) Step 4: Synthesis of Intermediate D

Into a 2 L-three neck flask, provided with a thermometer, a stirrer and a cooler, 216 g (0.5 mol) of Intermediate C obtained by Step 3, 600 mL of methylene chloride were added, and cooled to 0° C. or below by setting the reaction vessel on an ice/acetone bath. Then, 139.8 g (1.2 mol) of chlorosulfonic acid was added drop-wise for 45 min. During the addition, the internal temperature was maintained at 10° C. or below. After the addition, the reaction was continued for additional 2 hr at an internal temperature of 10° C. or below, 850 mL of acetonitrile was added to the reaction solution, followed by addition of 150 mL of N,N-dimethylacetamide drop-wise for 1 hr at a temperature of 10° C. or below. After the termination of the addition, the reaction solution was cooled to an internal temperature of 0° C., 93.2 mL (1 mol) of phosphorus oxychloride was added drop-wise for 20 min. The solution was stirred for 1 hr while the temperature was maintained at 40° C. by a water bath, then methylene chloride and acetonitrile were removed under a normal pressure while gradually raising the external temperature to 70° C. The condensed residue was dissolved to 850 mL of ethyl acetate, extracted with 1 L of water twice (500 mL×2), separated the phases, and the organic phase was dried over magnesium sulfate anhydride. The extracted solution was filtered and then concentrated under a reduced pressure to remove the solvent, thereby to obtain 260 g (yield=97.9%) of Intermediate D of oil.

3. Synthesis of Intermediate H (Steps 5 to 8)

i) Step 5: Synthesis of Intermediate E

Into a 500 mL-three neck flask, provided with a thermometer, a stirrer and a cooler, 43.3 g (0.1 mol) of Intermediate C obtained by Step 3 and 200 mL of methanol were added and stirred at 40° C. Then, a sodium hydride (8.0 g, 0.2 mol)/water (40 mL) solution was added drop-wise for 15 min. After stirring at 40° C. for 30 min, the solution was cooled to 20° C. with a water bath, a conc. hydrochloric acid (18 mL)/water (150 mL) solution was added. To the reaction solution, 250 mL of ethyl acetate was added, the reaction solution was stirred and left to stand, and then the water phase was removed. Then, 100 mL of water was added, and extraction and separation of phases were conducted, and the organic phase was dried over magnesium sulfate anhydrate. The extracted solution was filtered and concentrated under a reduced pressure to remove the solvent, thereby to obtain 40.5 g (yield was quantitative) of Intermediate E of oil.

ii) Step 6: Synthesis of Intermediate F

Into a 500 mL-three neck flask, provided with a thermometer, a stirrer and a cooler, 40.5 g (0.5 mol) of Intermediate E obtained by Step 5, 1 g of N,N-dimethylformamide, and 80 mL of toluene were added and stirred at an internal temperature of 100° C. Then, 16.2 g (0.12 mol) of thionyl chloride was added drop-wise for 20 min and stirred for 1 hr at 100° C. The reaction solution was concentrated under a reduced pressure to remove the solvent, thereby 42.5 g (yield was quantitative) of Intermediate F of oil was obtained.

iii) Step 7: Synthesis of Intermediate G

Into a 500 mL-three neck flask, provided with a thermometer, a stirrer and a cooler, 8.4 g (0.21 mol) of sodium hydride (60% lipophilic) and 100 mL of THF were added and stirred at a room temperature. Then, 10.1 g (0.105 mol) of methanesulfonamide was added and stirred at 40° C. for 2 hr. The reaction solution was cooled to an internal temperature of 15° C. or below with a water bath, and 43 g of the acid chloride obtained by Step 6, i.e., Intermediate F, was added drop-wise for 30 min. After 2 hr's reaction at 40° C., the reaction solution was cooled with iced water, and a conc. hydrochloric acid (11 mL)/water (200 mL) solution and 250 mL of ethyl acetate were added. The mixture was stirred, left to stand, then the water phase was removed and 200 mL of water was added, stirred and left to stand again to separate the organic phase and dried over magnesium sulfate anhydride. The extracted solution was filtered, followed by concentration under a reduced pressure to remove the solvent, thereby 48.2 g (yield was quantitative) of Intermediate G of oil was obtained.

iv) Step 8: Synthesis of Intermediate H

Into a 1 L-three neck flask, provided with a thermometer, a stirrer and a cooler, 48.2 g (0.1 mol) of Intermediate G obtained by Step 7 and 200 mL of methylene chloride were added, and cooled to 0° C. or below by setting an ice/acetone bath. Then, 28 g (0.24 mol) of chlorosulfonic acid was added drop-wise for 30 min. During the addition, the temperature was maintained at 10° C. or below. After the addition, the reaction was continued for additional 2 hr at a temperature of 10° C. or below, then 100 mL of acetonitrile was added to the reaction solution followed by 25 mL of N,N-dimethylacetamide at 10° C. or below. After the termination of the addition, the reaction solution was cooled to 0° C., and 18. 6 mL (0.2 mol) of phosphorus oxychloride was added drop-wise for 20 min. After stirring the reaction mixture for 1 hr while maintaining the temperature at 40° C. with a water bath, methylene chloride and acetonitrile were removed under a normal pressure while the external temperature was gradually raised to 70° C. The concentrated residue was dissolved into 350 mL of ethyl acetate, and washed with 400 mL of water twice (200 mL×2), separated phases and the organic phase was dried over magnesium sulfate anhydride. The extracted solution was filtered and concentrated under a reduce pressure to remove the solvent, thereby 58 g (yield was quantitative) of Intermediate H of oil was obtained.

4. Synthesis of Intermediate J (Steps 9 and 10)

i) Step 9: Synthesis of Intermediate I

Into a 500 mL-three neck flask, provided with a thermometer, a stirrer and a cooler, 8.4 g (0.21 mol) of sodium hydride (60% lipophilic) and 100 mL of THF were added and stirred at a room temperature. Then 18.0 g (0.105 mol) of p-toluenesulfonamide was added and stirred at 40° C. for 2 hr. The reaction solution was cooled with water to 15° C. or below, and 42.5 g (0.1 mol) of the acid chloride obtained by Step 6, i.e., Intermediate F, was added drop-wise for 30 min. After 2 hr's reaction at 50° C., the reaction solution was cooled with iced water, and a conc. hydrochloric acid (11 mL)/water (200 mL) solution and 250 mL of ethyl acetate were added. The mixture was stirred, left to stand, then the water phase was removed and 200 mL of water was added, stirred and left to stand again to separate the organic phase and the organic phase was dried over magnesium sulfate anhydride. The extracted solution was filtrated, then concentrated under a reduced pressure to remove the solvent, and recrystallized with acetonitrile, thereby to obtain 43.5 g (yield=78%) of Intermediate I of white crystals.

ii) Step 10: Synthesis of Intermediate J

Into a 500 mL-three neck flask, provided with a thermometer, a stirrer and a cooler, 27.9 g (0.05 mol) of Intermediate I obtained by Step 9 and 100 mL of methylene chloride were added, and cooled to 0° C. or below by setting an ice/acetone bath. Then, 13.98 g (0.12 mol) of chlorosulfonic acid was added drop-wise for 30 min. During the addition, the temperature was maintained at 10° C. or below. After the addition, the reaction was continued for additional 2 hr at 10° C. or below, then 100 mL of acetonitrile was added to the reaction solution followed by 15 mL of N,N-dimethylacetamide at 10° C. of below. After the termination of the addition, the reaction solution was cooled to 0° C. or below, and 9.32 mL (0.1 mol) of phosphorus oxychloride was added drop-wise for 20 min. After stirring the reaction mixture for 1 hr while maintaining the reaction temperature at 40° C. with a water bath, methylene chloride and acetonitrile were removed under a normal pressure while the external temperature was gradually raised to 70° C. The concentrated residue was dissolved into 400 mL of ethyl acetate, and washed with 400 mL of water twice (200 mL×2), separated phases, and the organic phase was dried over magnesium sulfate anhydrate. The extracted solution was filtered and concentrated under a reduce pressure to remove the solvent, thereby 32.5 g (yield was quantitative) of Intermediate J of oil was obtained.

5. Synthesis of Intermediate L (Step 11)

Into a 500 mL-three neck flask, provided with a thermometer, a stirrer and a cooler, 51 g (0.15 mol) of Intermediate K, 28.2 g (0.225 mol) of ethylene bromohydrin, 41.5 (0.3 mol) of potassium carbonate, and 200 mL of DMF were added and stirred with heating at 100° C. for 4 hr. The reaction solution was cooled to 40° C., inorganic salts were removed by suction-filtration, then the reaction vessel and crystals were washed with 300 mL of ethyl acetate. The filtrate was washed with 200 mL of water twice (100 mL×2), separated phases and the organic phase was dried over magnesium sulfate anhydride. The extracted solution was filtered, then concentrated under a reduced pressure to remove the solvent, and recrystallized with 200 mL of acetonitrile, thereby to obtain 45.4 g (yield=78.7%) of Intermediate L of white crystals.

6. Synthesis of exemplified compound M-75 (Steps 12 to 17)

i) Step 12: Synthesis of Intermediate 1

Into a 500 mL-three neck flask, provided with a thermometer, a stirrer and a cooler, 53.1 g (0.5 mol) of thiocarbohydrazide and 250 mL of methanol were added and stirred at an internal temperature of 10 to 15° C. by cooling with an iced water bath. While maintaining the internal temperature of 10 to 15° C., 69 g (0.5125 mol) of 1-chloropinacoline was added drop-wise for 30 min. After additional stirring for 30 min, the iced water bath was removed, and the reaction solution was stirred for 1 hr at a room temperature. During the stirring, the reaction solution gradually generated heat and the internal temperature rose up to 40° C. Then, the reaction solution was heated to reflux, and the solvent was removed under a reduced pressure. The concentrated residue was dissolved to 400 mL of acetonitrile and crystallized by cooling with ice. The precipitated crystal was suction-filtered, thereby to obtain 97.6 g (yield=87.6%) of Intermediate 1 of crystals.

ii) Step 13: Synthesis of Intermediate 2

Into a 500 mL-three neck flask, provided with a thermometer, a stirrer and a cooler, 55.7 g (0.25 mol) of Intermediate 1 and 300 mL of acetonitrile were added and heated to reflux on a water bath. To the mixture, a Intermediate B 59.4 g (0.25 mol)/acetonitrile (30 mL) solution was added drop-wise for 2 hr. After the completion of the addition, the mixture was additionally heated to reflux for 30 min, and cooled with water. The precipitated crystals were suction-filtered, poured with acetonitrile, and 84.3 g (yield 83.1%) of crystallized HCl salt of Intermediate 2 was obtained. The HCl salt of Intermediate 2 was dispersed into 250 mL of water, a sodium hydroxide (7.9 g)/water (70 mL) solution was added drop-wise for 30 min at an internal temperature of 40° C. After stirring for 1 hr, pH of the reaction solution was adjusted to 7 to 8 with $NaHCO_3$ and stirred for additional 30 min. The reaction solution was cooled with water and the crystals were suction-filtered, washed with water and dried at 50° C., thereby to obtain 72.9 g (yield=78.9%) of Intermediate 2 of crystals.

iii) Step 14: Synthesis of Intermediate 3

Into a 500 mL-three neck flask, provided with a thermometer, a stirrer and a cooler, 73.9 g (0.2 mol) of Intermediate 2 and 180 mL of acetic anhydride were added and heated to reflux for 5 hr with an oil bath set at 150° C. Then, acetic anhydride was removed under a reduced pressure with an aspirator while maintaining the internal temperature at 110° C., 200 mL of acetonitrile was added drop-wise to the concentrate for 10 min, followed by adding 10 mL of methanol and heating to reflux. To the reaction solution, 15.3 mL of conc. hydrochloric acid was added drop-wise for 15 min, and then, heated to reflux for 2 hr. The reaction solution was cooled with water, followed by with iced water to 5 to 10° C. for 1 hr. The precipitated crystals were suction-filtered, poured with acetonitrile, thereby to obtain 71 g (yield=95%) of Intermediate 3 of crystals.

Purity of the crystals was measured with HPLC to reveal that the purity was 93% with a reaction by-product of sulfur.

iv) Step 15: Synthesis of Intermediate 4

Into a 500 mL-three neck flask, provided with a thermometer, a stirrer and a cooler, 71.0 g (0.176 mol) of Intermediate 3 and 350 mL of water were added and stirred at 40° C. Then, a sodium hydroxide (6.6 g)/water (50 mL) solution was added drop-wise for 30 min. After stirring for 1 hr, pH of the reaction solution was adjusted to 7 to 8 with $NaHCO_3$ and stirred for additional 30 min. After the reaction solution was cooled with water, crystals were suction-filtered, washed with water, thereby to obtain Intermediate 3 in a free form. All of the Intermediate 3 in a free form was dispersed into 350 mL of IPA, heated to reflux. To the solution, 11 g of hydrazine hydrate was added drop-wise for 20 min. After the addition, the solution was heated to reflux for 1 hr. The reaction solution was cooled with water to 20° C., the precipitated crystals were suction-filtered, and the filtrate was concentrated to obtain crude Intermediate 4 of oil. The crude product was dissolved into 200 mL of ethyl acetate, 6.5 g of hydrochloric acid gas was blew into the reaction vessel, and the precipitated crystals were suction-filtered. The crystals were washed with 30 mL of ethyl acetate and 30 mL of acetone, thereby to obtain 42 g (yield=96%) of Intermediate 4 hydrochloride.

v) Step 16: Synthesis of Intermediate 5

Into a 500 mL-three neck flask, provided with a thermometer, a stirrer and a cooler, 24.4 g (0.1 mol) of Intermediate 4, 53.1 g (0.1 mol) of Intermediate D, and 200 mL of acetonitrile were added and stirred at 15° C. To the reaction solution, 35 mL of triethylamine was added drop-wise for 30 min, the reaction solution was stirred for 1 hr at a room temperature, then 250 mL of ethyl acetate was added. Extraction with a conc. hydrochloric acid (15 mL)/water (150 mL) solution was performed, and phases were separated. The organic phase was washed with 200 mL of water twice (100 mL×2) and separated, dried over magnesium sulfate anhydrate. The extracted solution was filtered, concentrated under a reduced pressure to remove the solvent, thereby to obtain 68.3 g (yield=97.3%) of Intermediate 5 of oil.

vi) Step 17: Synthesis of exemplified compound M-75

Into a 500 mL-three neck flask, provided with a thermometer, a stirrer and a cooler, 68.3 g (0.0973 mol) of oil of Intermediate 5 obtained by Step 16, 100 mL of methanol, and 100 mL of THF were added at a room temperature and stirred to dissolve. Then, a sodium hydroxide (8.8 g)/water (35 mL) solution was added drop-wise to the reaction solution. The reaction solution was stirred for 1 hr at a room temperature, then 300 mL of ethyl acetate and a conc. hydrochloric acid (20 mL)/water (200 mL) solution were added for extraction and separated phases. The organic phase was washed with 200 mL of water twice (100 mL×2) and dried over magnesium sulfate anhydrate. After the extracted solution was filtered, concentration under a reduced pressure was performed to remove the solvent, thereby to obtain 66.5 g of the exemplified compound M-75 of oil. The oil product was dissolved into 550 mL of a solvent mixture of hexane/toluene=10/1, left to stand at a room temperature, and the precipitated crystals were suction-filtered. The crystals were washed with 100 mL of a solvent mixture of cold hexane/toluene=10/1, thereby to obtain 37.1 g (yield=56.5%) of the exemplified compound M-75 as white crystalls was obtained.

$^1$H NMR (DMSO-$d_6$, ppm) spectrum of the exemplified compound M-75 is set forth in FIG. 1.

7. Synthesis of exemplified compound M-109 (Step 18)

Exemplified compound M-109 was synthesized in the same manner as in the synthesis of the exemplified compound M-75, except that Intermediate D used in Step 16 was changed to Intermediate H. The thus obtained exemplified compound M-109 in oil was purified by silica gel column chromatography with an eluting solvent of a hexane/ethyl acetate=5/1 mixture, concentrated thereby to obtain 43.1 g (yield=57.3%) of the exemplified compound M-109 as amorphous.

Figure 3:
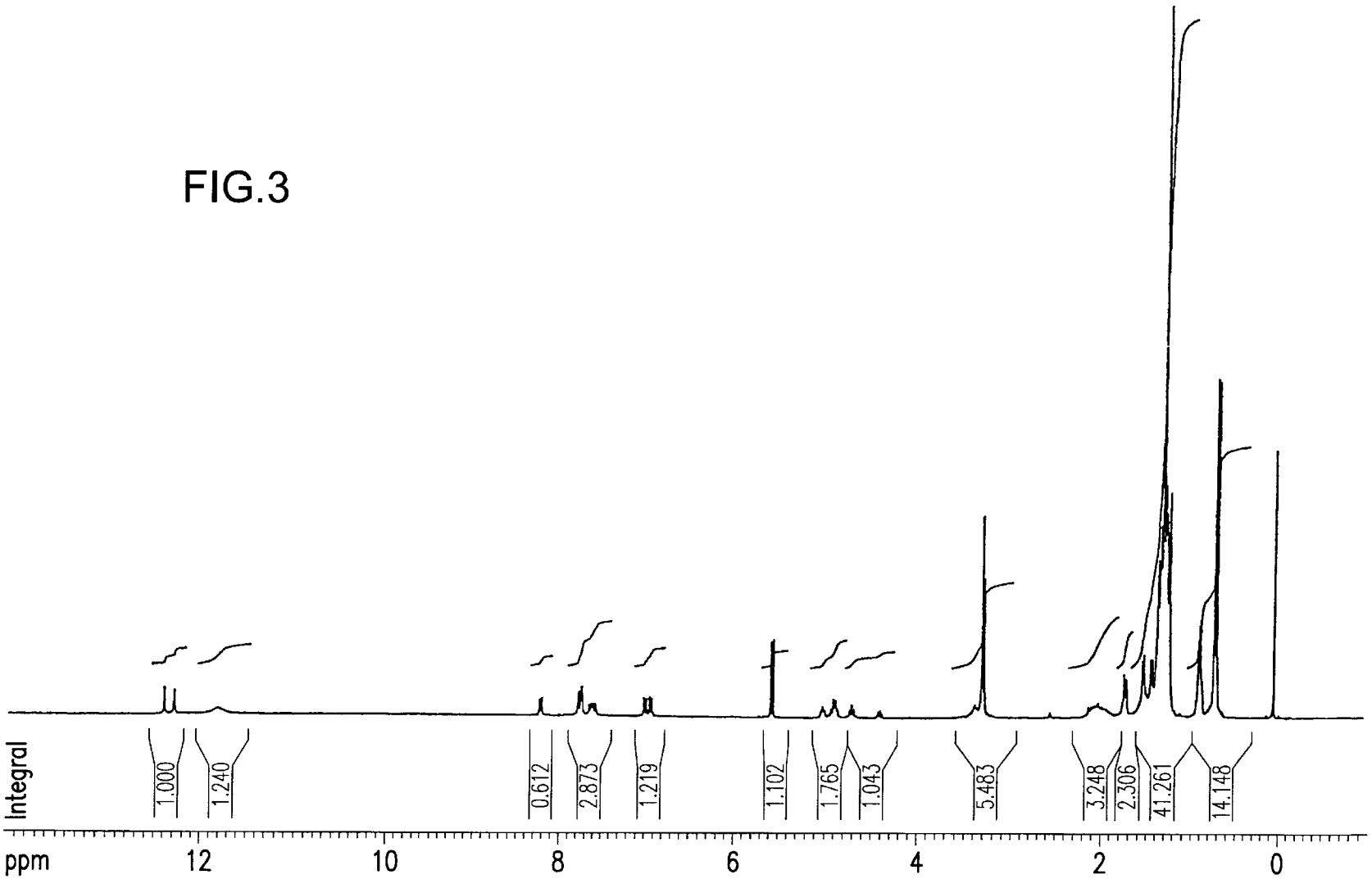
FIG. 3 is $^1$H NMR (300 MHz, DMSO-$d_6$, ppm) spectrum of the exemplified compound M-109.

$^1$H NMR (DMSO-$d_6$, ppm) spectrum of the exemplified compound M-109 is set forth in FIG. 3.

8. Synthesis of exemplified compound M-125 (Step 19)

Exemplified compound M-125 was synthesized in the same manner as in the synthesis of the exemplified compound M-75, except that Intermediate D used in Step 16 was changed to Intermediate J. The thus obtained exemplified compound M-125 of oil was dissolved into 350 mL of methanol, recrystallized under cooling with ice, thereby to obtain 51.3 g of the exemplified compound M-125 as white crystal (yield=62%, m.p. 87° C.).

Figure 4:
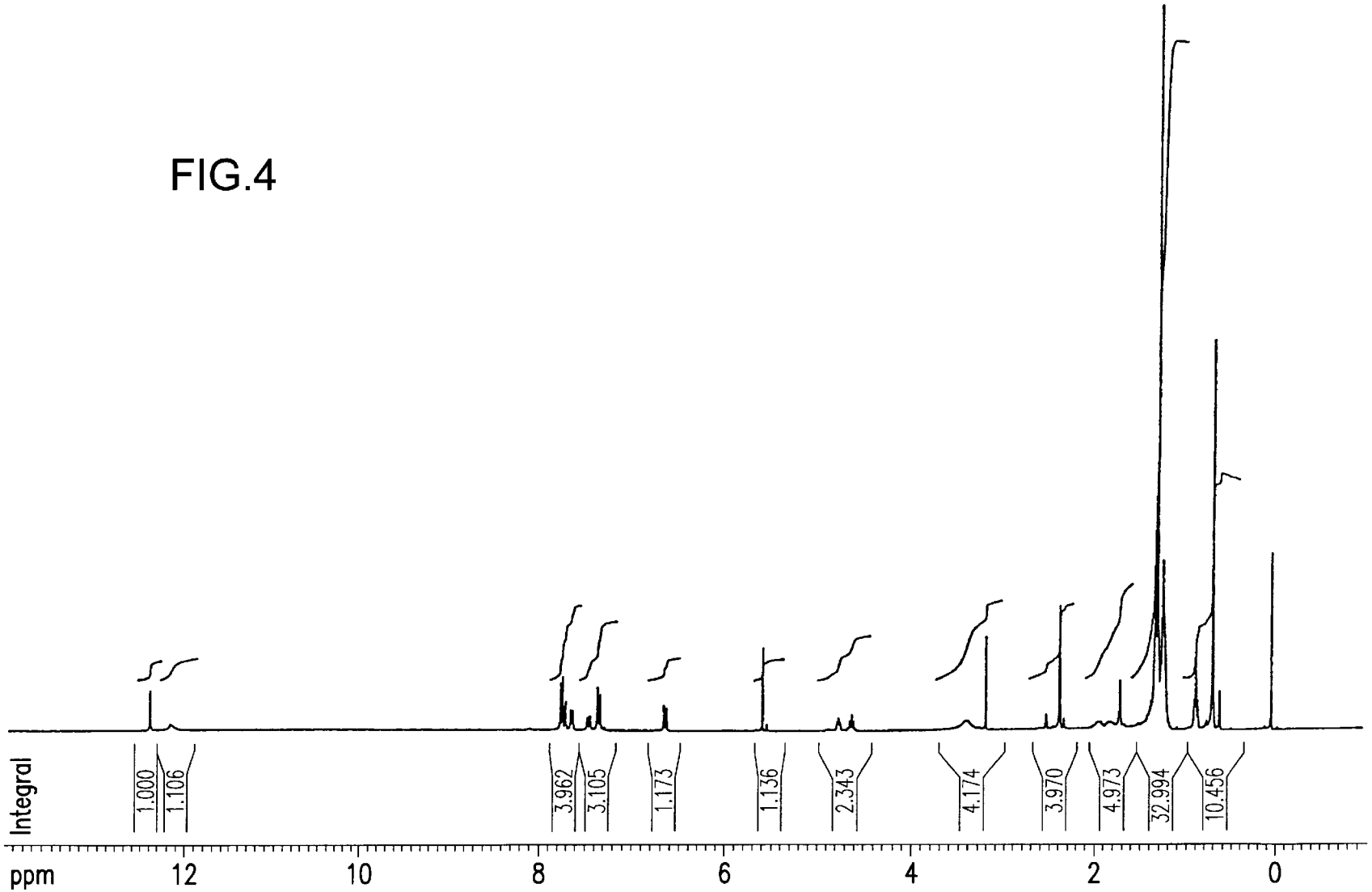
FIG. 4 is $^1$H NMR (300 MHz, DMSO-$d_6$, ppm) spectrum of the exemplified compound M-125.

$^1$H NMR (DMSO-$d_6$, ppm) spectrum of the exemplified compound M-125 is set forth in FIG. 4.

9. Synthesis of exemplified compound M-92 (Steps 20 and 21)

i) Synthesis of Intermediate 6: Step 20

Into a 500 mL-three neck flask, provided with a thermometer, a stirrer and a cooler, 6.7 g (0.01 mol) of the exemplified compound M-75, 0.25 mL of DMF and 100 mL of dichloromethane were added and stirred by cooling with water at 10° C. or below. Then 3.17 g of oxalyl dichloride was added drop-wise for 30 min. The reaction solution was stirred for 1 hr at a room temperature, concentrated under a reduced pressure with an aspirator, thereby to obtain 7.1 g of Intermediate 6 of oil (yield was quantitative).

ii) Step 21: Synthesis of exemplified compound M-92

Into a 500 mL-three neck flask, provided with a thermometer, a stirrer and a cooler, 21 g of diethanolamine, 100 mL of ethyl acetate, and 100 mL of iced water were added and stirred vigorously at an internal temperature of 5° C. Then, 7.1 g (0.01 mol) of Intermediate 6 synthesized by Step 20 was dissolved into 100 mL of ethyl acetate and the thus obtained solution was added drop-wise to the reaction solution for 15 min. After stirring was continued for 30 min, the reaction solution was separated, and the organic phase was washed with diluted hydrochloric acid solution once and with water once. The organic phase was separated and dried over magnesium sulfate anhydrate. The extracted solution was filtered, and concentrated under a reduced pressure to remove the solvent, thereby to obtain 7.7 g of crude oil of exemplified compound M-92. The crude oil product was purified by silica gel column chromatography with an eluting solvent of a methylene chloride/methanol=20/1 mixture, and concentrated thereby to obtain 6.0 g (yield=78.8%) of the exemplified compound M-92 as amorphous.

Figure 2:
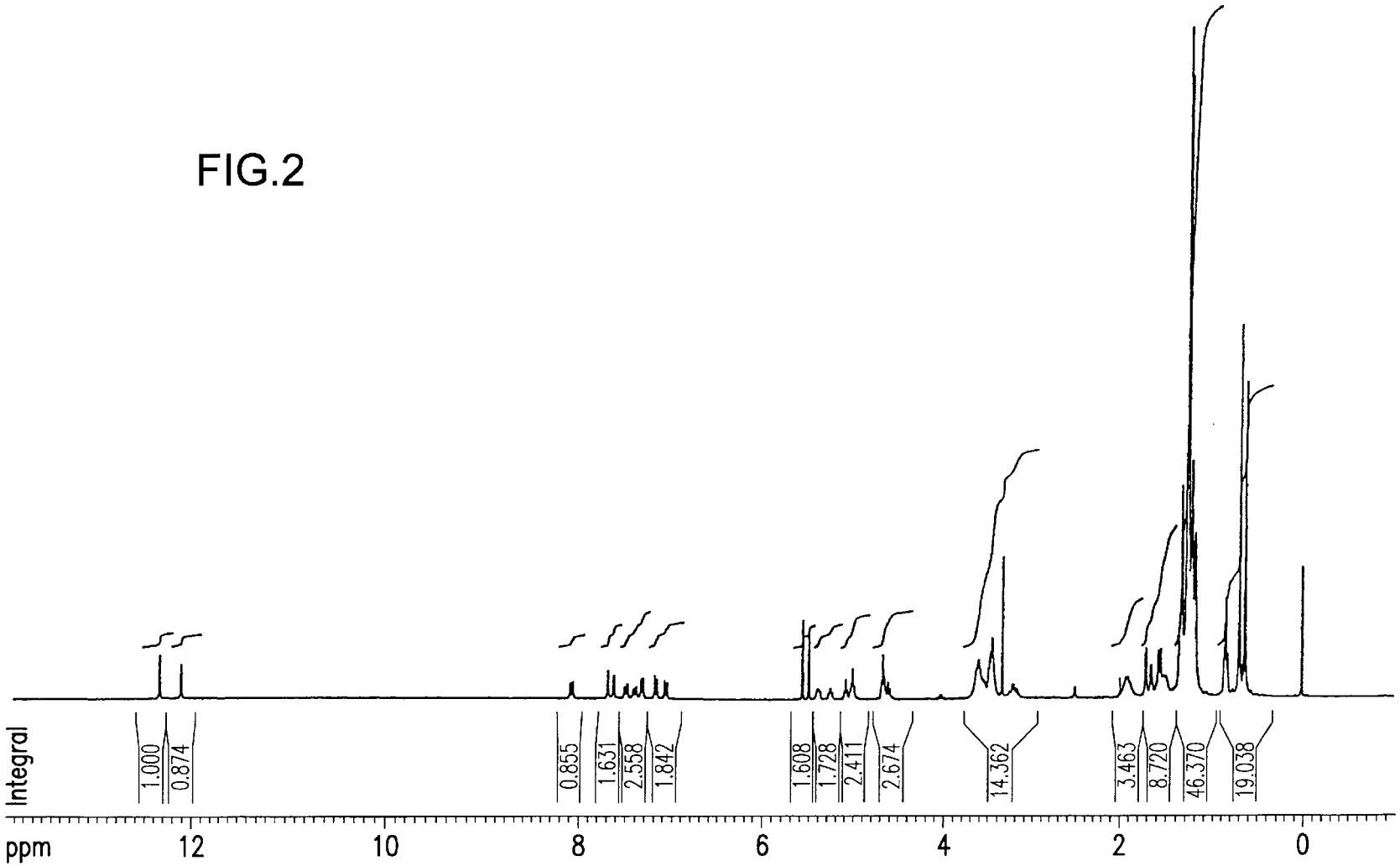
FIG. 2 is $^1$H NMR (300 MHz, DMSO-$d_6$, ppm) spectrum of the exemplified compound M-92.

$^1$H NMR (DMSO-$d_6$, ppm) spectrum of the exemplified compound M-92 is set forth in FIG. 2.

10. Synthesis of exemplified compound M-150 (Steps 22 and 23)

i) Into a 500 mL-three neck flask, provided with a thermometer, a stirrer and a cooler, 7.1 g (0.01 mol) of Intermediate 6, 5.76 g (0.015 mol) of Intermediate L, and 50 mL of acetonitrile were added, and 1.6 g (0.02 mol) of pyridine was added drop-wise for 15 min while maintaining the internal temperature at 15° C. or below. After reaction of 1 hr at a room temperature, 100 mL of ethyl acetate was added to the reaction solution. The organic phase was washed with diluted hydrochloric acid once and with water once. The organic phase was separated, and dried over magnesium sulfate anhydride. The extracted solution was filtered, concentrated under a reduced pressure to remove the solvent thereby to obtain crude oil Intermediate 7. The crude oily product was purified by silica gel column chromatography with an eluting solvent of a hexane/ethyl acetate=2/1 mixture and concentrated thereby to obtain 5.62 g (yield=54%) of Intermediate 7 as amorphous.

ii) Step 23: Synthesis of exemplified compound M-150

Into a 500 mL-three neck flask, provided with a thermometer, a stirrer and a gas inlet, 5.62 g (0.0054 mol) of Intermediate 7 obtained by Step 20, 100 mL of ethyl acetate, and 0.5 g of 10%Pd-C were added and hydrogen gas at a normal pressure was introduced through the gas inlet. After the system was exchanged with hydrogen gas, the reaction solution was stirred for 6 hr at a normal pressure. Pd-C was removed by Celite-filtration, and the filtrate was concentrated to obtain 5.03 g (yield=98%) of the exemplified compound M-150 as amorphous.

Figure 5:
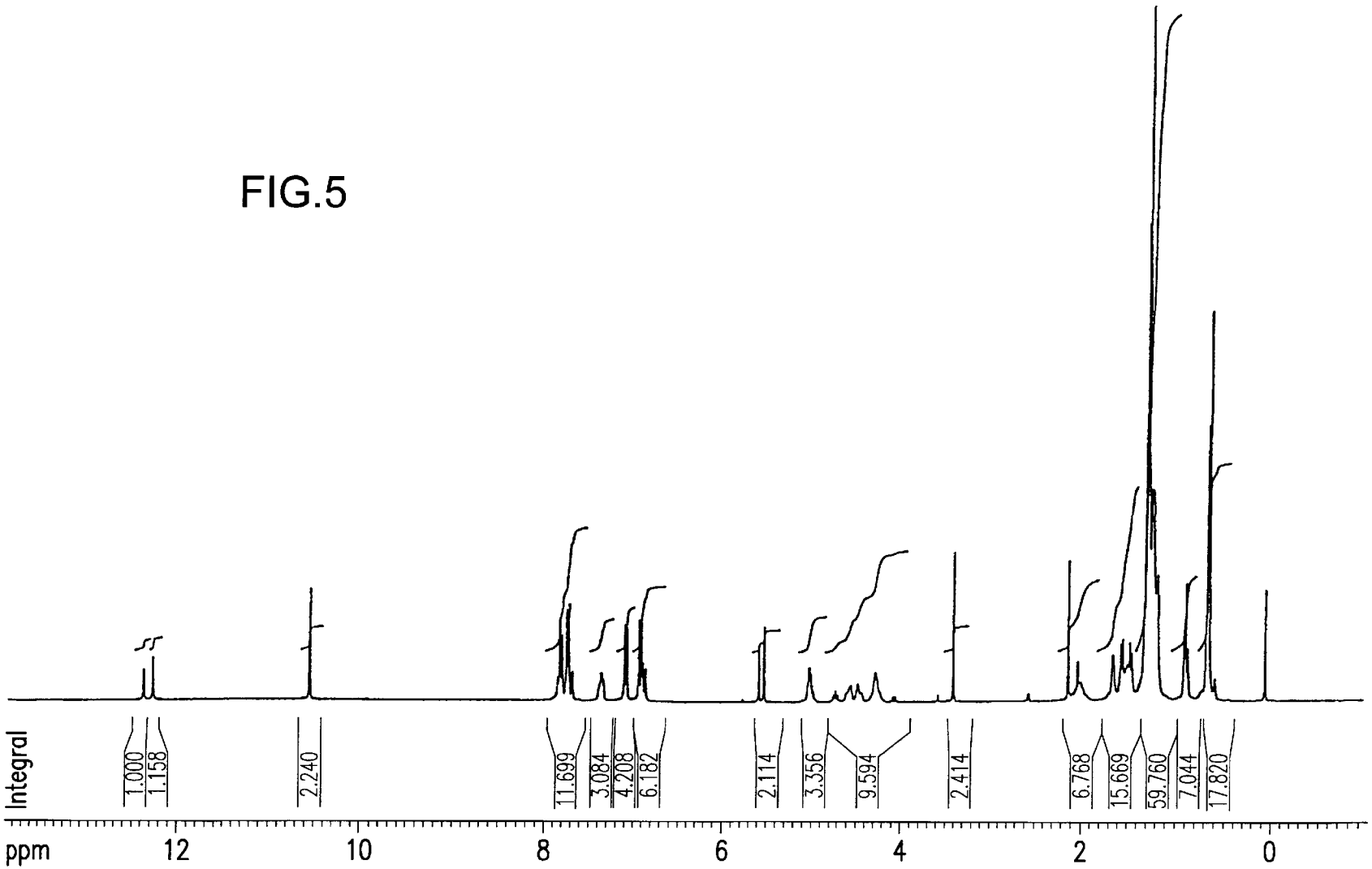
FIG. 5 is $^1$H NMR (300 MHz, DMSO-$d_6$, ppm) spectrum of the exemplified compound M-150.

$^1$H NMR (DMSO-$d_6$, ppm) spectrum of the exemplified compound M-150 is set forth in FIG. 5.

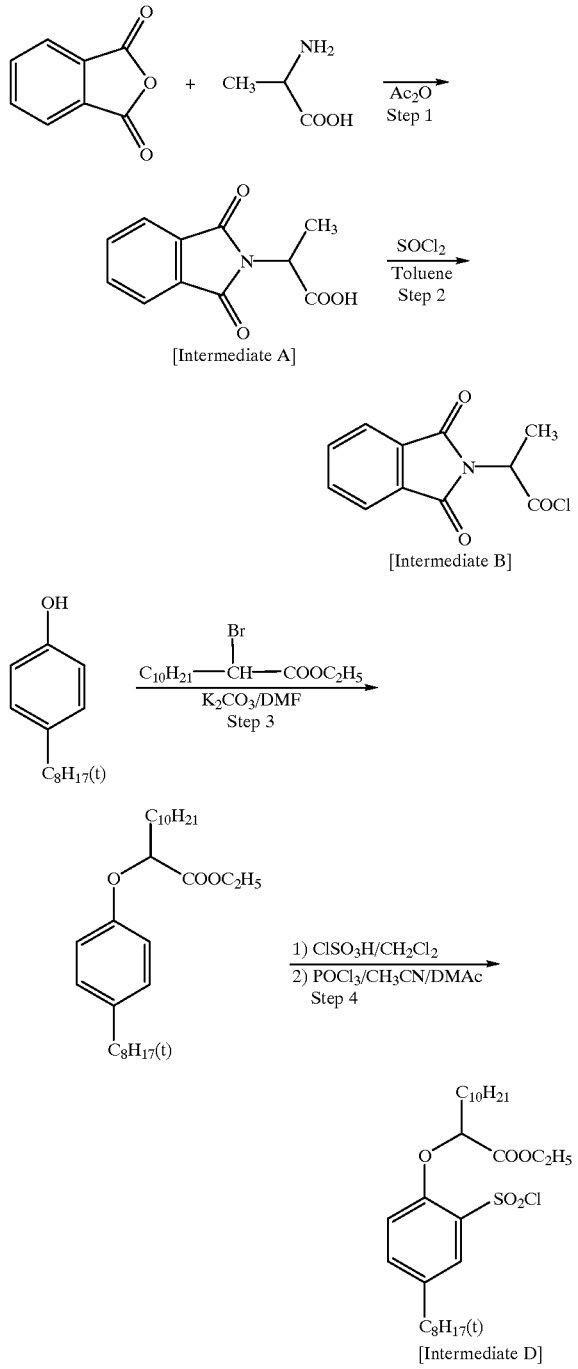

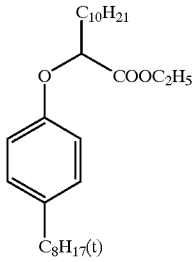

[Intermediate C]

NaOH/$H_2O$
MeOH
Step 5

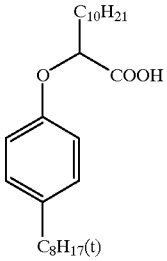

[Intermediate E]

$SOCl_2$
Toluene
Step 6

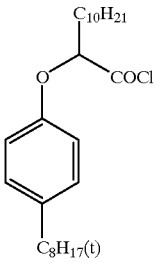

[Intermediate F]

$CH_3SO_2NH_2$
NaH/THF
Step 7

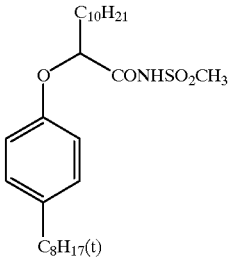

[Intermediate G]

1) $ClSO_3H/CH_2Cl_2$
2) $POCl_3/CH_3CN/DMAc$
Step 8

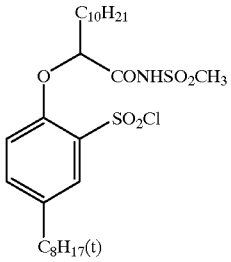

[Intermediate H]

-continued

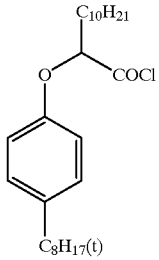

[Intermediate F]

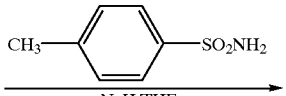

NaH/THF
Step 9

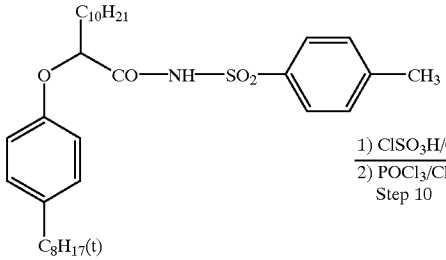

[Intermediate I]

1) $ClSO_3H/CH_2Cl_2$
2) $POCl_3/CH_3CN/DMAc$
Step 10

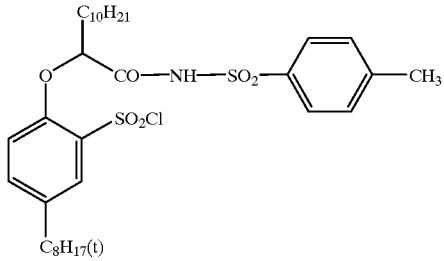

[Intermediate J]

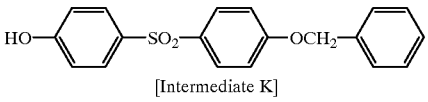

[Intermediate K]

$HOCH_2CH_2Br$
$K_2CO_3/DMF$
Step 11

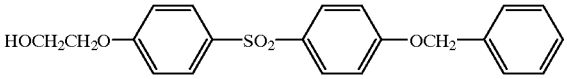

[Intermediate L]

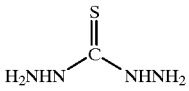

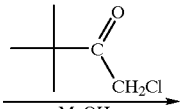

MeOH
Step 12

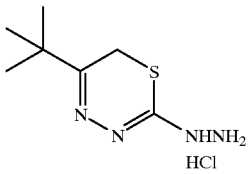

[Intermediate 1]

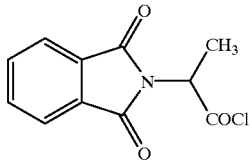

[Intermediate B]

$CH_3CN$
Step 13

-continued
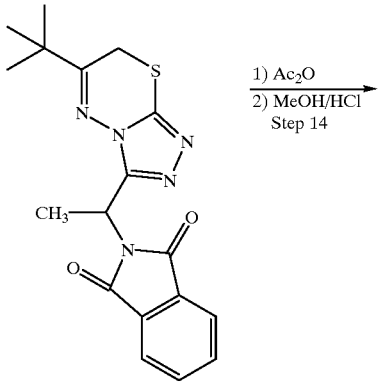
[Intermediate 2]
1) $Ac_2O$
2) MeOH/HCl
Step 14
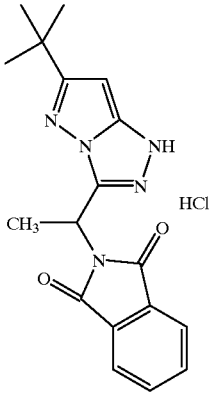
[Intermediate 3]
1) $NaOH/H_2O$
2) $H_2NNH_2$/IPA
Step 15
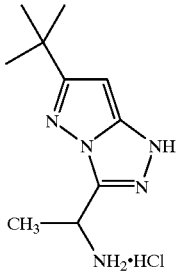
[Intermediate 4]
[Intermediate D]
$Et_3N/CH_3CN$
Step 16
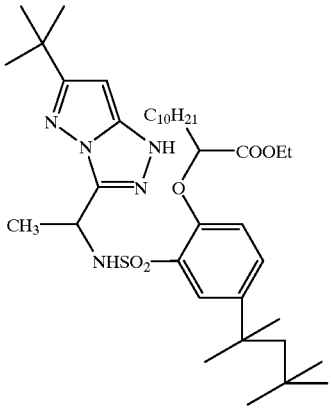
[Intermediate 5]
$NaOH/H_2O$
MeOH/THF
Step 17
-continued
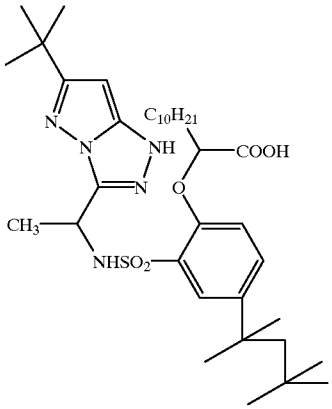
[Exemplified compound M-75]
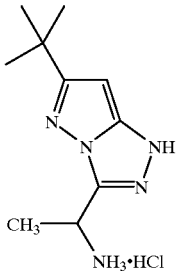
[Intermediate 4]
[Intermediate H]
$Et_3N/CH_3CN$
Step 18
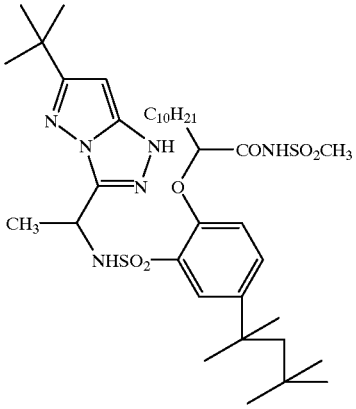
[Exemplified compound M-109]
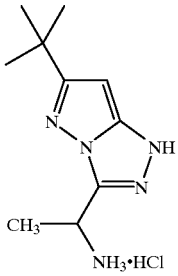
[Intermediate 4]
[Intermediate J]
$Et_3N/CH_3CN$
Step 19

-continued

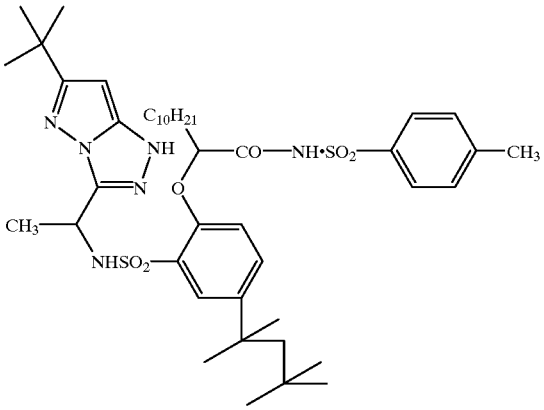

[Exemplified compound M-125]

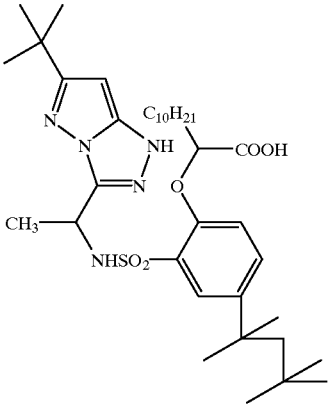

[Exemplified compound M-75]

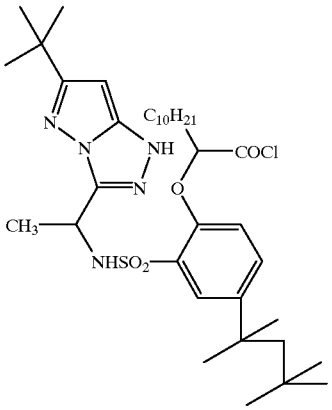

[Intermediate 6]

-continued

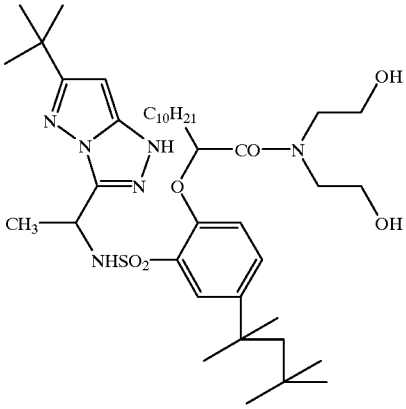

[Exemplified compound M-92]

[Intermediate 6] $\xrightarrow[\text{Pyridine/CH}_3\text{CN}]{\text{[Intermediate L]}}$ Step 22

$\xrightarrow[\text{DMF/CH}_2\text{Cl}_2]{\text{COCl—COCl}}$ Step 20

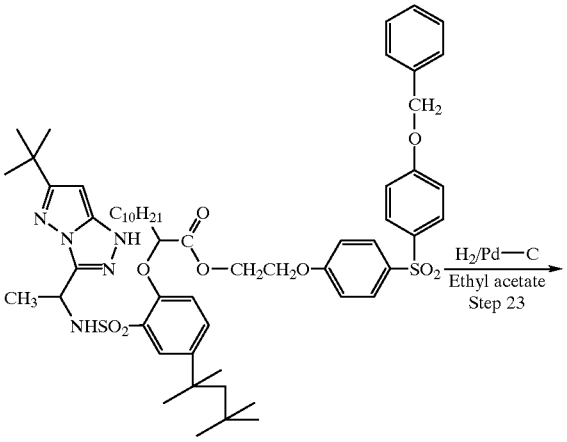

[Intermediate 7]

$\xrightarrow[\text{NaOH/Ethyl acetate/H}_2\text{O}]{\text{HN(CH}_2\text{CH}_2\text{OH)}_2}$ Step 21

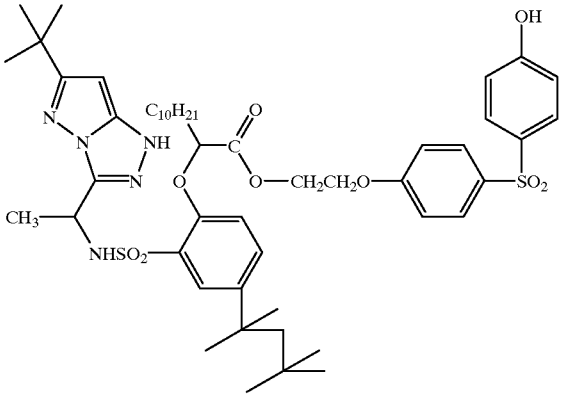

[Exemplified compound M-150]

The content of the coupler represented by formula (MC-1) or formula (MC-2) of the present invention in the sensitive material is 0.01 to 10 g, preferably 0.1 g to 2 g per $m^2$ of a sensitive material. The content is appropriately $1\times10^{-3}$ to 1 mol, preferably $2\times10^{-3}$ to $3\times10^{-1}$ mol per mol of the silver halide in the same sensitive emulsion layer as the layer in which the coupler represented by formula (MC-1) or formula (MC-2) is contained.

One or more types of couplers represented by formula (MC-1) can be added to a sensitive material. If this is the case, a plurality of couplers can be added to the same layer or different layers. The same can be applied to the coupler represented by formula (MC-2). Also, a coupler represented by formula (MC-1) and a coupler represented by formula (MC-2) can be used together in the sensitive material.

When a sensitive layer has a unit structure, i.e., includes two or more sensitive emulsion layers sensitive to the same color and having different sensitivities, the content per mol of a silver halide is preferably $2\times10^{-3}$ to $1\times10^{-1}$ mol in a low-speed layer and preferably $3\times10^{-2}$ to $3\times10^{-1}$ mol in a high-speed layer.

The coupler represented by formula (MC-1) or formula (MC-2) of the present invention can be introduced to the sensitive material by various known dispersion methods. Among other methods, an oil-in-water dispersion method is preferable in which a coupler is dissolved in a high-boiling organic solvent, used in combination with a low-boiling solvent where necessary, the solution is dispersed by emulsification in an aqueous gelatin solution by using a surfactant, and the dispersion is added to a silver halide emulsion.

Examples of the high-boiling solvent used in this oil-in-water dispersion method are described in, e.g., U.S. Pat. No. 2,322,027, the disclosure of which is herein incorporated by reference. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104, the disclosures of which are herein incorporated by reference. Dispersion using an organic solvent-soluble polymer is described in PCT International Publication WO88/00723, the disclosure of which is herein incorporated by reference.

Examples of the high-boiling solvent usable in the above-mentioned oil-in-water dispersion method are phthalic acid esters (e.g., dibutylphthalate, dioctylphthalate, dicyclohexylphthalate, di-2-ethylhexylphthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and di-2-ethylhexylphenylphosphate), benzoic acid esters (e.g., 2-ethylhexylbenzoate, 2,4-dichlorobenzoate, dodecylbenzoate, 2-ethylhexyl-p-hydroxybenzoate), amides (e.g., N,N-diethyldodecaneamide and N,N-diethyllaurylamide), alcohols and phenols (e.g., isostearylalcohol, 2,4-di-tert-amylphenol, and glycerinmonooleyl), aliphatic esters (e.g., dibutoxyethyl succinate, di-2-ethylhexyl succinate, 2-hexyldecyl tetradecanate, tributyl citrate, diethylazelate, isostearyllactate, and trioctyltosylate), aniline derivatives (e.g., N,N-dibutyl-2-butoxy-5-tert-octylaniline), chlorinated paraffins (paraffins containing 10% to 80% of chlorine), trimesic acid esters (e.g., trimesic acid tributyl), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy) butyric acid and 2-ethoxyoctanedecanic acid), alkylphosphoric acids (e.g., di-(2-ethylhexyl)phosphoric acid and diphenylphosphoric acid). In addition to the above high-boiling solvents, compounds described in, e.g., JP-A-6-258803, the disclosure of which is herein incorporated by reference, can also be preferably used as high-boiling solvents.

Of these compounds, phosphoric acid esters are preferable, and the combination of phosphoric acid esters and alcohols or phenols is also preferable.

The weight ratio of a high-boiling organic solvent to a coupler represented by formula (MC-1) or formula (MC-2) of the present invention is preferably 0 to 2.0, more preferably 0.01 to 1.0, and most preferably 0.01 to 0.5.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C.

The sensitive material of the present invention need only have at least one green-sensitive emulsion layer and contain a coupler represented by formula (MC-1) or formula (MC-2) of the present invention is contained, on a support. A common sensitive material can be formed by coating a support with at least one blue-sensitive silver halide emulsion layer, at least one green-sensitive silver halide emulsion layer, and at least one red-sensitive silver halide emulsion layer in the order named. However, the order of layers can be different from this one.

In the present invention, red-, green-, and blue-sensitive silver halide emulsion layers are preferably formed by coating in this order from the side closest to a support. Also, each sensitive layer has a unit structure including two or more sensitive emulsion sub-layers having different sensitivities. Each sensitive layer particularly preferably has a three-layered unit structure including three sensitive emulsion sub-layers, i.e., low-, medium-, and high-speed sub-layers from the side closest to a support. A coupler represented by formula (MC-1) or formula (MC-2) of the present invention can be added to any of low-, medium-, and high-speed sub-layers and is preferably added to a low-speed sub-layer.

The sensitive material of the present invention is spectrally sensitized to blue, green, and red. A wavelength by which the maximum value of the sensitivity of each sensitive layer is given is preferably 430 to 460 nm for a blue-sensitive layer, 520 to 560 nm for a green-sensitive layer, and 600 to 650 nm for a red-sensitive layer.

The sensitive material of the present invention can also have a sensitive emulsion layer having sensitivity in a wavelength region other than the blue, green, and red regions described above. In particular, the faithfulness of color reproduction can be improved by forming a fourth sensitive layer whose maximum sensitivity is given at a wavelength of 480 to 530 nm and by suppressing development of a red-sensitive layer as a function of development of this fourth sensitive layer. This fourth layer is preferably applicable to the sensitive material of the present invention.

In the present invention, a coupler for generating a different color from the color of an emulsion can be mixed in addition to a coupler for forming a dye which generates a complementary color of the color of the emulsion. For example, a cyan generating coupler or ii black generating coupler can be added to high- and medium-speed sub-layers of a green-sensitive emulsion unit in addition to a coupler represented by formula (MC-1) of the present invention. This improves the shadow expression.

A coupler represented by formula (MC-1) or formula (MC-2) of the present invention can be used together with another magenta coupler. This magenta coupler is preferably a 1-phenyl-3-acylamino-5-pyrazolone magenta coupler, and more preferably selected from C-4, C-7, and C-8 described in examples of this specification. When a coupler represented by formula (MC-1) or formula (MC-2) is used together with another magenta coupler, the molar ratio of a coupler represented by formula (MC-1) or formula (MC-2) of the present invention is preferably 30% or more, and more preferably 50% or more.

When a coupler represented by formula (MC-1) or formula (MC-2) of the present invention is used in combination with another magenta coupler, the content in the sensitive material is 0.01 to 10 g, preferably 0.1 to 2 g per $m^2$ of the sensitive material. The content is appropriately $1\times10^{-3}$ to 1 mol, preferably $2\times10^{-3}$ to $3\times10^{-1}$ mol per mol of a silver halide in the same sensitive emulsion layer as the layer in which the coupler represented by formula (MC-1) or formula (MC-2) is contained.

If a sensitive layer has a unit structure, the content of a coupler represented by formula (MC-1) or formula (MC-2) of the present invention per mol of a silver halide is preferably $2\times10^{-3}$ to $1\times10^{-1}$ mol in a low-speed sub-layer and preferably $3\times10^{-2}$ to $3\times10^{-1}$ mol in a high-speed sub-layer.

The sensitive material of the present invention can also contain a competing compound, i.e., a compound which competes with an image forming coupler to react with an oxidized form of a color developing agent and which does not form any dye image. Examples of this competing coupler are reducing compounds such as hydroquinones, catechols, hydrazines, and sulfonamidophenols, and compounds which couple with an oxidized form of a color developing agent but do not essentially form a color image (e.g., colorless compound forming couplers disclosed in German Patent No. 1,155,675, British Patent No. 861,138, and U.S. Pat. Nos. 3,876,428 and 3,912,513, and flow-out couplers disclosed in JP-A-6-83002, the disclosures of which are herein incorporated by reference).

The competing compound is preferably added to a sensitive emulsion layer or a non-sensitive layer containing a magenta coupler represented by formula (MC-1) or formula (MC-2) of the present invention. A completing compound is particularly preferably added to a sensitive emulsion layer containing a coupler represented by formula (MC-1) or formula (MC-2) of the present invention. The content of a competing compound is 0.01 to 10 g, preferably 0.10 to 5.0 g per $m^2$ of the sensitive material. The content is 1 to 1,000 mol %, preferably 20 to 500 mol % with respect to a coupler represented by formula (MC-1) or formula (MC-2) of the present invention.

In the sensitive material of the present invention, a sensitive unit sensitive to the same color can have a non-color-forming interlayer. Additionally, this interlayer preferably contains a compound selectable as the aforementioned competing compound.

To prevent deterioration of the photographic properties caused by formaldehyde gas, the sensitive material of the present invention preferably contains a compound described in U.S. Pat. No. 4,411,987 or 4,435,503, the disclosure of which is herein incorporated by reference, which can react with and fix formaldehyde gas.

In silver halide photographic emulsions used in the sensitive material of the present invention and silver halide photosensitive materials of the invention, it is generally possible to use various techniques and inorganic and organic materials described in Research Disclosure Nos. 308119 (1989), 37038 (1995), and 40145 (1997), the disclosure of which is herein incorporated by reference.

In addition, techniques and inorganic and organic materials usable in color photosensitive materials of the invention are described in portions of EP436,938A2 and patents cited below, the disclosures of which are herein incorporated by reference.

| Items | Corresponding portions |
|---|---|
| 1) Layer arrangements | page 146, line 34 to page 147, lie 25 |
| 2) Silver halide emulsions usable | page 147, line 26 to page 148 line 12 |
| 3) Yellow couplers usable together | page 137, line 35 to page 146, line 33, and page 149, lines 21 to 23 |
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 to page 29, line 50 |
| 9) Antiseptic and mildewproofing agents | page 150, lines 25 to 28 |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |
| 14) Film thickness. film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing.stabilizing step | page 153, lines 3 to 37 |

EXAMPLE 1

The present invention will be described in detail below by way of its examples, but the invention is not limited to these examples.

Preparation of Sample 101

A multilayered color sensitive material including layers having the following compositions was formed on a 127$\mu$m thick undercoated cellulose triacetate film support to make a sample 101. Numbers represent addition amounts per $m^2$. Note that the effects of added compounds are not restricted to the described purposes.

1st layer: Antihalation layer

| | | |
|---|---|---|
| Black colloidal silver | | 0.10 g |
| Gelatin | | 2.00 g |
| Ultraviolet absorbent U-1 | | 0.20 g |
| Ultraviolet absorbent U-3 | | 0.040 g |
| Ultraviolet absorbent U-4 | | 0.15 g |
| High-boiling organic solvent Oil-1 | | 0.10 g |
| Dye D-4 | | 1.0 mg |
| Dye D-8 | | 1.5 mg |
| Fine crystal solid dispersion of dye E-1 | | 0.10 g |

2nd layer: Interlayer

| | | |
|---|---|---|
| Gelatin | | 0.40 g |
| Compound Cpd-C | | 0.5 mg |
| Compound Cpd-J | | 1.5 mg |
| Compound Cpd-K | | 4.0 mg |
| High-boiling organic solvent Oil-3 | | 0.010 g |
| High-boiling organic solvent Oil-4 | | 0.020 g |
| High-boiling organic solvent Oil-5 | | 2.0 mg |
| High-boiling organic solvent Oil-7 | | 2.0 mg |
| High-boiling organic solvent Oil-8 | | 5.0 mg |
| Dye D-7 | | 2.5 mg |

3rd layer: Interlayer

| | | |
|---|---|---|
| Yellow colloidal silver | silver | 0.010 g |
| Gelatin | | 0.40 g |
| Compound Cpd-M | | 0.015 g |
| High-boiling organic solvent Oil-3 | | 0.020 g |

4th layer: Low-speed red-sensitive emulsion layer

| | | |
|---|---|---|
| Emulsion A | silver | 0.20 g |
| Emulsion B | silver | 0.20 g |
| Emulsion C | silver | 0.15 g |
| Gelatin | | 0.70 g |
| Coupler C-1 | | 0.10 g |
| Coupler C-2 | | 0.050 g |
| Coupler C-3 | | 0.050 g |
| Coupler C-9 | | 0.010 g |
| Coupler C-11 | | 0.050 g |
| Compound Cpd-C | | 5.0 mg |
| Compound Cpd-I | | 0.020 g |
| Compound Cpd-J | | 5.0 mg |
| High-boiling organic solvent Oil-2 | | 0.10 g |
| Additive P-1 | | 0.10 g |

5th layer: Medium-speed red-sensitive emulsion layer

| | | |
|---|---|---|
| Emulsion C | silver | 0.25 g |
| Emulsion D | silver | 0.25 g |
| Gelatin | | 0.70 g |
| Coupler C-1 | | 0.15 g |
| Coupler C-2 | | 0.050 g |
| Coupler C-3 | | 0.020 g |
| Coupler C-11 | | 0.070 g |
| High-boiling organic solvent Oil-2 | | 0.10 g |
| Additive P-1 | | 0.10 g |

6th layer: High-speed red-sensitive emulsion layer

| | | |
|---|---|---|
| Emulsion E | silver | 0.20 g |
| Emulsion F | silver | 0.25 g |
| Gelatin | | 1.20 g |
| Coupler C-1 | | 0.10 g |
| Coupler C-2 | | 0.050 g |
| Coupler C-3 | | 0.20 g |
| Coupler C-11 | | 0.30 g |
| High-boiling organic solvent Oil-2 | | 0.10 g |
| High-boiling organic solvent Oil-9 | | 0.20 g |
| Compound Cpd-K | | 2.0 mg |
| Compound Cpd-F | | 0.050 g |
| Additive P-1 | | 0.10 g |

7th layer: Interlayer

| | | |
|---|---|---|
| Gelatin | | 0.60 g |
| Additive M-1 | | 0.30 g |
| Compound Cpd-I | | 2.6 mg |
| Dye D-5 | | 0.020 g |
| Dye D-6 | | 0.010 g |

-continued

| | | |
|---|---|---|
| Compound Cpd-M | | 0.040 g |
| Compound Cpd-O | | 3.0 mg |
| Compound Cpd-P | | 2.5 mg |
| High-boiling organic solvent Oil-1 | | 0.020 g |
| High-boiling organic solvent Oil-6 | | 0.050 g |

8th layer: Interlayer

| | | |
|---|---|---|
| Yellow colloidal silver | silver | 0.010 g |
| Gelatin | | 0.60 g |
| Additive P-1 | | 0.05 g |
| Compound Cpd-A | | 0.10 g |
| Compound Cpd-M | | 0.10 g |
| High-boiling organic solvent Oil-6 | | 0.10 g |

9th layer: Low-speed green-sensitive emulsion layer

| | | |
|---|---|---|
| Emulsion G | silver | 0.25 g |
| Emulsion H | silver | 0.30 g |
| Emulsion I | silver | 0.25 g |
| Gelatin | | 1.00 g |
| Coupler C-7 | | 0.10 g |
| Coupler C-8 | | 0.17 g |
| Compound Cpd-B | | 0.030 g |
| Compound Cpd-D | | 0.020 g |
| Compound Cpd-E | | 0.020 g |
| Compound Cpd-G | | 2.5 mg |
| Compound Cpd-F | | 0.040 g |
| Compound Cpd-K | | 2.0 mg |
| Compound Cpd-L | | 0.020 g |
| High-boiling organic solvent Oil-1 | | 0.05 g |
| High-boiling organic solvent Oil-2 | | 0.10 g |

10th layer: Medium-speed green-sensitive emulsion layer

| | | |
|---|---|---|
| Emulsion I | silver | 0.20 g |
| Emulsion J | silver | 0.20 g |
| Gelatin | | 0.70 g |
| Coupler C-4 | | 0.25 g |
| Compound Cpd-B | | 0.030 g |
| Compound Cpd-D | | 0.020 g |
| Compound Cpd-F | | 0.050 g |
| Compound Cpd-G | | 2.0 mg |
| High-boiling organic solvent Oil-2 | | 0.10 g |

11th layer: High-speed green-sensitive emulsion layer

| | | |
|---|---|---|
| Emulsion K | silver | 0.55 g |
| Gelatin | | 0.80 g |
| Coupler C-4 | | 0.35 g |
| Compound Cpd-B | | 0.050 g |
| Compound Cpd-D | | 0.020 g |
| Compound Cpd-F | | 0.040 g |
| Compound Cpd-K | | 5.0 mg |
| High-boiling organic solvent Oil-2 | | 0.15 g |

12th layer: Interlayer

| | | |
|---|---|---|
| Gelatin | | 0.30 g |
| Compound Cpd-M | | 0.05 g |
| High-boiling organic solvent Oil-3 | | 0.025 g |
| High-boiling organic solvent Oil-6 | | 0.025 g |

13th layer: Yellow filter layer

| | | |
|---|---|---|
| Yellow colloidal silver | silver | 5.0 mg |
| Gelatin | | 1.00 g |
| Compound Cpd-C | | 0.010 g |
| Compound Cpd-M | | 0.030 g |
| Compound Cpd-L | | 0.010 g |
| High-boiling organic solvent Oil-1 | | 0.020 g |
| Fine crystal solid dispersion of dye E-2 | | 0.030 g |
| Fine crystal solid dispersion of dye E-3 | | 0.020 g |

14th layer: Interlayer

| | | |
|---|---|---|
| Gelatin | | 0.40 g |

15th layer: Low-speed blue-sensitive emulsion layer

| | | |
|---|---|---|
| Emulsion L | silver | 0.20 g |
| Emulsion M | silver | 0.20 g |
| Gelatin | | 0.80 g |

-continued

| | | |
|---|---|---|
| Coupler C-5 | | 0.20 g |
| Coupler C-6 | | 0.10 g |
| Coupler C-10 | | 0.10 g |
| Compound Cpd-I | | 0.010 g |
| Compound Cpd-M | | 0.010 g |
| 16th layer: Medium-speed blue-sensitive emulsion layer | | |
| Emulsion N | silver | 0.20 g |
| Emulsion O | silver | 0.20 g |
| Gelatin | | 0.90 g |
| Coupler C-5 | | 0.10 g |
| Coupler C-6 | | 0.10 g |
| Coupler C-10 | | 0.10 g |
| Compound Cpd-N | | 2.0 mg |
| Compound Cpd-K | | 2.0 mg |
| High-boiling organic solvent Oil-2 | | 0.050 g |
| 17th layer: High-speed blue-sensitive emulsion layer | | |
| Emulsion O | silver | 0.20 g |
| Emulsion P | silver | 0.25 g |
| Gelatin | | 1.20 g |
| Coupler C-5 | | 0.10 g |
| Coupler C-6 | | 0.10 g |
| Coupler C-10 | | 0.80 g |
| High-boiling organic solvent Oil-2 | | 0.10 g |
| Compound Cpd-N | | 5.0 mg |
| Compound Cpd-Q | | 0.20 g |
| 18th layer: 1st protective layer | | |
| Gelatin | | 0.70 g |
| Ultraviolet absorbent U-1 | | 0.20 g |
| Ultraviolet absorbent U-2 | | 0.050 g |
| Ultraviolet absorbent U-5 | | 0.30 g |
| Compound Cpd-O | | 5.0 mg |

-continued

| | | |
|---|---|---|
| Compound Cpd-A | | 0.030 g |
| Compound Cpd-H | | 0.20 g |
| Dye D-1 | | 0.10 g |
| Dye D-2 | | 0.050 g |
| Dye D-3 | | 0.07 g |
| High-boiling organic solvent Oil-3 | | 0.10 g |
| 19th layer: 2nd protective layer | | |
| Colloidal silver | silver | 0.10 mg |
| Fine grain silver iodobromide emulsion (average grain size 0.06 μm, AgI content 1 mol %) | silver | 0.10 g |
| Gelatin | | 0.50 g |
| 20th layer: 3rd protective layer | | |
| Gelatin | | 0.80 g |
| Polymethylmethacrylate (average grain size 1.5 μm) | | 0.10 g |
| 6:4 copolymer of methylmethacrylate and methacrylic acid (average grain size 1.5 μm) | | 0.10 g |
| Silicone oil SO-1 | | 0.030 g |
| Surfactant W-1 | | 3.0 mg |
| Surfactant W-2 | | 0.030 g |
| Surfactant W-7 | | 2.5 mg |

In addition to the above compositions, additives F-1 to F-10 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

TABLE 1

Silver iodobromide emulsions used in Sample 101 are as follows.

| Emulsion | Characteristics | Av. equivalent spherical diameter (μm) | COV* of diameter (%) | AgI Content (%) |
|---|---|---|---|---|
| A | Monodispersed tetradecahedral grains | 0.13 | 10 | 4.0 |
| B | Monodispersed cubic internally-fogged grains | 0.25 | 10 | 4.8 |
| C | Monodispersed (111) tabular grains having an av.as.rt** of 2.0 | 0.30 | 15 | 3.8 |
| D | Monodispersed (111) tabular grains having an av.as.rt** of 3.0 | 0.35 | 18 | 4.8 |
| E | Monodispersed (111) tabular grains having an av.as.rt** of 3.0 | 0.40 | 15 | 2.0 |
| F | Monodispersed (111) tabular grains having an av.as.rt** of 4.5 | 0.50 | 12 | 1.8 |
| G | Monodispersed cubic grains | 0.15 | 9 | 3.5 |
| H | Monodispersed cubic internally-fogged grains | 0.24 | 12 | 3.5 |
| I | Monodispersed (111) tabular grains having an av.as.rt** of 4.0 | 0.30 | 17 | 3.5 |
| J | Monodispersed (111) tabular grains having an av.as.rt** of 5.0 | 0.45 | 16 | 3.0 |
| K | Monodispersed (111) tabular grains having an av.as.rt** of 5.5 | 0.60 | 13 | 3.3 |
| L | Monodispersed tetradecahedral grains | 0.33 | 10 | 4.5 |
| M | Monodispersed cubic grains | 0.33 | 9 | 4.5 |
| N | Monodispersed (111) tabular grains having an av.as.rt** of 3.0 | 0.43 | 10 | 2.5 |
| O | Monodispersed (111) tabular grains having an av.as.rt** of 6.0 | 0.75 | 9 | 2.0 |
| P | Monodispersed (111) tabular grains having an av.as.rt** of 6.0 | 0.90 | 8 | 1.8 |

*COV: coefficient of variation in distribution
**av.as.rt: average aspect ratio

TABLE 2

| Spectral sensitization of Emulsions A to P | | |
|---|---|---|
| Emulsion | Spectral sensifizer added | Addition amount per mol of silver halide (g) |
| A | S-1 | 0.010 |
| | S-2 | 0.25 |
| | S-3 | 0.010 |
| | S-13 | 0.025 |
| B | S-2 | 0.25 |
| | S-8 | 0.015 |
| | S-13 | 0.025 |
| C | S-2 | 0.20 |
| | S-8 | 0.030 |
| | S-13 | 0.025 |
| D | S-1 | 0.030 |
| | S-2 | 0.15 |
| | S-3 | 0.020 |
| | S-13 | 0.10 |
| E | S-1 | 0.020 |
| | S-2 | 0.15 |
| | S-8 | 0.020 |
| | S-13 | 0.10 |
| F | S-1 | 0.020 |
| | S-2 | 0.17 |
| | S-8 | 0.030 |
| | S-13 | 0.025 |
| G | S-4 | 0.30 |
| | S-5 | 0.10 |
| | S-12 | 0.10 |
| H | S-4 | 0.20 |
| | S-12 | 0.10 |

TABLE 2-continued

| Spectral sensitization of Emulsions A to P | | |
|---|---|---|
| Emulsion | Spectral sensifizer added | Addition amount per mol of silver halide (g) |
| I | S-4 | 0.25 |
| | S-5 | 0.10 |
| | S-12 | 0.15 |
| J | S-4 | 0.40 |
| | S-9 | 0.10 |
| | S-12 | 0.15 |
| K | S-4 | 0.25 |
| | S-5 | 0.050 |
| | S-9 | 0.050 |
| | S-12 | 0.15 |
| L | S-6 | 0.25 |
| | S-7 | 0.15 |
| | S-10 | 0.050 |
| M | S-6 | 0.10 |
| | S-10 | 0.15 |
| | S-11 | 0.25 |
| N | S-10 | 0.25 |
| | S-11 | 0.25 |
| O | S-6 | 0.10 |
| | S-10 | 0.20 |
| | S-11 | 0.25 |
| P | S-6 | 0.050 |
| | S-7 | 0.050 |
| | S-10 | 0.20 |
| | S-11 | 0.25 |

C-1

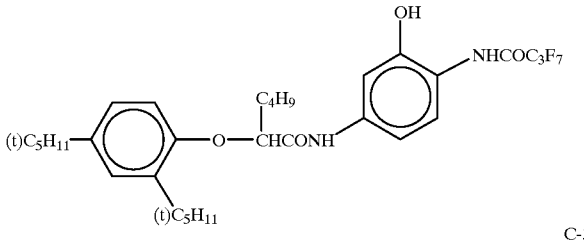

C-2

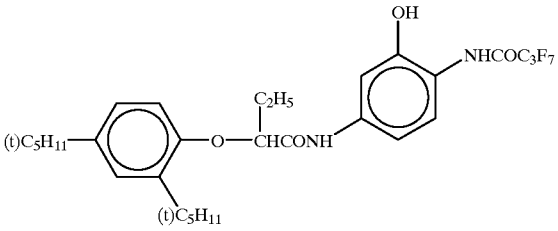

C-3

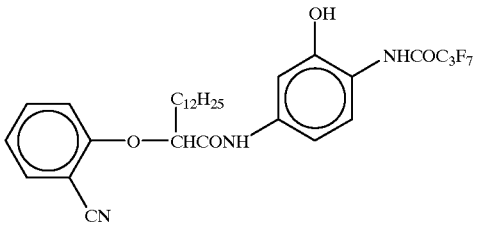

C-4

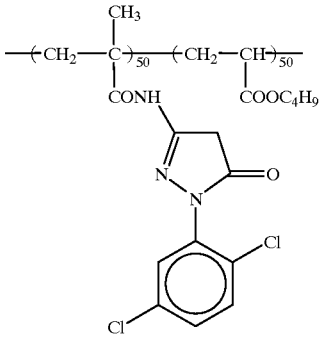

The numbers indicate wt %

Av. mol. wt : about 25, 000

-continued
C-5
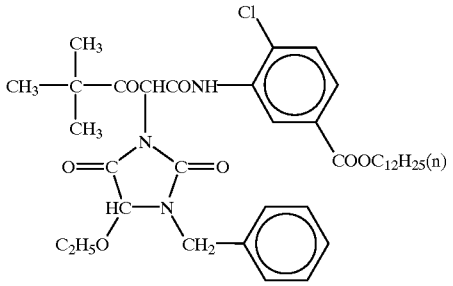
C-6
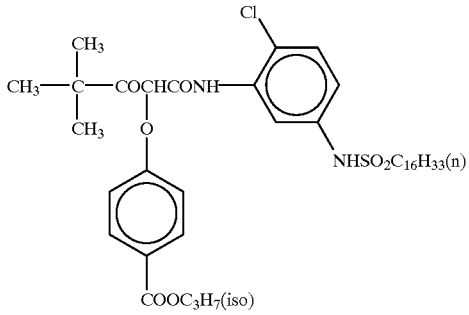
C-7
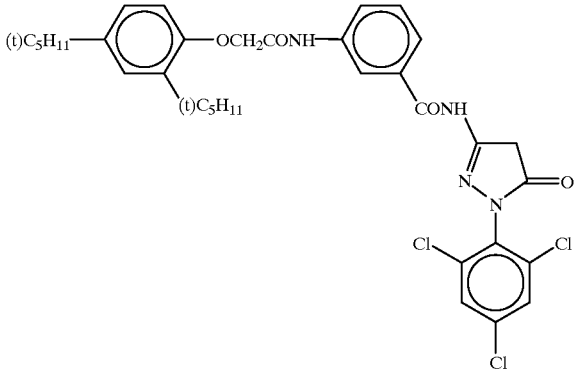
C-8
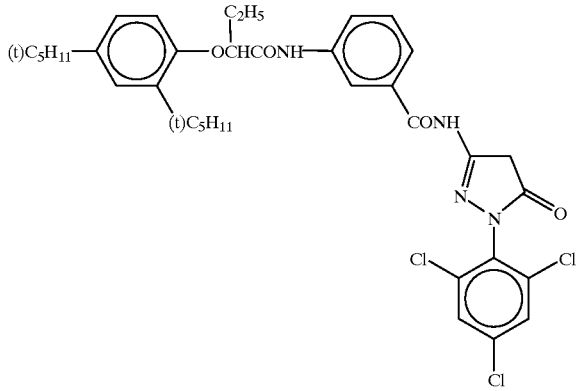
C-9
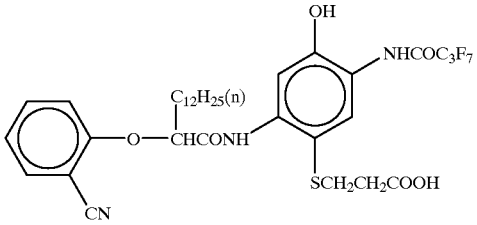
C-10
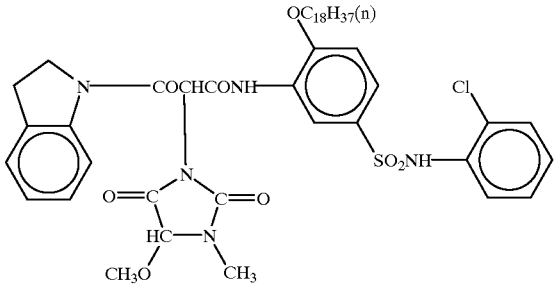
C-11
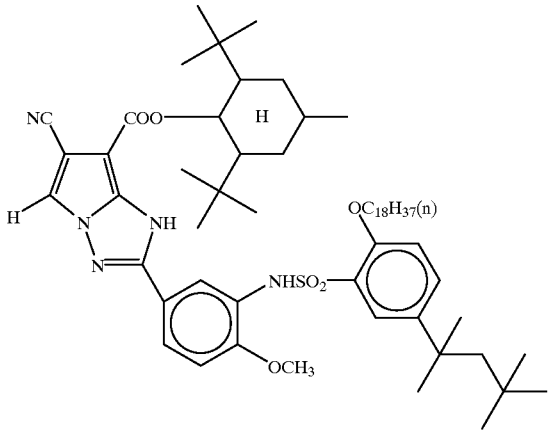
Oil-1
Dibutyl phthalate -continued
Oil-2
Tricresyl phosphate
Oil-3
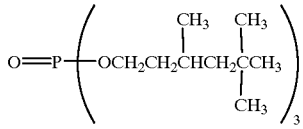
Oil-4
Tricyclohexyl phosphate
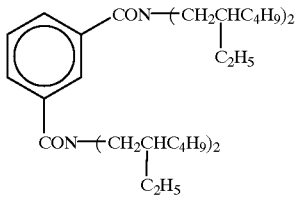
Oil-5
Dicyclohexyl phthalate
Oil-6
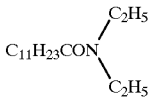
Oil-7
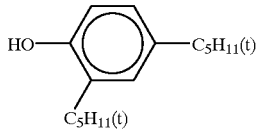
Oil-8
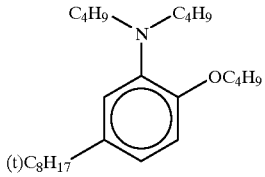
Oil-9
Cpd-A
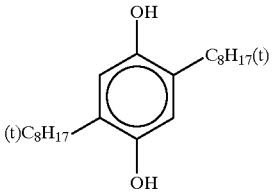
Cpd-B
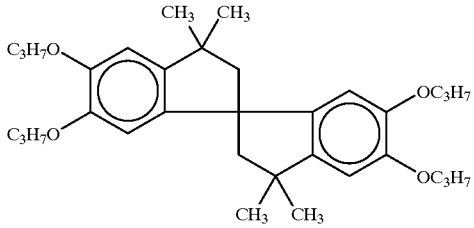
Cpd-C
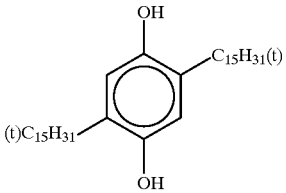
Cpd-D
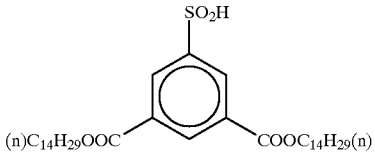
Cpd-E
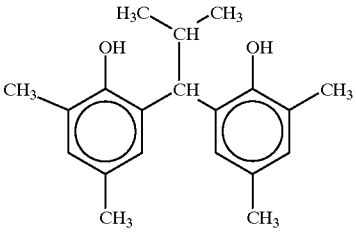
Cpd-G
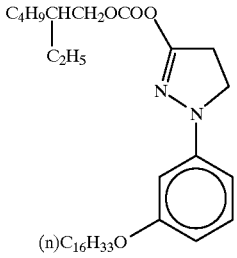
Cpd-F
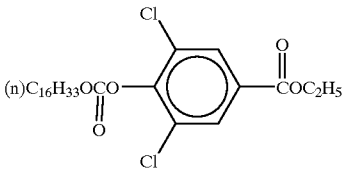
Cpd-H
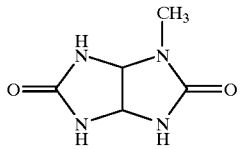

-continued
Cpd-I
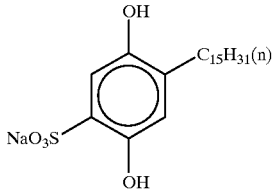
Cpd-J
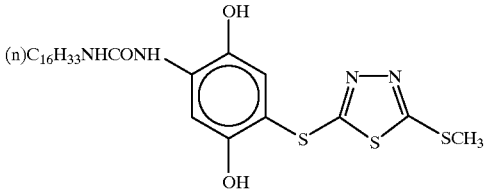
Cpd-K
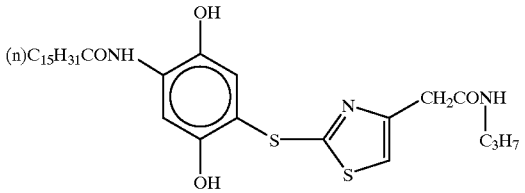
Cpd-L
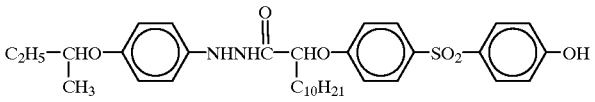
Cpd-M
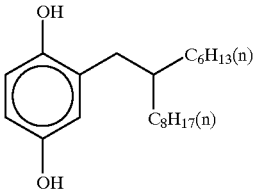
Cpd-N
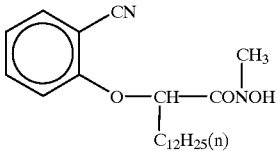
Cpd-O
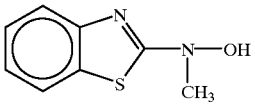
Cpd-P
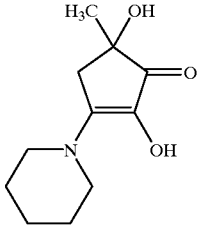
Cpd-Q
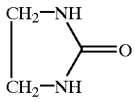
U-1
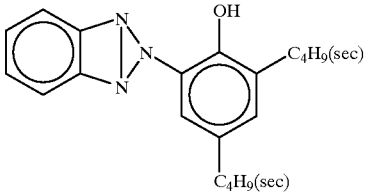
U-2
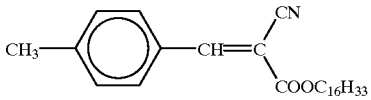
U-3
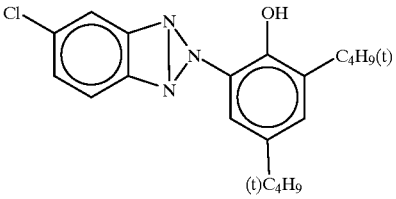
U-4
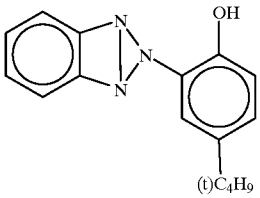
U-5
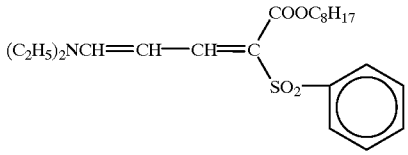

-continued
S-1
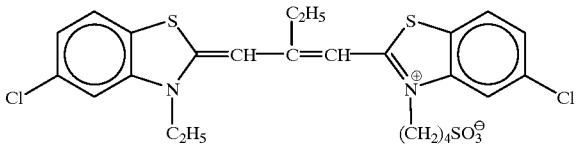
S-2
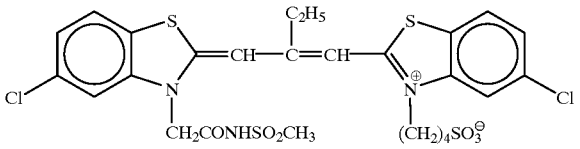
S-3
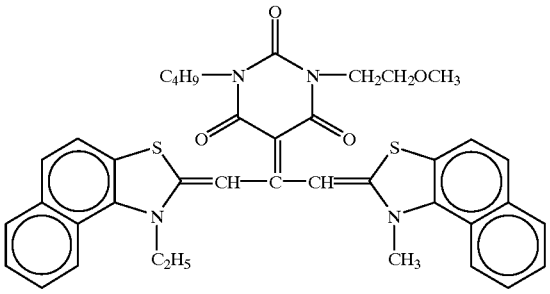
S-4
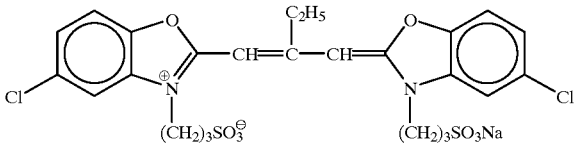
S-5
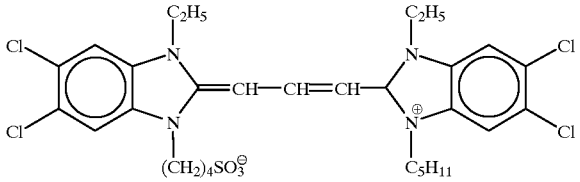
S-6
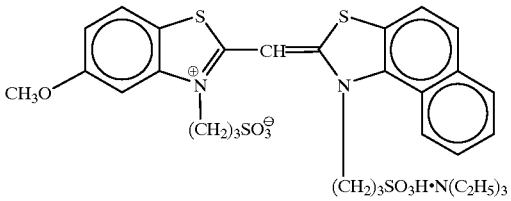
S-7
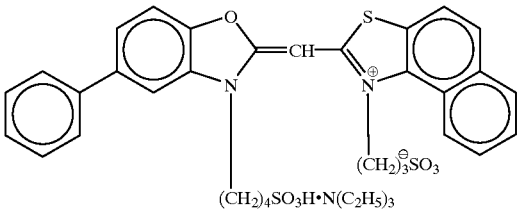
S-8
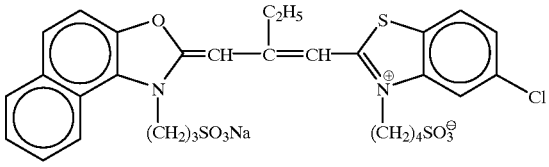
S-9
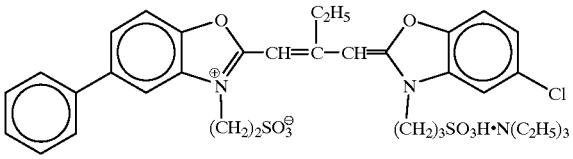
S-10
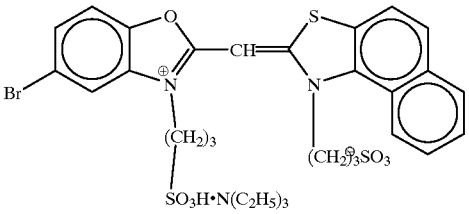
S-11
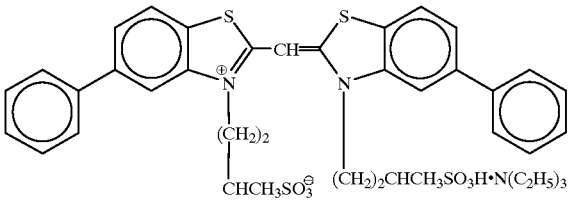
S-12
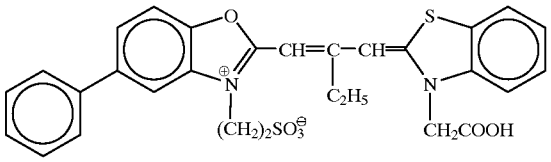

-continued
S-13
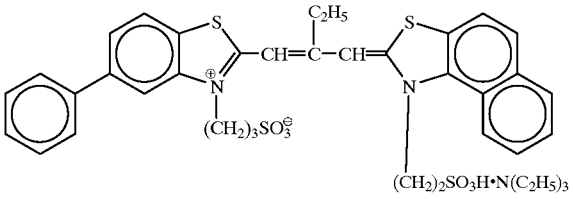
D-1
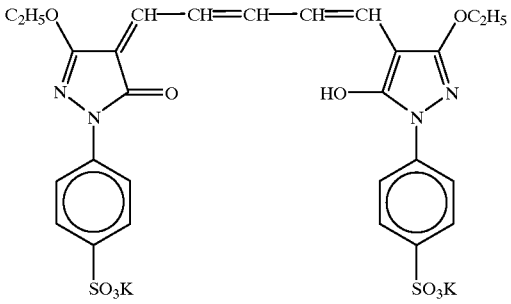
D-2
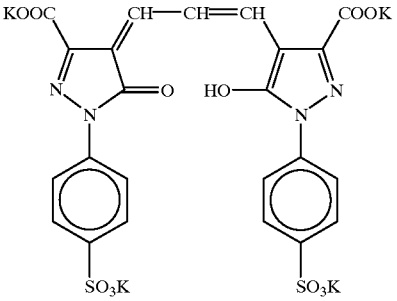
D-3
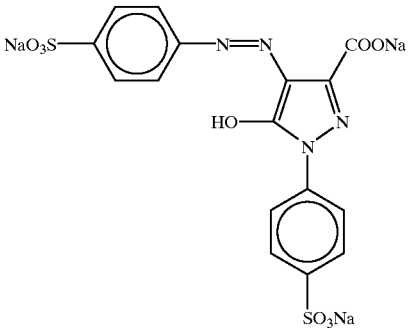
D-4
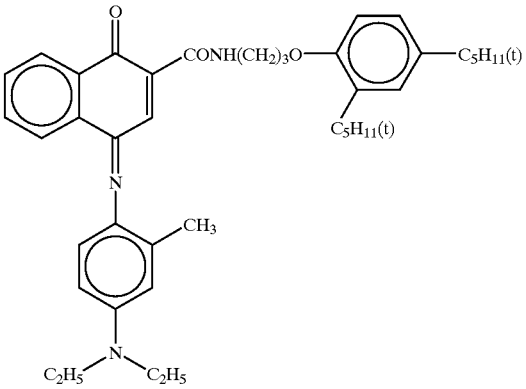
D-5
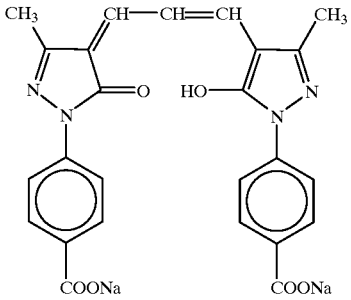
D-6
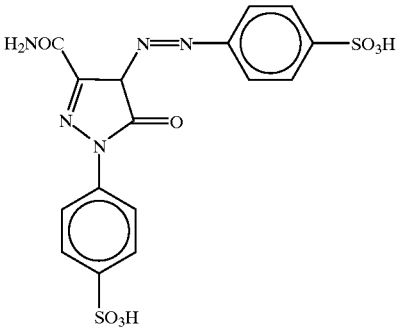
D-7
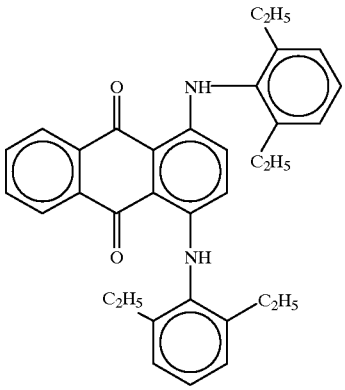

-continued
D-8
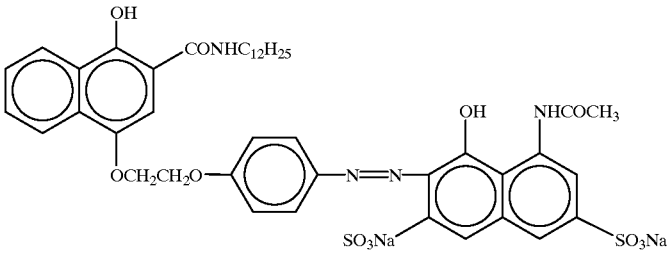
E-1
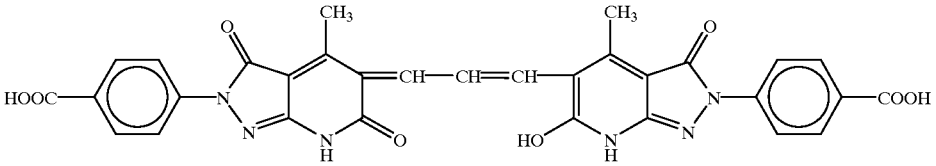
E-2
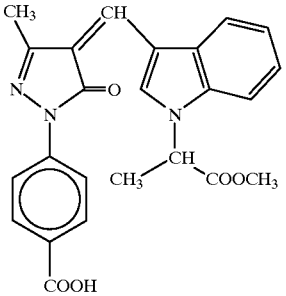
E-3
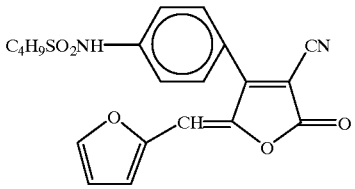
H-1
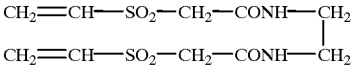
W-1
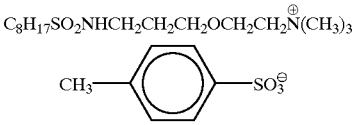
W-2
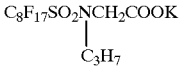
W-3
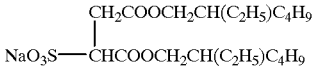
W-4
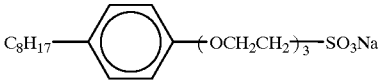
W-5
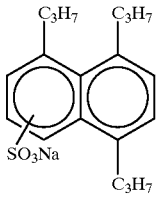
W-6
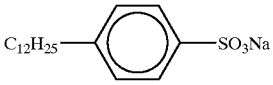
W-7
$C_8F_{17}SO_3Li$
P-1
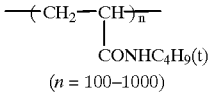
($n$ = 100–1000)
SO-1
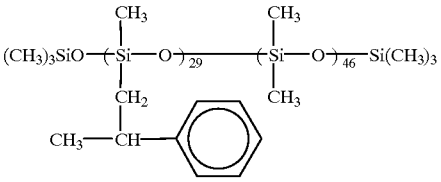

-continued

F-1

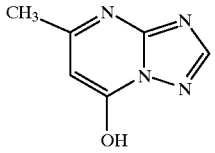

F-2

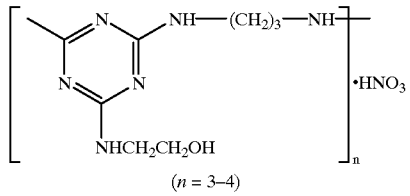

F-3

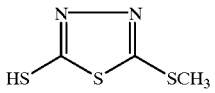

F-4

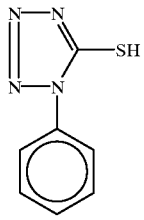

F-5

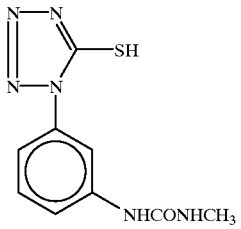

F-6

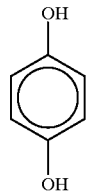

F-7

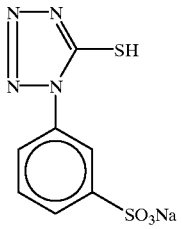

F-8

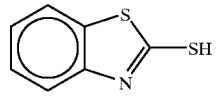

F-9

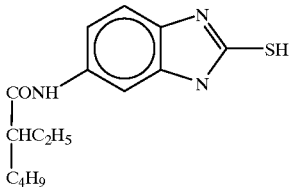

F-10

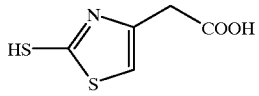

Preparation of dispersion of Organic Solid Disperse Dye

The dye E-1 was dispersed by the following method. That is, water and 200 g of Pluronic F88 (ethylene oxide-propylene oxide block copolymer) manufactured by BASF CORP. were added to 1,430 g of a dye wet cake containing 30% of methanol, and the resultant material was stirred to form a slurry having a dye concentration of 6%. Next, Ultra Visco Mill (UVM-2) manufactured by Imex K.K. was filled with 1,700 mL of zirconia beads with an average grain size of 0.5 mm, and the slurry was milled through UVM-2 at a peripheral speed of approximately 10 m/sec and a discharge rate of 0.5 L/min for 8 hr. The beads were filtered away, and water was added to dilute the material to a dye concentration of 3%. After that, the material was heated to 90° C. for 10 hr for a stabilization purpose. After that, the average grain size of the obtained fine dye grains was 0.60 μm. The grain size distribution (grain size standard deviation×100/average grain size) was 18%.

Following the same procedure as above, solid dispersions of the dyes E-2 and E-3 were obtained. The average grain sizes were found to be 0.54 and 0.56 μm, respectively.

Samples 102 to 145 were prepared following the same procedures as for the sample 101, except that the couplers 4, 7, and 8 in the 9th, 10th, and 11th layers were changed as shown in Table 3. Note that in replacing with a pyrazolotriazole coupler, the coupler amount in each layer was replaced such that the magenta color densities in 9th to 11th layers of each of the samples 102 to 145 were equal to the magenta densities of 9th to 11th layers of the sample 101, respectively, when the following processing (development A) is performed. The ratios of each pyrazolotriazole coupler to be used were obtained by previously separately forming another sample. Note also that the high-boiling organic solvent Oil-2 was added at weight ratio to the coupler of 0.7, unless otherwise indicated in the parenthesis in Table 3 below.

Comparative coupler (A)
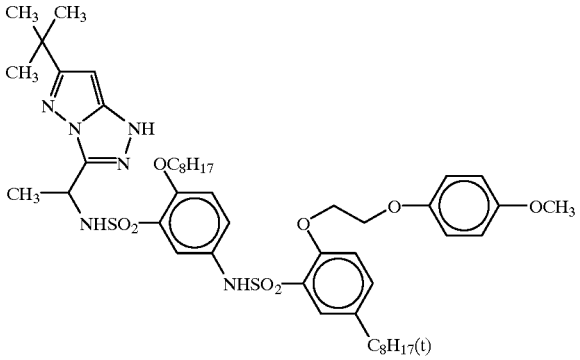
Compound described in JP-A-5-100382
(US 5,272,049)
Comparative coupler (B)
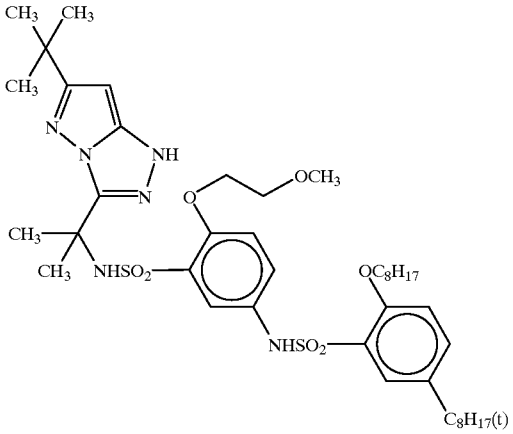
Compound described in JP-A-5-100382
(US 5,272,049)
Comparative coupler (C)
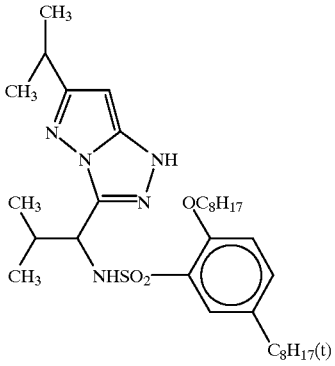
Compound described in JP-A-100382
(US 5,272,049)
-continued
Comparative coupler (D)
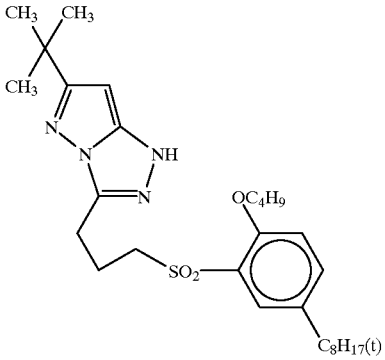
Compound described in JP-A-5-100382,
(US 5,272,049) and
Compound described in JP-A-63-153548
(US 4,994,351)
Comparative coupler (E)
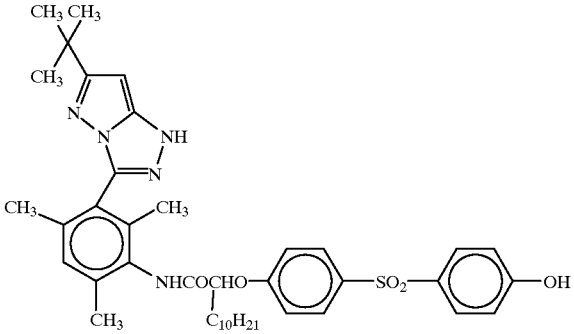
Compound described in JP-A-5-100382
(US 5,272,049)
Comparative coupler (F)
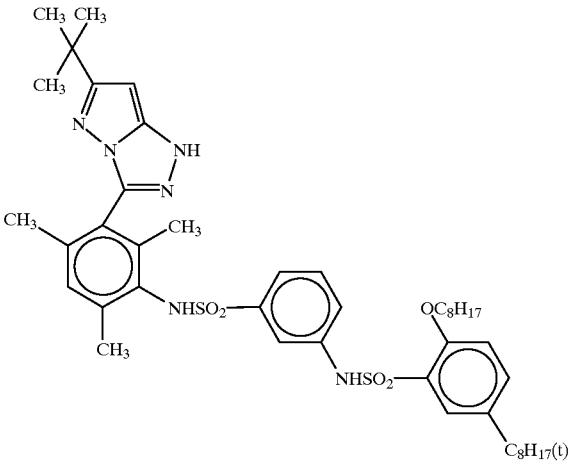
Compound described in JP-A-5-100382
(US 5,272,049)

-continued
Comparative coupler (G)
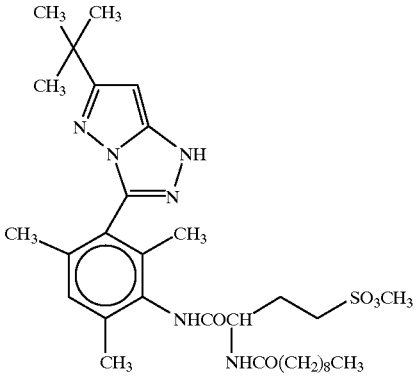
Compound described in JP-A-5-100382
(US 5,272,049)
Comparative coupler (H)
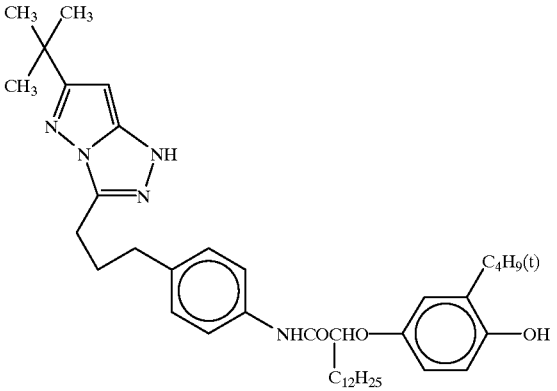
Compound described in JP-A-63-153548
(US 4,994,351)
Comparative coupler (I)
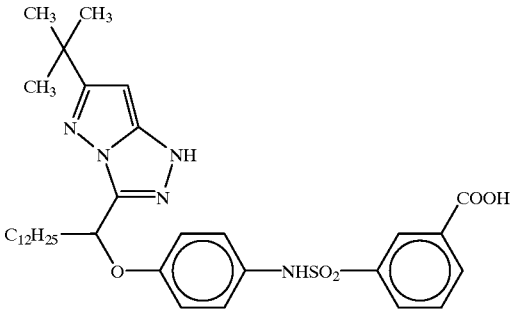
Compound described in JP-A-4-163548
-continued
Comparative coupler (J)
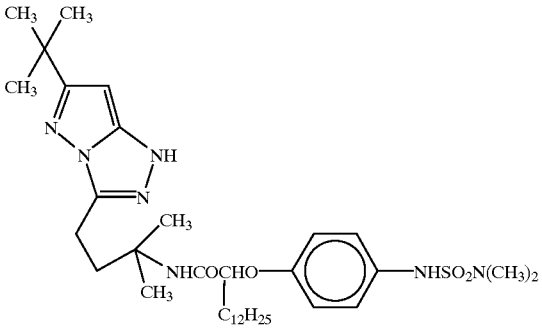
Compound described in JP-A-63-153548
(US 4,994,351)
Comparative coupler (K)
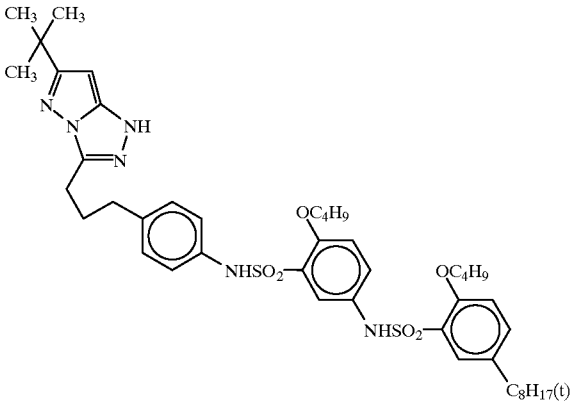
Compound described in JP-A-63-153548
(US 4,994,351)
Comparative coupler (L)
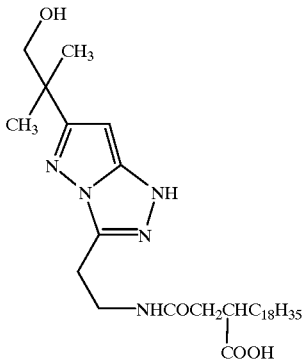
Compound described in JP-A-6-214360
(US 5,368,998)

-continued

Comparative coupler (M)

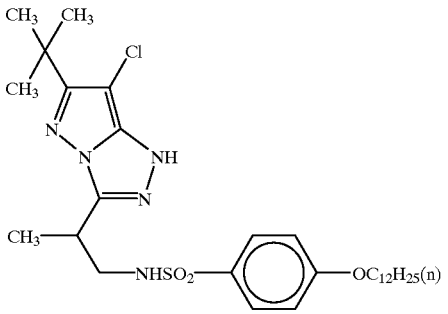

(Two equivalent form of the coupler used in the invention)

Comparative coupler (N)

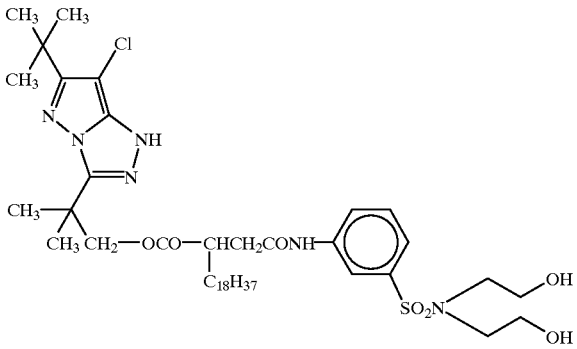

Compound described in JP-A-10-186603

Comparative coupler (O)

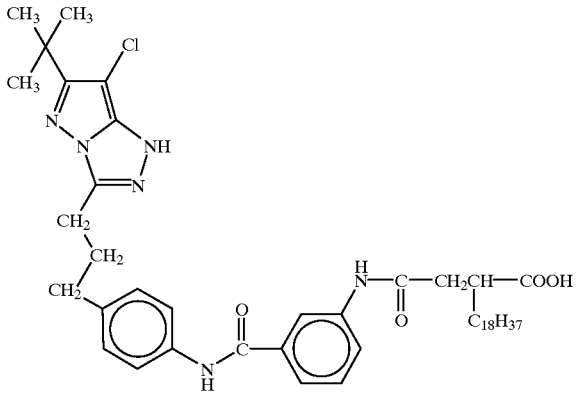

Compound 2 described in DE 36 33 364 C3 (US 4,835,094), provided that the group, —$C_{15}H_{37}$, at the lower right portion of the formula described therein seems to be a misprint, and thus the group was constructed as —$C_{18}H_{37}$, as indicated herein.

-continued

Comparative Coupler (P)

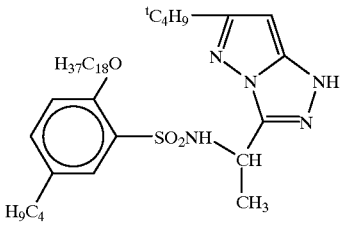

Compound (N-76) described in US 5,272,049

TABLE 3

Contents of Samples

| Sample | | Couplers used in 9th to 11th layers The amount of Oil-2 is 0.7 in weight ratio to the coupler, unless indicated in parentheses | | |
|---|---|---|---|---|
| | | 9th Layer | 10th Layer | 11th Layer |
| 101 | Comp. | | As indicated above | |
| 102 | Comp. | Comparative coupler A | Comparative coupler A | Comparative coupler A |
| 103 | Comp. | Comparative coupler B | Comparative coupler B | Comparative coupler B |
| 104 | Comp. | Comparative coupler C | Comparative coupler C | Comparative coupler C |
| 105 | Comp. | Comparative coupler D | Comparative coupler D | Comparative coupler D |
| 106 | Comp. | Comparative coupler E | Comparative coupler E | Comparative coupler E |
| 107 | Comp. | Comparative coupler F | Comparative coupler F | Comparative coupler F |
| 108 | Comp. | Comparative coupler G | Comparative coupler G | Comparative coupler G |
| 109 | Comp. | Comparative coupler H | Comparative coupler H | Comparative coupler H |
| 110 | Comp. | Comparative coupler I | Comparative coupler I | Comparative coupler I |
| 111 | Comp. | Comparative coupler J | Comparative coupler J | Comparative coupler J |
| 112 | Comp. | Comparative coupler K | Comparative coupler K | Comparative coupler K |
| 113 | Comp. | Comparative coupler L | Comparative coupler L | Comparative coupler L |
| 114 | Comp. | Comparative coupler M | Comparative coupler M | Comparative coupler M |
| 115 | Comp. | Comparative coupler N | Comparative coupler N | Comparative coupler N |
| 116 | Comp. | Comparative coupler O | Comparative coupler O | Comparative coupler O |
| 117 | Comp. | Comparative coupler P | Comparative coupler P | Comparative coupler P |
| 118 | Inv. | M-1 | M-1 | M-1 |
| 119 | Inv. | M-10 | M-10 | M-10 |
| 120 | Inv. | M-12 | M-12 | M-12 |
| 121 | Inv. | M-13 | M-13 | M-13 |
| 122 | Inv. | M-20 | M-20 | M-20 |
| 123 | Inv. | M-23 | M-23 | M-23 |
| 124 | Inv. | M-30 | M-30 | M-30 |
| 125 | Inv. | M-31 | M-31 | M-31 |
| 126 | Inv. | M-49 | M-49 | M-49 |
| 127 | Inv. | M-51 | M-51 | M-51 |
| 128 | Inv. | M-55 | M-55 | M-55 |
| 129 | Inv. | M-62 | M-62 | M-62 |
| 130 | Inv. | M-65 | M-65 | M-65 |
| 131 | Inv. | M-67 | M-67 | M-67 |
| 132 | Inv. | M-30(0.3) | M-63(0.3) | M-63(0.1) |
| 133 | Inv. | M-1(0.4) | M-65(0.2) | M-65(0.3) |
| 134 | Inv. | M-1(0.4) | M-19(0.2) | Same as sample 101 |
| 135 | Inv. | M-1(0.4) | M-63(0.3) | M-63(0.3) |

TABLE 3-continued

| Sample | | Contents of Samples: Couplers used in 9th to 11th layers The amount of Oil-2 is 0.7 in weight ratio to the coupler, unless indicated in parentheses | | |
|---|---|---|---|---|
| | | 9th Layer | 10th Layer | 11th Layer |
| 136 | Inv. | M-30(0.3) | M-65(0.1) | M-65(0.1) |
| 137 | Inv. | M-14(0.2) | M-14(0.2) | Comparative coupler M |
| 138 | Inv. | M-109(0.1) | M-109(0.1) | M-109(0.1) |
| 139 | Inv. | M-109(0) | M-109(0) | M-109(0) |
| 140 | Inv. | M-125(0.1) | M-125(0.1) | M-125(0.1) |
| 141 | Inv. | M-75(0.1) | M-75(0) | M-75(0) |
| 142 | Inv. | M-92(0.4) | M-92(0.4) | M-92(0.5) |
| 143 | Inv. | M-150(0.2) | M-150(0.2) | M-150(0.2) |
| 144 | Inv. | M-109(0.1) | A mixture of M-109 (0.1) and C-7 in a ratio of 7:3 | A mixture of M-109 (0.1) and C-7 in a ratio of 7:3 |
| 145 | Inv. | M-109(0) | M-109(0) | C-4 |

The following development was performed in this example. In this processing, 60% of each of FUJICHROME RVP and FUJICHROME RAP both of which are manufactured by Fuji Photo Film Co. Ltd., and ECTACHROME EPR and ECTACHROME E100S, both of which are manufactured by Eastman Kodak Company and the samples 101 and 119 were completely exposed to white light, and the resultant materials were processed at a ratio of 1:3:2:1:1:2 until the replenishment amount was five times the tank volume, thereby providing the processing solutions for the samples to be tested. This processing is called "development A".

| Processing Step | Time | Temperature | Tank volume | Replenishment rate |
|---|---|---|---|---|
| 1st development | 6 min | 38° C. | 12 L | 2,200 mL/m$^2$ |
| 1st washing | 2 min | 38° C. | 4 L | 7,500 mL/m$^2$ |
| Reversal | 2 min | 38° C. | 4 L | 1,100 mL/m$^2$ |
| Color development | 6 min | 38° C. | 12 L | 2,200 mL/m$^2$ |
| Pre-bleaching | 2 min | 38° C. | 4 L | 1,100 mL/m$^2$ |
| Bleaching | 6 min | 38° C. | 12 L | 220 mL/m$^2$ |
| Fixing | 4 min | 38° C. | 8 L | 1,100 mL/m$^2$ |
| 2nd washing | 4 min | 38° C. | 8 L | 7,500 mL/m$^2$ |
| Final rinsing | 1 min | 25° C. | 2 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid. pentasodium salt | 1.5 g | 1.5 g |
| Diethylenetriamine pentaacetic acid. pentasodium salt | 2.0 g | 2.0 g |
| Sodium sulfite | 30 g | 30 g |
| Hydroquinone.potassium Monosulfonate | 20 g | 20 g |
| Potassium carbonate | 15 g | 20 g |
| Sodium bicarbonate | 12 g | 15 g |

-continued

| <1st developer> | <Tank solution> | <Replenisher> |
|---|---|---|
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjust by sulfuric acid or potassium hydroxide.

| <Reversal solution> | <Tank solution> | <Replenisher> |
|---|---|---|
| Nitrilo-N,N,N-trimethylene phosphonic acid. pentasodium salt | 3.0 g | the same as tank solution |
| Stannous chloride dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjust by acetic acid or sodium hydroxide.

| <Color developer> | <Tank solution> | <Replenisher> |
|---|---|---|
| Nitrilo-N,N,N-trimethylene phosphonic acid. pentasodium salt | 2.0 g | 2.0 g |
| Sodium sulfite | 7.0 g | 7.0 g |
| Trisodium phosphate. Dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfon amidoethyl)-3-methyl-4 aminoaniline.3/2 sulfuric acid.monohydrate | 11 g | 11 g |
| 3,6-dithiaoctane-1,8-diol | 1.0 g | 1.0 g |
| Water to make | 1,000 mL | 1,000 mL |
| pH | 11.80 | 12.00 |

The pH was adjust by sulfuric acid or potassium hydroxide.

| <Pre-bleaching solution> | <Tank solution> | <Replenisher> |
|---|---|---|
| Ethylenediaminetetraacetic acid.disodium salt. dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjust by nitric acid or sodium hydroxide.

| <Bleaching solution> | <Tank solution> | <Replenisher> |
|---|---|---|
| Ethylenediaminetetraacetic acid.disodium salt. dihydrate | 2.0 g | 4.0 g |
| Ethylenediaminetetraacetic acid.Fe(III).ammonium. dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjust by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjust by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

Evaluation of Samples

Evaluation of Image Storage Characteristics

A set of the samples 101 to 145 were exposed to white light at a color temperature of 4,800 K through a wedge having continuously changing density and subjected to the above development. After the densities of these processed samples were measured, the samples were stored at a temperature of 60° C. and a humidity of 70% for seven days, and their densities were again measured. Table 4 shows a rise in yellow density in a white portion as evaluation of the image storage characteristics.

Evaluation of Dependence on Processing

Another two sets of the samples 101 to 145 exposed as described above were provided. One set of the samples were subjected to a developing step, i.e., "development B", which was the same development as above except for the replenishment rate of the color developer was 1.6 L. The other set of the samples were subjected to a developing step i.e., "development C", which was the same development as above except for the replenishment rate of the color developer was 1.1 L. The densities of the processed samples were measured. Table 6 shows the difference between the maximum magenta density in "development A" and the magenta density in "development B", and the difference between the maximum magenta density in "development A" and "development C". In a direction in which the densities in "development B" and "development C" increase with respect to the density in "development A" is indicated by a positive value. The closer the value to 0, the less the influence on processing variations, and the more preferable the result.

Evaluation of Raw Stock Storability

Another two sets of the samples 101 to 145 were 1 prepared. One set thereof was stored at a temperature of 50° C. and a humidity of 70% for seven days. The other set was stored in a freezer for the same period. The thus stored sets of samples were exposed to light together. After these processed samples were subjected to "development A" described above, their densities were measured.

Table 4 below shows a sensitivity difference, at a point which gives magenta density of 1.0, between a sample stored in a freezer and a sample stored at 50° C–60%.

TABLE 4

Results of evaluation

| Samples | | * Image preservability | Dependency on processing conditions ** Development B | Dependency on processing conditions ** Development C | *** Raw stock preservability |
|---|---|---|---|---|---|
| 101 | Comp. | 0.05 | −0.10 | −0.15 | −0.12 |
| 102 | Comp. | 0.05 | −0.22 | −0.32 | −0.20 |
| 103 | Comp. | 0.05 | −0.25 | −0.35 | −0.20 |
| 104 | Comp. | 0.15 | −0.17 | −0.25 | −0.10 |
| 105 | Comp. | 0.07 | −0.23 | −0.33 | −0.18 |
| 106 | Comp. | 0.06 | −0.27 | −0.36 | −0.20 |
| 107 | Comp. | 0.07 | −0.27 | −0.36 | −0.20 |
| 108 | Comp. | 0.06 | −0.20 | −0.30 | −0.18 |
| 109 | Comp. | 0.07 | −0.20 | −0.34 | −0.16 |
| 110 | Comp. | 0.08 | −0.18 | −0.28 | −0.28 |
| 111 | Comp. | 0.07 | −0.30 | −0.43 | −0.24 |
| 112 | Comp. | 0.07 | −0.26 | −0.38 | −0.24 |
| 113 | Comp. | 0.08 | −0.28 | −0.40 | −0.26 |
| 114 | Comp. | 0.06 | −0.17 | −0.26 | −0.30 |
| 115 | Comp. | 0.06 | −0.15 | −0.24 | −0.22 |
| 116 | Comp. | 0.06 | −0.16 | −0.26 | −0.26 |
| 117 | Comp. | 0.05 | −0.25 | −0.33 | −0.21 |
| 118 | Inv. | 0.02 | −0.05 | −0.08 | −0.05 |
| 119 | Inv. | 0.02 | −0.05 | −0.07 | −0.05 |
| 120 | Inv. | 0.02 | −0.03 | −0.05 | −0.04 |
| 121 | Inv. | 0.02 | −0.04 | −0.06 | −0.04 |
| 122 | Inv. | 0.02 | −0.03 | −0.0S | −0.05 |
| 123 | Inv. | 0.02 | −0.07 | −0.09 | −0.06 |
| 124 | Inv. | 0.02 | −0.04 | −0.06 | −0.03 |
| 125 | Inv. | 0.02 | −0.02 | −0.03 | −0.03 |
| 126 | Inv. | 0.03 | −0.03 | −0.05 | −0.05 |
| 127 | Inv. | 0.03 | −0.03 | −0.05 | −0.06 |
| 128 | Inv. | 0.03 | −0.03 | −0.05 | −0.04 |
| 129 | Inv. | 0.03 | −0.02 | −0.03 | −0.05 |
| 130 | Inv. | 0.03 | −0.03 | −0.05 | −0.06 |
| 131 | Inv. | 0.03 | −0.03 | −0.05 | −0.04 |
| 132 | Inv. | 0.02 | −0.02 | −0.03 | 0 |
| 133 | Inv. | 0.02 | −0.02 | −0.03 | 0 |
| 134 | Inv. | 0.03 | −0.02 | −0.03 | −0.02 |
| 135 | Inv. | 0.02 | −0.02 | −0.03 | −0.03 |
| 136 | Inv. | 0.02 | −0.02 | −0.03 | −0.03 |
| 137 | Inv. | 0.02 | −0.03 | −0.05 | −0.05 |
| 138 | Inv. | 0.02 | −0.02 | −0.03 | 0 |
| 139 | Inv. | 0.02 | −0.02 | −0.03 | 0 |
| 140 | Inv. | 0.02 | −0.03 | −0.03 | 0 |
| 141 | Inv. | 0.03 | −0.02 | −0.03 | −0.02 |
| 142 | Inv. | 0.02 | −0.02 | −0.03 | −0.03 |
| 143 | Inv. | 0.02 | −0.03 | −0.03 | −0.03 |

TABLE 4-continued

| Samples | | Results of evaluation: * Image preservability | Dependency on processing conditions ** Development B | Dependency on processing conditions ** Development C | *** Raw stock preservability |
|---|---|---|---|---|---|
| 144 | Inv. | 0.03 | −0.02 | −0.03 | 0 |
| 145 | Inv. | 0.02 | −0.03 | −0.03 | −0.02 |

* Image preservability is evaluated by increment of yellow coloration at white background.
** Dependency on processing conditions is evaluated by change in magenta maximum density.
*** Raw stock preservability is evaluated by change in sensitivity at the portion giving magenta density of 1.0.

Compared to the sample 101 using a pyrazolone magenta coupler, the sample 104 using a comparative coupler C in which the 6-position of pyrazolotriazole was not a tertiary alkyl group was unpreferable because yellow coloring in a white portion when an image was stored was large. In contrast, deterioration of yellow coloring was little in each of the samples 102, 103, and 105 to 117 using comparative couplers in which the 6-position was tertiary alkyl.

When, however, the replenishment rate of the color developer was reduced in, e.g., the sample 102, the density greatly changed, and the sensitivity lowered in the row stock storability test.

By contrast, in the sample 118 of the present invention, for example, the yellow coloring greatly improved, and the raw stock storability also improved even when the replenishment rate of the color developer was reduced. For comparison, the coupler M-1 of the present invention used in the sample 118 was replaced with a comparative coupler M which was a chlorine atom split-off 2-equivalent coupler (sample 114). As a consequence, the yellow coloring, process dependence, and raw stock storability deteriorated.

That is, the 4-equivalent coupler used in the present invention caused less yellow coloring than that of its corresponding 2-equivalent coupler. Also, compared to a known similar tertiary alkyl-substituted pyrazolo-[5,1-c]-1,2,4-triazole coupler, this 4-equivalent coupler changed its characteristics little and had high raw stock storability even when the replenishment rate of the color developer was reduced. This is surprising and unexpectable from the prior art.

EXAMPLE 2

Samples 201 to 299 were formed by using 1:1 mixtures of one of compounds SOL-1 to SOL-10 and SOL-12 to SOL-100 shown below and the high-boiling solvent Oil-2 instead of the high-boiling organic solvent Oil-1 in the sample 101 in Example-1. Also, samples 301 to 399 were similarly formed from the sample 138.

These samples 201 to 299 and Samples 301 to 399 were exposed and processed by "development A" described above. Consequently, as described in Example-1, the samples 301 to 399 caused less yellow coloring with time than in the samples 201 to 299, so the results were preferable.

SOL-1

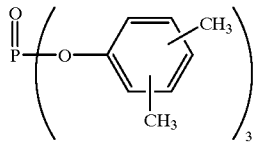

SOL-2

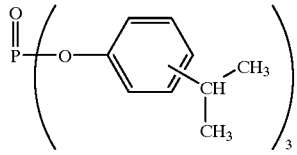

SOL-3

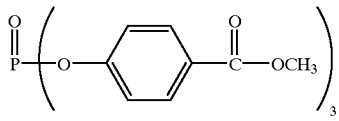

SOL-4

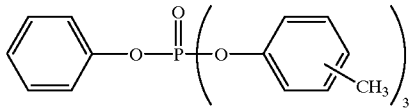

SOL-5

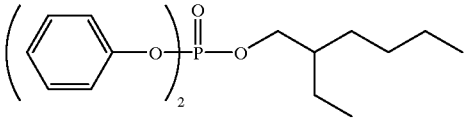

SOL-6

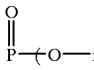

SOL-7

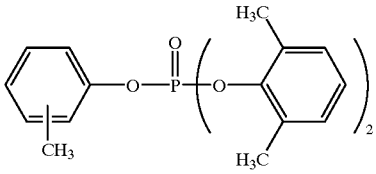

SOL-8

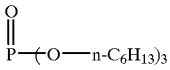

SOL-9

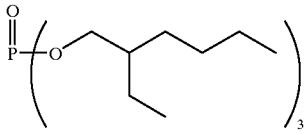

SOL-10

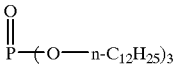

SOL-12

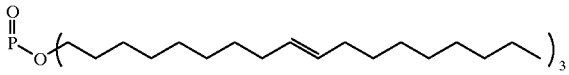

SOL-13

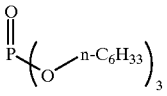

-continued
SOL-14
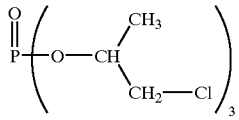
SOL-15
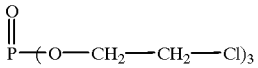
SOL-16
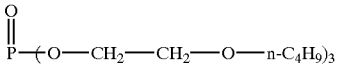
SOL-17
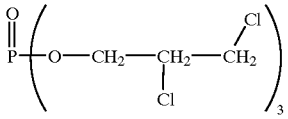
SOL-18
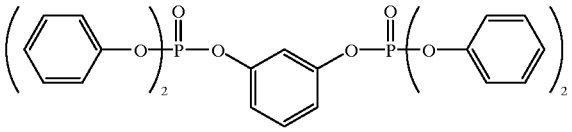
SOL-19
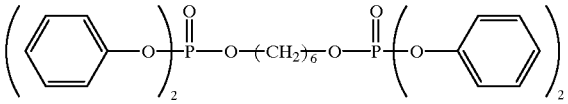
SOL-20
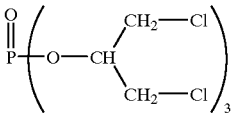
SOL-21
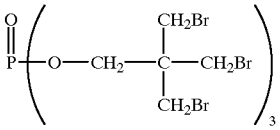
SOL-22
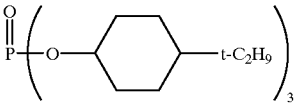
SOL-23
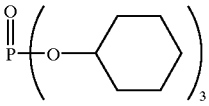
SOL-24
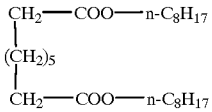
SOL-25
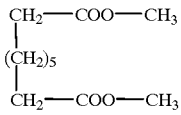
-continued
SOL-26
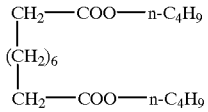
SOL-27
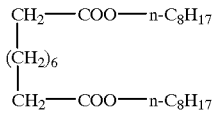
SOL-28
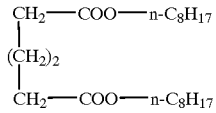
SOL-29
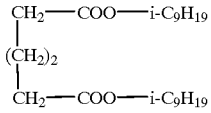
SOL-30
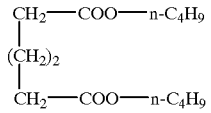
SOL-31
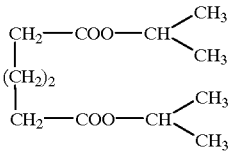
SOL-32
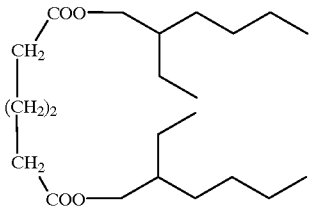
SOL-33
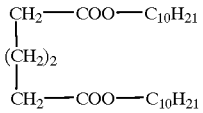
SOL-34
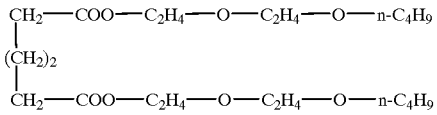
SOL-35
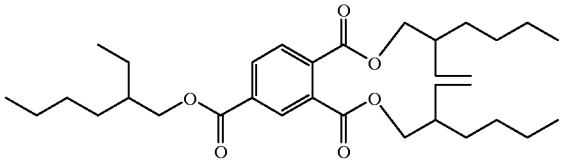

-continued
SOL-36
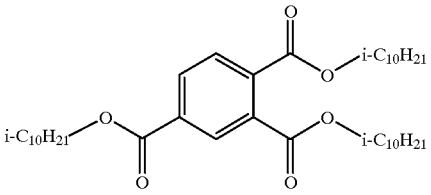
SOL-37
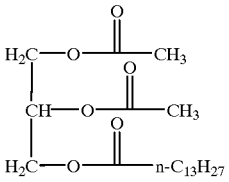
SOL-38
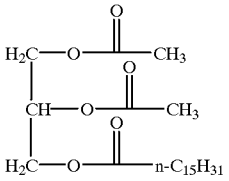
SOL-39
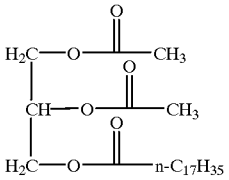
SOL-40
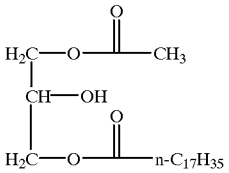
SOL-41
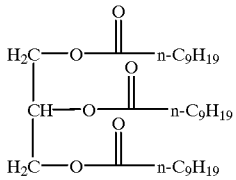
SOL-42
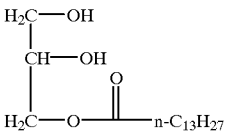
SOL-43
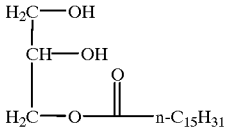
SOL-44
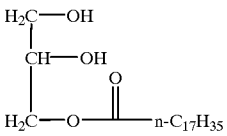
-continued
SOL-45
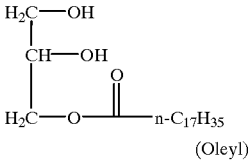
SOL-46
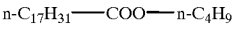
SOL-47
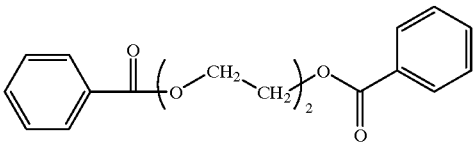
SOL-48
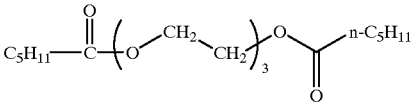
SOL-49
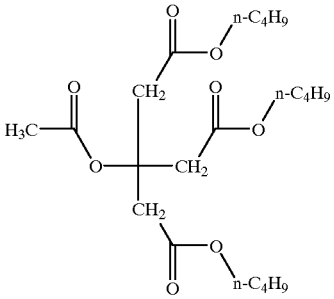
SOL-50
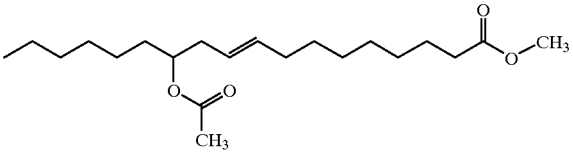
SOL-51
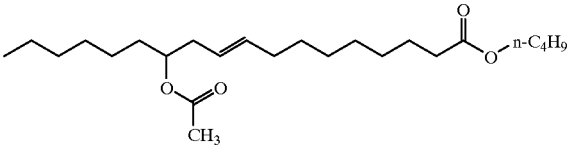
SOL-52
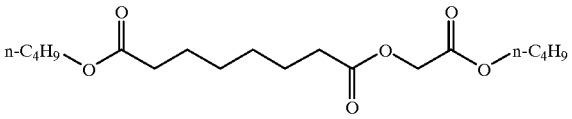
SOL-53
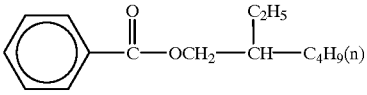
SOL-54
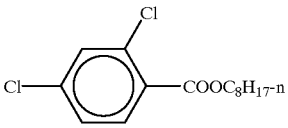

-continued
SOL-55
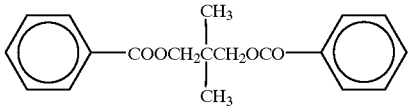
SOL-56
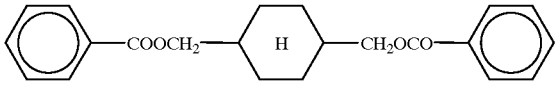
SOL-57
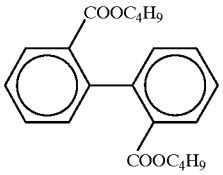
SOL-58
$n\text{-}C_{15}H_{31}COOC_{16}H_{33}\text{-}n$
SOL-59
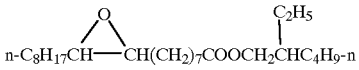
SOL-60
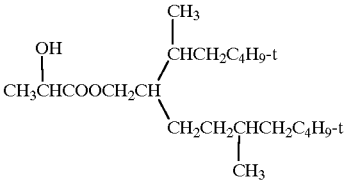
SOL-61
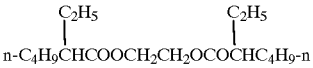
SOL-62
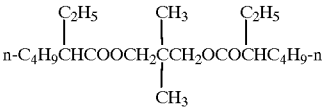
SOL-63
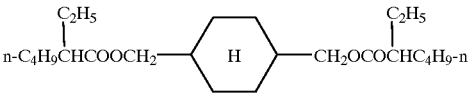
SOL-64
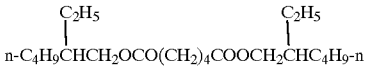
SOL-65
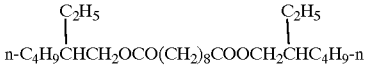
SOL-66
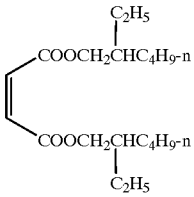
-continued
SOL-67
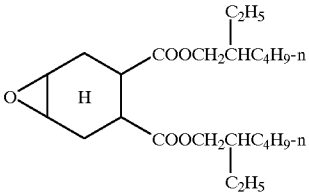
SOL-68
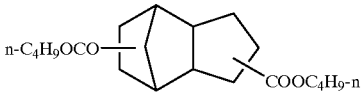
SOL-69
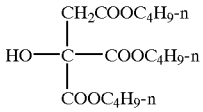
SOL-70
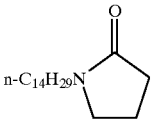
SOL-71
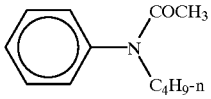
SOL-72
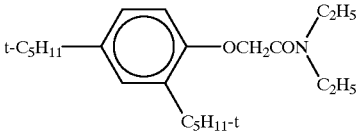
SOL-73
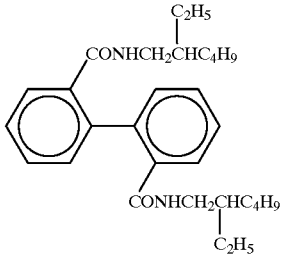
SOL-74
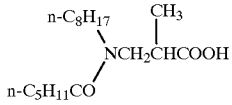
SOL-75
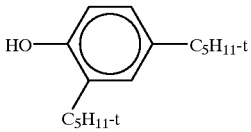
SOL-76
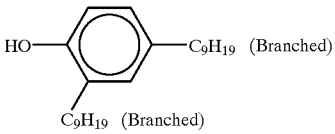

-continued

SOL-77

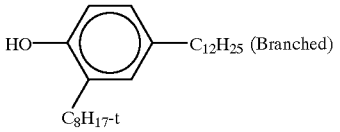

SOL-78

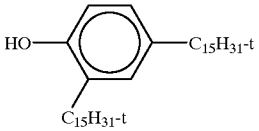

SOL-79

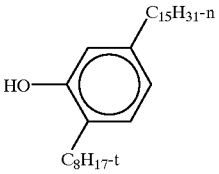

SOL-80

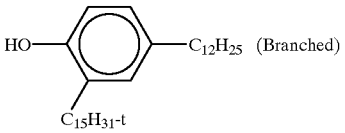

SOL-81

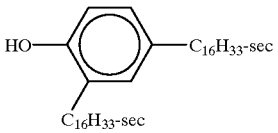

SOL-82

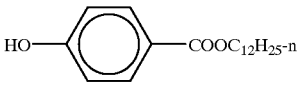

SOL-83

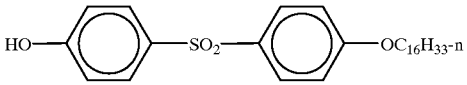

SOL-84

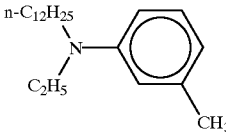

SOL-85

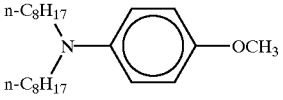

SOL-86

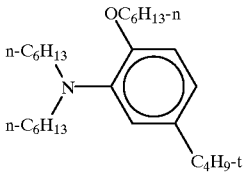

SOL-87

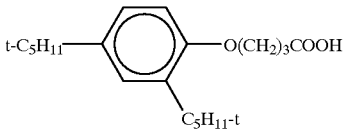

-continued

SOL-88

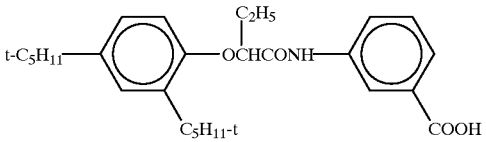

SOL-89

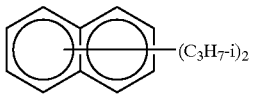

SOL-90

$C_nH_{2n+2}$
(A mixture of n-paraffin
wherein n = 14 and n = 15)

SOL-91

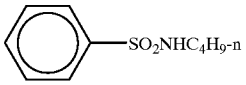

SOL-92

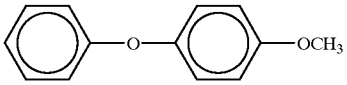

SOL-93

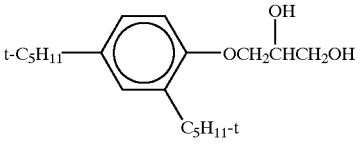

SOL-94

Chlorinated paraffin
(Av. composition $C_{14}H_{24}Cl_6$)

SOL-95

Chlorinated paraffin
(Av. composition $C_{12}H_{18}Cl_8$)

SOL-96

Poly (chlorotrifluoroethylene)
(Av. mol. wt. 900)

SOL-97

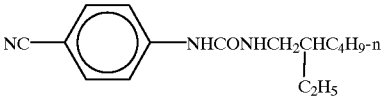

SOL-98

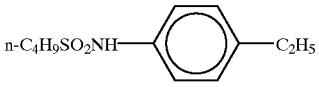

SOL-99

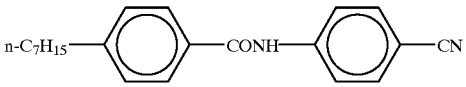

SOL-100

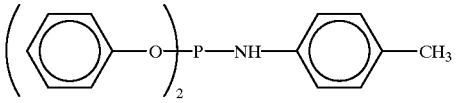

EXAMPLE 3

Two sets of samples 501 to 583 were prepared in the same manner as Sample 118, except that the exemplified coupler M-1 was replaced by the exemplified couplers M-66 to M-147, respectively. The thus prepared samples were exposed to light and one set of the samples was processed with Processing A and the other set of the samples was processed with Processing B to evaluate dependency on the changes in processing conditions.

As a result, Samples 501 to 583 showed excellent resistance to changes in processing conditions.

EXAMPLE 4

Samples 601 to 645 were prepared in the same manner as Samples 101 to 145, respectively, except that 15th to 17th layers were changed to those set forth below, and Emulsions B, C, D, F, H, I, J, K, L, N, O and P were changed to B2, C2, D2, F2, H2, I2, J2, K2, L2, N2, 02 and P2 set forth in Table 5 below, respectively.

| | |
|---|---|
| Emulsion L2 | silver 0.18 g |
| Emulsion M | silver 0.16 g |
| Gelatin | 0.70 g |
| Coupler C-10 | 0.30 g |
| Compound Cpd-I | 0.010 g |
| Compound Cpd-M | 0.010 g |

16th layer (Medium-speed blue-sensitive emulsion layer)

| | |
|---|---|
| Emulsion N2 | silver 0.16 g |
| Emulsion O2 | silver 0.15 g |
| Gelatin | 0.80 g |
| Coupler C-10 | 0.28 g |
| Compound Cpd-N | 2.0 mg |
| Compound Cpd-K | 2.0 mg |
| High-boiling organic solvent Oil-3 | 0.050 g |

17th layer (High-speed blue-sensitive emulsion layer)

| | |
|---|---|
| Emulsion O2 | silver 0.20 g |
| Emulsion P2 | silver 0.25 g |
| Gelatin | 1.20 g |
| Coupler C-10 | 1.00 g |
| High-boiling organic solvent Oil-3 | 0.10 g |
| Compound Cpd-N | 5.0 mg |
| Compound Cpd-Q | 0.20 g |

TABLE 5

The silver iodobromide emulsions used in Example 4.

| Emulsion | Characteristics | Av. equivalent spherical diameter (μm) | COV* of diameter (%) | AgI Content (%) |
|---|---|---|---|---|
| B2 | Monodispersed (100) tabular grains av.as.rt **: 10.0 | 0.25 | 15 | 3.8 |
| C2 | Monodispersed (111) tabular internally-fogged grains av.as.rt **: 12.0 | 0.30 | 15 | 3.8 |
| D2 | Monodispersed (111) tabular grains av.as.rt **: 10.0 | 0.33 | 18 | 4.8 |
| F2 | Monodispersed (111) tabular grains av.as.rt **: 20.0 | 0.50 | 13 | 1.8 |
| H2 | Monodispersed (100) tabular grains av.as.rt **: 10.0 | 0.24 | 12 | 3.5 |
| I2 | Monodispersed (111) tabular grains av.as.rt **: 10.0 | 0.32 | 17 | 3.5 |
| J2 | Monodispersed (111) tabular grains av.as.rt **: 15.0 | 0.45 | 16 | 3.0 |
| K2 | Monodispersed (111) tabular grains av.as.rt **: 20.0 | 0.58 | 13 | 3.3 |
| L2 | Monodispersed (100) tabular grains av.as.rt **: 10.0 | 0.35 | 10 | 4.5 |
| N2 | Monodispersed (111) tabular grains av.as.rt **: 15.0 | 0.48 | 10 | 2.5 |
| O2 | Monodispersed (111) tabular grains av.as.rt **: 20.0 | 0.70 | 9 | 2.0 |
| P2 | Monodispersed (111) tabular grains av.as.rt **: 25.0 | 0.90 | 8 | 1.8 |

*COV: coefficient of variation in distribution
** av.as.rt: average aspect ratio The addition amounts of the sensitizing dyes used for Emulsions B2, C2, D2, F2, H2, I2, J2, K2, L2, N2, O2, and P2 were increased without changing the ratio of the sensitizing dyes, so that the amounts of the sensitizing dyes per surface area of the emulsion grains becomes the same as those of Emulsions B, C, D, F, H, I, J, K, L, N, O, and P, respectively.

Three sets of samples 601 to 645 were prepared and exposed to light. The first set of the samples was processed with Processing A, the second set of the samples was processed with Processing B, and the third set of the samples was processed with Processing C, to evaluate dependency on the changes in processing conditions.

As a result, Samples 618 to 645 showed excellent resistance to changes in processing conditions. Especially, changes in sensitivity and maximum density were small when the samples were processed with the color developers whose pH'ss were different.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photosensitive material comprising at least one blue-sensitive emulsion layer, at least one green-sensitive emulsion layer, and at least one red-sensitive emulsion layer on a support, wherein the material contains a magenta coupler represented by formula (MC-1) below:

(MC-1)

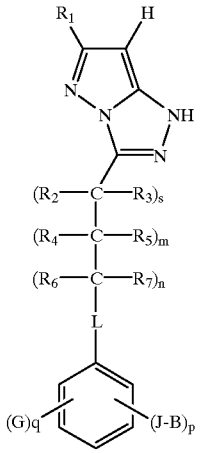

wherein $R_1$ represents a tertiary alkyl group; each of s, m, and n independently represents 0 or 1; each of $R_2$, $R_3$, $R_4$, $R_5$, $R_6$, and $R_7$ represents a hydrogen atom, halogen atom, alkyl group, or aryl group; L represents a divalent group selected from the group consisting of —$NR_8SO_2$—, —$SO_2NR_8$—, —$SO_2NR_8CO$—, —$NR_8COO$—, —$NR_8CONR_9$—, and —COO—, wherein the right side of each formula bonds to the phenyl group in formula (MC-1); each of $R_8$ and $R_9$ represents a hydrogen atom, alkyl group, or aryl group; J represents a divalent group selected from the group consisting of —CO—, —COO—, —O—, —S—, —$CONR_{10}$—, —$NR_{10}CO$—, —$NR_{10}COO$—, —$NR_{10}NR_{11}$—, —$SO_2$—, —$SO_2NR_{10}$—, and —$CONR_{10}SO_2$—, wherein the left side of each formula bonds to the phenyl group in formula (MC-1); each of $R_{10}$ and $R_{11}$ represents a hydrogen atom, alkyl group, or aryl group; B represents an alkyl group having the total number of carbon atoms of 1 to 70 or an aryl group having the total number of carbon atoms of 6 to 70; p represents an integer from 1 to 5, a plurality of —J—B's being able to be the same or different when p is 2 or more; G represents a group selected from the group consisting of an alkyl group, aryl group, halogen atom, and alkoxy group; and q represents an integer from 0 to 4, a plurality of G's being able to be the same or different when q is 2 or more, provided that the following magenta coupler is excluded:

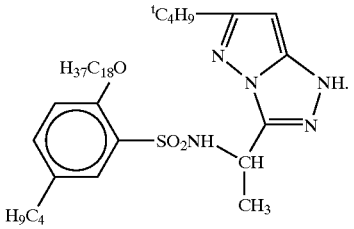

2. The silver halide color photosensitive material according to claim 1, wherein when L is —$NR_8SO_2$— and J is —O—, B represents a substituted alkyl group or an aryl group having the total number of carbon atoms of 6 to 70.

3. The silver halide color photosensitive material according to claim 2, wherein $R_1$ represents a tertiary alkyl group not containing any elements except for a hydrogen atom and a carbon atom; s represents 1; m represents 1 or 0; n represents 0; each of $R_2$, $R_3$, $R_4$, $R_5$, $R_6$ and $R_7$ independently represents a hydrogen atom, halogen atom, alkyl group, or aryl group, provided that at least one of $R_2$ and $R_3$ represents an alkyl group containing 4 or less carbon atoms, and at least one of $R_4$ and $R_5$ represents a hydrogen atom, when m is 1; L represents a group selected from —$NHSO_2$—, —$SO_2NH$—, and —$SO_2NHCO$—; J represents a group selected from —O—, —COO—, —CONH—, —NHCO—, —NHCONH—, —$SO_2NH$—, and —$CONHSO_2$—; B represents a group having the total number of carbon atoms of 6 to 30; p represents 1 or 2; G represents a tertiary alkyl group; and q represents 1, provided that when L is —$NR_8SO_2$— and J is —O—, B represents a substituted alkyl group or an aryl group having the total number of carbon atoms of 6 to 70.

4. The silver halide color photosensitive material according to claim 2, wherein —J—B is substituted by a group selected from —$CR_{12}OH$—, —$SO_2NH_2$, —$SO_2NHCOR_{13}$, —$CONH_2$ and —COOH, wherein each of $R_{12}$ and $R_{13}$ represents a substituted or nonsubstituted alkyl group or substituted or nonsubstituted aryl group.

5. The silver halide color photosensitive material according to claim 1, wherein the magenta coupler represented by formula (MC-1) is represented by formula (MC-3) below:

(MC-3)

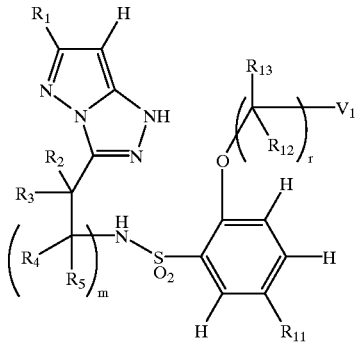

wherein $R_1$ represents a 4- to 8-carbon unsubstituted tertiary alkyl group; each of $R_2$, $R_3$, $R_4$, and $R_5$ independently represents a hydrogen atom or 1- to 4-carbon unsubstituted alkyl group, provided that at least one of $R_2$ and $R_3$ is not a hydrogen atom; m represents 0 or 1; $R_{11}$ represents a 4- to 8-carbon tertiary alkyl group or 5- to 10-carbon cycloalkyl group; each of $R_{12}$ and $R_{13}$ independently represents a hydrogen atom or 1- to 20-carbon alkyl group; r represents a natural number from 1 to 3; and $V_1$ represents a carboxyl group, 1- to 20-carbon substituted or unsubstituted carbamoly group, 2- to 20-carbon substituted or unsubstituted sulfonylaminocarbonyl group, or 1- to 20-carbon substituted or unsubstituted alkoxycarbonyl group.

6. The silver halide color photosensitive material according to claim 5, wherein the magenta coupler represented by formula (MC-3) is represented by formula (MC-4):

(MC-4)

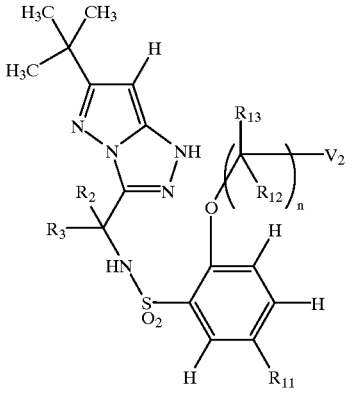

wherein each of $R_2$ and $R_3$ independently represent a hydrogen atom or 1- to 3-carbon unsubstituted alkyl group; $R_{11}$ represents a hydrogen atom, 1- to 8-carbon unsubstituted alkyl group, or 5- to 10-carbon cycloalkyl group; each of $R_{12}$ and $R_{13}$ independently represents a hydrogen atom or 1- to 20-carbon alkyl group; n represents a natural number from 1 to 3; and $V_2$ represents a group selected from the following groups:

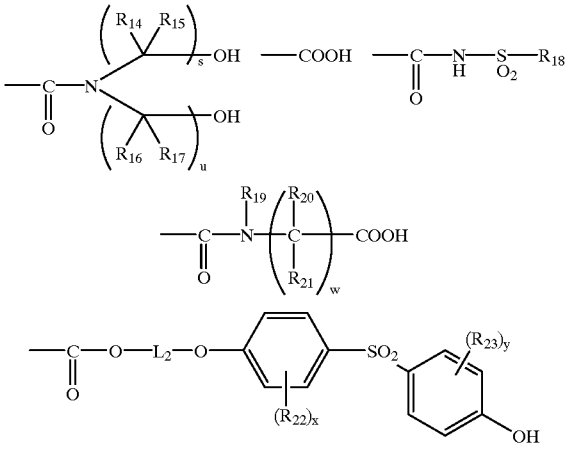

wherein each of $R_{14}$, $R_{15}$, $R_{16}$ and $R_{17}$ independently represents a hydrogen atom or 1- to 3-carbon unsubstituted alkyl group; each of s and u independently represents 2 or 3; $R_{18}$ represents a 1- to 8-carbon unsubstituted alkyl group or 6- to 20-carbon aryl group; w represents 1 or 2; $R_{19}$ represents a hydrogen atom or 1- to 20-carbon unsubstituted alkyl group; each of $R_{20}$ and $R_{21}$ independently represents a hydrogen atom or 1- to 3-carbon unsubstituted alkyl group; each of $R_{22}$ and $R_{23}$ independently represents a chlorine atom or bromine atom; each of x and y independently represents an integer from 0 to 2; and $L_2$ represents a 2- to 10-carbon alkylene group.

7. The silver halide color photosensitive material according to claim 6, wherein $R_2$ represents a methyl, ethyl, n-propyl or iso-propyl group; $R_3$ represents a hydrogen atom, a methyl or ethyl group; $R_{11}$ represents a hydrogen atom or a 1- to 8-carbon unsubstituted alkyl group; $R_{12}$ represents a hydrogen atom; and $R_{13}$ represents a hydrogen atom or a 1- to 16-carbon unsubstituted alkyl group; n represents a natural number from 1 to 3; and $V_2$ represents the following group:

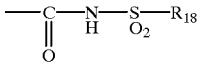

wherein $R_{18}$ represents a 1- to 8-carbon unsubstituted alkyl group or 6- to 20-carbon aryl group.

8. A method for forming a color image on a silver halide color photosensitive material comprising a step of performing black-and-white development followed by a step of reversal processing for material and a step of performing color development for the reversal processed material by using a color developer having a pH of 11.5 or more, wherein the material subjected to the black-and-white development is the material described in claim 1, and a replenishment rate of the color developer is less than 1.6 liters per $m^2$ of the material.

* * * * *